US010811242B2

(12) United States Patent
Zarrine-Afsar et al.

(10) Patent No.: US 10,811,242 B2
(45) Date of Patent: Oct. 20, 2020

(54) SOFT IONIZATION SYSTEM AND METHOD OF USE THEREOF

(71) Applicants: University Health Network, Toronto (CA); Unity Health Toronto, Toronto (CA)

(72) Inventors: Arash Zarrine-Afsar, Toronto (CA); Howard Joeseph Ginsberg, Toronto (CA); Michael Woolman, North York (CA)

(73) Assignee: University Health Network, Toronto, Ontario (CA)

( * ) Notice: Subject to any disclaimer, the term of this patent is extended or adjusted under 35 U.S.C. 154(b) by 81 days.

(21) Appl. No.: 16/308,749

(22) PCT Filed: Jun. 9, 2017

(86) PCT No.: PCT/CA2017/050713
§ 371 (c)(1),
(2) Date: Dec. 10, 2018

(87) PCT Pub. No.: WO2017/214718
PCT Pub. Date: Dec. 21, 2017

(65) Prior Publication Data

US 2020/0144044 A1 May 7, 2020

Related U.S. Application Data

(60) Provisional application No. 62/348,478, filed on Jun. 10, 2016.

(51) Int. Cl.
*H01J 49/04* (2006.01)
*H01J 49/00* (2006.01)

(52) U.S. Cl.
CPC ..... *H01J 49/049* (2013.01); *H01J 49/0036* (2013.01); *H01J 49/0445* (2013.01); *H01J 49/0463* (2013.01)

(58) Field of Classification Search
CPC .. H01J 49/049; H01J 49/0036; H01J 49/0445; H01J 49/0463
(Continued)

(56) References Cited

U.S. PATENT DOCUMENTS 6,504,150 B1 1/2003 Verentchikov et al.
8,029,501 B2 10/2011 Miller
(Continued)

FOREIGN PATENT DOCUMENTS

CA 2900686 A1 8/2014
WO 2010/136887 A1 12/2010
(Continued)

OTHER PUBLICATIONS

International Search Report and Written Opinion dated Nov. 30, 2016 in corresponding International Patent Application No. PCT/CA2016/051112 (13 pages).
(Continued)

*Primary Examiner* — Nicole M Ippolito
(74) *Attorney, Agent, or Firm* — Bereskin & Parr LLP/S.E.N.C.R.L., s.r.l.; Tony Orsi

(57) ABSTRACT

Methods and systems are provided for ionizing molecules for the purpose of analysis by mass spectrometry, in which gaseous material from a sample substrate is generated using laser desorption. The laser is provided having a pulse range of about 1-1000 picoseconds to produce the gaseous material. The gaseous material is heated to generate ions from the molecules present in the gaseous material where the amount of heat that is applied is in the temperature range of 45° C. to 250° C. and the applied heat results in soft ionization of the molecules. The ionized molecules are transported to a mass spectrometer for analysis.

19 Claims, 34 Drawing Sheets

(58) Field of Classification Search
USPC ..... 250/281, 282, 283, 288
See application file for complete search history.

(56) References Cited

U.S. PATENT DOCUMENTS

| | | | | |
|---|---|---|---|---|
| 9,287,100 | B2 | 3/2016 | Szalay et al. | |
| 2007/0141719 | A1 | 6/2007 | Bui | |
| 2007/0290129 | A1* | 12/2007 | Ogo | G01N 21/31 250/288 |
| 2008/0128608 | A1 | 6/2008 | Northen et al. | |
| 2008/0206131 | A1 | 8/2008 | Jaffray et al. | |
| 2009/0236518 | A1* | 9/2009 | Kobayashi | H01J 49/168 250/288 |
| 2009/0294660 | A1* | 12/2009 | Whitehouse | H01J 49/045 250/288 |
| 2010/0213367 | A1 | 8/2010 | Miller | |
| 2012/0156712 | A1 | 6/2012 | Takats | |
| 2012/0258485 | A1 | 10/2012 | Stauber et al. | |
| 2012/0286155 | A1* | 11/2012 | Mulligan | H01J 49/0468 250/282 |
| 2012/0312980 | A1* | 12/2012 | Whitehouse | H01J 49/145 250/282 |
| 2015/0287578 | A1 | 10/2015 | Bendall et al. | |
| 2015/0325422 | A1 | 11/2015 | Cramer | |
| 2018/0271502 | A1 | 9/2018 | Zarrine-Afsar et al. | |

FOREIGN PATENT DOCUMENTS

| | | | |
|---|---|---|---|
| WO | 2010/141763 | A1 | 12/2010 |
| WO | 2012/031082 | A2 | 3/2012 |
| WO | 2014/175211 | A1 | 10/2014 |
| WO | 2017/214718 | A1 | 12/2017 |

OTHER PUBLICATIONS

McLaughlin et al., "Influence of frozen-section analysis of sentinel lymph node and lumpectomy margin status on reoperation rates in patients undergoing breast-conservation therapy", J Am Coll Surg, 2008, 206(1): 76-82.
Abbas et al., "The incidence of carcinoma in cytologically benign thyroid cysts", Surgery, 2001, 130(6): 1035-1038.
Erguvan-Dogan et al., "Specimen radiography in confirmation of MRI-guided needle localization and surgical excision of breast lesions", AJR Am J Roentgenol, 2006, 187(2): 339-344.
Jolesz, "Intraoperative imaging in neurosurgery: where will the future take us?", Acta Neurochir Suppl , 2011, 109: 21-25.
Haka et al., "In vivo margin assessment during partial mastectomy breast surgery using raman spectroscopy", Cancer Res, 2006, 66(6): 3317-3322.
Thomusch et al., "Validity of intra-operative neuromonitoring signals in thyroid surgery", Langenbecks Arch Surg, 2004, 389(6): 499-503.
Thomusch et al., "Intraoperative neuromonitoring of surgery for benign goiter", Am J Surg, 2002, 183(6): 673-678.
Curatolo et al., "Ultrasound-guided optical coherence tomography needle probe for the assessment of breast cancer tumor margins", AJR Am J Roentgenol, 2012, 199(4): W520-522.
Kennedy et al., "Needle optical coherence elastography for the measurement of microscale mechanical contrast deep within human breast tissues", J Biomed Opt, 2013, 18(12): 121510.
Kennedy et al., "Investigation of Optical Coherence Microelastography as a Method to Visualize Cancers in Human Breast Tissue", Cancer Res, Aug. 2015, 75(16): 3236-3245.
McLaughlin et al., "Imaging of human lymph nodes using optical coherence tomography: potential for staging cancer", Cancer Res, 2010, 70(7): 2579-2584.
McLaughlin et al., "Parametric imaging of cancer with optical coherence tomography", J Biomed Opt, 2010, 15(4): 046029-1 to 046029-4.
Gianfelice et al., "MR imaging-guided focused ultrasound surgery of breast cancer: correlation of dynamic contrast-enhanced MRI with histopathologic findings", Breast Cancer Res Treat, 2003, 82(2): 93-101.
Wiseman et al., "Tissue imaging at atmospheric pressure using desorption electrospray ionization (DESI) mass spectrometry", Angew Chem Int Ed Engl, 2006, 45(43): 7188-7192.
Eberlin et al., "Molecular assessment of surgical-resection margins of gastric cancer by mass-spectrometric imaging", Proc Natl Aced Sci U S A, 2014, 111(7): 2436-2441.
Eberlin et al., "Cholesterol sulfate imaging in human prostate cancer tissue by desorption electrospray ionization mass spectrometry", Analytical Chemistry, 2010, 82(9): 3430-3434.
Dill et al., "Multivariate statistical differentiation of renal cell carcinomas based on lipidomic analysis by ambient ionization imaging mass spectrometry", Anal Bioanal Chem, 2010, 398(7-8): 2969-2978.
Dill et al., "Multivariate statistical identification of human bladder carcinomas using ambient ionization imaging mass spectrometry", Chemistry, 2011, 17(10): 2897-2902.
Eberlin et al., "Classifying human brain tumors by lipid imaging with mass spectrometry", Cancer Res, 2012, 72(3): 645-654.
Eberlin et al., "Ambient mass spectrometry for the intraoperative molecular diagnosis of human brain tumors", Proc Natl Acad Sci U S A, 2013, 110(5): 1611-1616.
Santagata et al., Intraoperative mass spectrometry mapping of an onco-metabolite to guide brain tumor surgery, Proc Natl Acad Sci U S A, 2014, 111(30): 11121-11126.
Dill et al., "Lipid profiles of canine invasive transitional cell carcinoma of the urinary bladder and adjacent normal tissue by desorption electrospray ionization imaging mass spectrometry", Analytical Chemistry, 2009, 81(21): 8758-8764.
Dill et al., "Mass spectrometric imaging of lipids using desorption electrospray ionization", J Chromatogr B Analyt Technol Biomed Life Sci, 2009, 877(26): 2883-2889.
Calligaris et al., "Molecular typing of meningiomas by desorption electrospray ionization mass spectrometry imaging for surgical decision-making", International Journal of Mass Spectrometry, Feb. 2015, 377: 690-698.
Eberlin et al., "Nondestructive, histologically compatible tissue imaging by desorption electrospray ionization mass spectrometry", Chembiochem, 2011, 12(14): 2129-2132.
Tata et al., "Contrast Agent Mass Spectrometry Imaging Reveals Tumour Heterogeneity", Anal Chem, Aug. 2015, 87(15): 7683-7689.
Alali et al., "Optimization of rapid Mueller matrix imaging of turbid media using four photoelastic modulators without mechanically moving parts", Opt Eng, 2013, 52(10): 103114-1 to 103114-8.
Tillner et al., "Investigation of the Impact of Desorption Electrospray Ionization Sprayer Geometry on Its Performance in Imaging of Biological Tissue", Anal Chem, Mar. 25, 2016, 88(9): 4808-4816.
Škrášková et al., "Enhanced capabilities for imaging gangliosides in murine brain with matrix-assisted laser desorption/ionization and desorption electrospray ionization mass spectrometry coupled to ion mobility separation", Methods, Jul. 15, 2016 (Epub: Feb. 23, 2016), 104: 69-78.
Zou et al., "Ambient Mass Spectrometry Imaging with Picosecond Infrared Laser Ablation Electrospray Ionization (PIR-LAESI)", Anal Chem, Dec. 2015, 87(24): 12071-12079.
Schäfer et al., "In vivo, in situ tissue analysis using rapid evaporative ionization mass spectrometry", Angew Chem Int Ed Engl, 2009, 48(44): 8240-8242.
Balog et al., "Intraoperative tissue identification using rapid evaporative ionization mass spectrometry", Sci Transl Med, 2013, 5(194): 194ra193. pp. 1-11.
Balog et al., "In vivo endoscopic tissue identification by rapid evaporative ionization mass spectrometry (REIMS)", Angew Chem Int Ed Engl, Sep. 14, 2015, 54(38): 11059-11062.
Amini-Nik et al., "Ultrafast Mid-IR Laser Scalpel: Protein Signals of the Fundamental Limits to Minimally Invasive Surgery", PLoS One, 2010, 5(9): e13053, pp. 1-6.

(56) References Cited

OTHER PUBLICATIONS

Tata et al., "Rapid Detection of Necrosis in Breast Cancer with Desorption ElectroSpray Ionization Mass Spectrometry", Scientific Reports, Oct. 13, 2016 (submitted May 16, 2016), 6: 35374, pp. 1-10.
Calligaris et al., "Application of desorption electrospray ionization mass spectrometry imaging in breast cancer margin analysis", Proc Natl Acad Sci U S A, 2014, 111(42): 15184-15189.
Guenther et al., "Spatially resolved metabolic phenotyping of breast cancer by desorption electrospray ionization mass spectrometry", Cancer Res, May 2015, 75(9): 1828-1837.
Tata et al., "Wide-field tissue polarimetry allows efficient localized mass spectrometry imaging of biological tissues," Chemical Science, 2016 (first published Dec. 15, 2015), 7: 2162-2169.
Azu et al., "What is an adequate margin for breast-conserving surgery? Surgeon attitudes and correlates", Annals of surgical oncology, 2010, 17(2): 558-563.
Bhatti et al., "Safe negative margin width in breast conservative therapy: results from a population with a high percentage of negative prognostic factors", World Journal of Surgery, 2014, 38(11): 2863-2870.
Puri et al., "A method for accurate spatial registration of PET images and histopathology slices", EJNMMI Research, Nov. 2015, 5(1): 64, pp. 1-11.
Ghosh et al., "Mueller matrix decomposition for polarized light assessment of biological tissues", Journal of Biophotonics, 2009, 2(3): 145-156.
Chamma et al., "Optically-tracked handheld fluorescence imaging platform for monitoring skin response in the management of soft tissue sarcoma", Journal of Biomedical Optics, Jul. 2015, 20(7): 076011.
Qiu et al., "Displaying 3D radiation dose on endoscopic video for therapeutic assessment and surgical guidance", Physics in Medicine and Biology, 2011, 57(20): 6601-6614.
Weersink et al., "Improving superficial target delineation in radiation therapy with endoscopic tracking and registration", Medical Physics, 2011, 38(12): 6458-6468.
Desai et al., "Fragment recruitment on metabolic pathways: comparative metabolic profiling of metagenomes and metatranscriptomes", Bioinformatics, 2013, 29(6): 790-791.
Morris et al., "Evaluation of pectoralis major muscle in patients with posterior breast tumors on breast MR images: early experience", Radiology, 2000, 214(1): 67-72.
McDonnell et al., "Imaging mass spectrometry", Mass Spectrum Rev, 2007, 26(4): 606-643.
Yang et al., "Accurate quantification of lipid species by electrospray ionization mass spectrometry—Meet a key challenge in lipidomics", Metabolites, 2011, 1(1): 21-40.
Wu et al., "Molecular imaging of adrenal gland by desorption electrospray ionization mass spectrometry", Analyst, 2010, 135(1): 28-32.
Wu et al., "Rapid, Direct Analysis of Cholesterol by Charge Labeling in Reactive Desorption Electrospray Ionization", Analytical Chemistry, 2009, 81(18): 7618-7624.
Veselkov et al., "Chemo-informatic strategy for imaging mass spectrometry-based hyperspectral profiling of lipid signatures in colorectal cancer", Proc. Natl. Acad. Sci. U S A, 111(3): 1216-1221 (Jan. 21, 2014).
Forsythe et al., "Semitransparent Nanostructured Films for Imaging Mass Spectrometry and Optical Microscopy", Anal Chem., 2012, 84(24): 10665-10670.
Olga et al., "Co-registered Topographical, Band Excitation Nanomechanical, and Mass Spectral Imaging Using a Combined Atomic Force Microscopy/Mass Spectrometry Platform", ACS Nano, 2015, 4(9):4260-4269.
Agar et al., "Development of Stereotactic Mass Spectrometry for Brain Tumor Surgery", Neurosurgery, 2011, 68(2): 280-290.
Van De Plas et al., "Image fusion of mass spectrometry and microscopy: a multimodality paradigm for molecular tissue mapping", Nature Methods, 12(4): 366-372 (Mar. 5, 2014; published Feb./Apr. 2015).
Desantis et al., "Breast Cancer Statistics, 2013", CA: A Cancer Journal for Clinicians, 2014, 64(1): 52-62.
Esbona et al., "Intraoperative Imprint Cytology and Frozen Section Pathology for Margin Assessment in Breast Conservation Surgery: A Systematic Review", Ann. Surg. Oncol., 2012, 19(10): 3236-3245.
Staradub et al., "Changes in Breast Cancer Therapy Because of Pathology Second Opinions", Annals of Surgical Oncology, 2002, 9(10): 982-987.
Wiseman et al., "Ambient molecular imaging by desorption electrospray ionization mass spectrometry", Nature Protocols, 2008, 3(3): 517-524.
Eberlin et al., "Desorption Imaging", Biochimica et Biophysica Acta, 2011, 1811(11): 946-960.
Wu et al., "Mass Spectrometry Imaging Under Ambient Conditions", Mass Spectrometry Reviews, 2013, 32(3): 218-543.
Tweedle, "Physicochemical Properties of Gadoteridol and Other Magnetic Resonance Contrast Agents", Investigative Radiology, 1992, 27 Suppl 1: S2-S6.
Hann et al., "Elemental analysis in biotechnology", Current Opinion in Biotechnology, Feb. 2015, 31: 93-100.
Becker et al., "Bioimaging mass spectrometry of trace elements—recent advance and applications of LA-ICP-MS: A review", Analytica Chimica Acta, 2014, 835: 1-18.
Perazella et al., "Imaging Patients With Kidney Disease: How Do We Approach Contrast-Related Toxicity?", The American Journal of the Medical Sciences, 2011, 341(3): 215-221.
Egeland et al., "Magnetic resonance imaging of tumor necrosis", Acta Oncologica, 2011, 50(3): 427-434.
Piggee, "In vivo molecular imaging by LAESI MS", Analytical Chemistry, 2008, 80(13): 4783.
Kwiatkowski et al., "Ultrafast Extraction of Proteins from Tissues Using Desorption by Impulsive Vibrational Excitation", Angew. Chem. Int. Ed., 54(2): 285-288 (Jan. 2, 2015).
Katenkamp et al., "Metastasis induction by incomplete tumor resection. A new metastasis model using inoculation sarcomas in adult nude mice after long-term cultivation of sarcoma cells", Exp. Toxic. Pathol., 1992, 44(1): 25-28.
Guenther et al., "Electrospray Post-Ionization Mass Spectrometry of Electrosurgical Aerosols", J. Am. Soc. Mass Spectrom., 2011, 22(11): 2082-2089.
Dill et al., "Perspectives in imaging using mass spectrometry", Chem. Commun., 2011, 47(10): 2741-2746.
Eberlin et al., "Instantaneous chemical profiles of banknotes by ambient mass spectrometry", Analyst, 2010, 135(10): 2533-2539.
Eberlin et al., "Three-Dimensional Vizualization of Mouse Brain by Lipid Analysis Using Ambient Ionization Mass Spectrometry", Angew. Chem. Int. Ed., 2010, 49(5): 873-876.
Cooks et al., "New ionization methods and miniature mass spectrometers for biomedicine: DESI imaging for cancer diagnostics and paper spray ionization for therapeutic drug monitoring", Faraday Discuss., 2011, 149: 247-267.
Dénes et al., "Metabonomics of Newborn Screening Dried Blood Spot Samples: A Novel Approach in the Screening and Diagnostics of Inborn Errors of Metabolism", Anal. Chem., 2012, 84(22): 10113-10120.
Dill et al., "Data quality in tissue analysis using desorption electrospray ionization", Anal. Bioanal. Chem., 2011, 401(6): 1949-1961.
Ifa et al., "Forensic analysis of inks by imaging desorption electrospray ionization (DESI) mass spectrometry", Analyst, 2007, 132(5): 461-467.
Ifa et al., "Forensic applications of ambient ionization mass spectrometry", Anal. Bioanal. Chem., 2009, 394(8): 1995-2008.
Ifa et al., "Latent Fingerprint Chemical Imaging by Mass Spectrometry", Science, 2008, 321(5890): 805.
Ifa et al., "Quantitative analysis of small molecules by desorption electrospray ionization mass spectrometry from polytetrafluoroethylene surfaces", Rapid Commun. Mass Spectrom., 2008, 22(4): 503-510.

(56) References Cited

OTHER PUBLICATIONS

Ifa et al., "Desorption electrospray ionization and other ambient ionization methods: current progress and preview", Analyst, 2010, 135(4): 669-681.
Manicke et al., "High-resolution tissue imaging on an orbitrap mass spectrometer by desorption electrospray ionization mass spectrometry", J. Mass. Spectrom., 2010, 45(2): 223-226.
Manicke et al., "High-Throughput Quantitative Analysis by Desorption Electrospray Ionization Mass Spectrometry", J. Am. Soc. Mass. Spectrom., 2008, 20(2): 321-325.
Manicke et al., "Desorption Electrospray Ionization (DESI) Mass Spectrometry and Tandem Mass Spectrometry (MS/MS) of Phospholipids and Sphingolipids: Ionization, Adduct Formation, and Fragmentation", J. Am. Soc. Mass. Spectrom., 2008, 19(4): 531-543.
Müller et al., "Direct Plant Tissue Analysis and Imprint Imaging by Desorption Electrospray Ionization Mass Spectrometry", Anal. Chem., 2011, 83(14): 5754-5761.
Paglia et al., "Desorption Electrospray Ionization Mass Spectrometry Analysis of Lipids after Two-Dimensional High-Performance Thin-Layer Chromatography Partial Separation", Anal. Chem., 2010, 82(5): 1744-1750.
Smith et al., "Dual-Source Mass Spectrometer with MALDI-LIT-ESI Configuration", Journal of Proteome Research, 2007, 6(2): 837-845.
Srimany et al., "Direct analysis of camptothecin from Nothapodytes nimmoniana by desorption electrospray ionization mass spectrometry (DESI-MS)", Analyst, 2011, 136(15): 3066-3068.
Takats et al., "Desorption Electrospray Ionization: Proteomics Studies by a Method That Bridges ESI and MALDI", CSH Protocols, 2008, 3(4): pdb.top37 (pp. 1-5).
Takats et al., "In Situ Desorption Electrospray Ionization (DESI) Analysis of Tissue Sections", CSH Protocols, 2008, 3(4): pdb. prot4994 (pp. 1-4).
Takats et al., "Desorption Electrospray Ionization (DESI) Analysis of Tryptic Digests/Peptides", CSH Protocols, 2008, 3(4): pdb. pro4993 (pp. 1-4).
Takats et al., "Desorption Electrospray Ionization (DESI) Analysis of Intact Proteins/Oligopeptides", CSH Protocols, 2008, 3(4): pdb. prot4992 (pp. 1-4).
Wiseman et al., "Desorption electrospray ionization mass spectrometry: Imaging drugs and metabolite in tissues", PNAS, 2008, 105(47): 18120-18125.
Lu et al., "Interpretation of Mueller matrices based on polar decomposition", Journal of Optical Society of America A, 1996, 13(5): 1106-1113.
Balog et al., "Identification of Biological Tissues by Rapid Evaporative Ionization Mass Spectrometry", Analytical Chemistry, 2010, 82(17): 7343-7350.
Balog et al., "Instantaneous Identification of the Species of Origin for Meat Products by Rapid Evaporative Ionization Mass Spectrometry", J Agric Food Chem, May 2016, 64(23): 4793-4800.
Sächfer et al., "In situ, real-time identification of biological tissues by ultraviolet and infrared laser desorption ionization mass spectrometry", Anal Chem, 2011, 83(5): 1632-1640.
He et al., "Air flow assisted ionization for remote sampling of ambient mass spectrometry and its application", Rapid Commun Mass Spectrom, 2011, 25(7): 843-850.
Guest, "Recent Developments of Laser Microprobe Mass Analyzers, Lamma-500 and Lamma-1000", International Journal of Mass Spectrometry and Ion Processes, 1984, 60(1): 189-199.
Nemes et al., "Atmospheric-pressure Molecular Imaging of Biological Tissues and Biofilms by LAESI Mass Spectrometry", J Vis Exp., 2010, (43) pii: 2097; pp. 1-4.
Jecklin et al., "Atmospheric pressure glow discharge desorption mass spectrometry for rapid screening of pesticides in food", Rapid Commun Mass Spectrom., 2008, 22(18): 2791-2798.
Na et al., "Development of a dielectric barrier discharge ion source for ambient mass spectrometry", J Am Soc Mass Spectrom., 2007, 18(10): 1859-1862.
Jorabchi et al., "Charge assisted laser desorption/ionization mass spectrometry of droplets", J Am Soc Mass Spectrom., 2008, 19(6): 883-840.
Galhena et al., "Small molecule ambient mass spectrometry imaging by infrared laser ablation metastable-induced chemical ionization", Anal Chem., 2010, 82(6): 2178-2181.
Kwiatkowski et al., "Homogenization of tissues via picosecond-infrared laser (PIRL) ablation: Giving a closer view on the in-vivo composition of protein species as compared to mechanical homogenization", J Proteomics, Feb. 16, 2016, 134: 193-202.
Schäfer et al., "Real time analysis of brain tissue by direct combination of ultrasonic surgical aspiration and sonic spray mass spectrometry", Analytical Chemistry, 2011, 82(20): 7729-7735.
Cowan et al., "Ultrafast memory loss and energy redistribution in the hydrogen bond network of liquid H2O", Nature, 2005, 434(7030): 199-202.
Northcott et al., "Medullosblastoma comprises four distinct molecular variants", J Clin Oncol, 2011, 29(11): 1408-1414.
Ramaswamy et al., "Risk stratification of childhood medulloblastoma in the molecular era: the current consensus", Acta Neuropathol, Apr. 4, 2016, 131(6): 821-831.
Sabha et al., "Analysis of IDH mutation, 1p/19q deletion, and PTEN loss delineates prognosis in clinical low-grade diffuse gliomas", Neuro Oncol, 2014, 16(7): 914-923.
Gottardo et al., "Medulloblastoma Down Under 2013: a report from the third annual meeting of the International Medulloblastoma Working Group", Acta Neuropathol, 2014, 127(2): 189-201.
Ifa et al., "Ambient Ionization Mass Spectrometry for Cancer Diagnosis and Surgical Margin Evaluation", Clin Chem, Jan. 2016 (published online: Nov. 10, 2015), 62(1): 111-123.
Zhang et al., "Will Ambient Ionization Mass Spectrometry Become an Integral Technology in the Operating Room of the Future?", Clinical Chemistry, Sep. 1, 2016, 62(9): 1172-1174.
Takats et al., "Ambient Mass Spectrometry in Cancer Research", Adv Cancer Res, 2017, 134: 231-256.
Fenselau et al., "Desorption of ions from rat membranes: selectivity of different ionization techniques", Biomed Environ Mass Spectrom, 1989, 18(12): 1037-1045.
Gerbig et al., "Analysis of colorectal adenocarcinoma tissue by desorption electrospray ionization mass spectrometric imaging", Anal Bioanal Chem, 2012, 403(8): 2315-2325.
Jarmusch et al., "Lipid and metabolite profiles of human brain tumors by desorption electrospray ionization-MS", Proc Natl Acad Sci U S A, Feb. 9, 2016, 113(6): 1486-1491.
Woolman et al., "An Assessment of the Utility of Tissue Smears in Rapid Cancer Profiling with Desorption Electrospray Ionization Mass Spectrometry (DESI-MS)", J Am Soc Mass Spectrom, 2017, 28(1): 145-153.
Franjic et al., "Vibrationally excited ultrafast thermodynamic phase transitions at the water/air interface", Phys Chem Chem Phys, 2010, 12(20): 5225-5239.
Franjic et al., "Laser selective cutting of biological tissues by impulsive heat deposition through ultrafast vibrational excitations", Opt Express, 2009, 17(25): 22937-22959.
Woolman et al., "Optimized Mass Spectrometry Analysis Workflow with Polarimetric Guidance for ex vivo and in situ Sampling of Biological Tissues", 2017, Sci Rep, 7(1): 468; pp. 1-12.
Reinoso et al., "Tissue water content in rats measured by dessication", J Pharmacol Toxicol Methods, 1997, 38(2): 87-92.
Xia et al., "MetaboAnalyst: a web server for metabolomic data analysis and interpretation", Nucleic Acids Res, 2009, 37(Web Server issue): W652-W660.
Xia et al., "MetaboAnalyst 3.0—making metabolomics more meaningful", Nucleic Acids Research, Jul. 2015, 43(W1):W251-W257.
Worley et al., "Multivariate Analysis in Metabolomics", 2013, Curr Metabolomics, 1(1): 92-107.
Fatou et al., "In vivo Real-Time Mass Spectrometry for Guided Surgery Application", Sci Rep, May 18, 2016, 6: 25919; pp. 1-14.
Griffin et al., "Metabolic profiles of cancer cells", Nat Rev Cancer, 2004, 4(7): 551-561.
Furey et al., "Ion suppression: a critical review on causes, evaluation, prevention and applications", Talanta, 2013, 115: 104-122.

(56) References Cited

OTHER PUBLICATIONS

International Preliminary Report on Patentability dated Apr. 5, 2018 in corresponding International Patent Application No. PCT/CA2016/051112 (8 pages).
International Search Report and Written Opinion dated Jan. 5, 2018 in corresponding International Patent Application No. PCT/CA2017/050713 (13 pages).
International Preliminary Report on Patentability dated Dec. 20, 2018 in corresponding International Patent Application No. PCT/CA2017/050713 (9 pages).
Notice of Publication dated Mar. 20, 2019 in corresponding EP Patent Application No. 17812350.1 (1 page).
Extended European Search Report dated Dec. 20, 2019 in EP Patent Application No. 17812350.1 (10 pages).
Protea, "Histology Guided Mass Spectrometry: A New Analytical Workflow for Clinical Research and Biomarker Discovery", accessed Sep. 15, 2015, website <https://proteabio.com/downloadCenter/Histology+Guided+Mass+Spectrometry:+A+New+Analytical+Workflow+for+Clinical+Research+and+Biomarker+Discovery>.
Taverna et al., "Histology-directed and imaging mass spectrometry: An emerging technology in ectopic calcification", Bone, May 2015, 74: 83-94.
Wood et al., "Polarization birefringence measurements for characterizing the myocardium, including healthy, infarcted, and stem-cell-regenerated tissues", J. Biomed Opt., 2010, 15(4): 047009-1 to 047009-9.
Ghosh et al., "Polarimetry in turbid, birefringent, optically active media: A Monte Carlo study of Mueller matrix decomposition in the backscattering geometry", Appl. Phys., 2009, 105(10): 102023-1 to 102023-8.
Alali et al., "Assessment of local structural disorders of the bladder wall in partial bladder outlet obstruction using polarized light imaging", Biomed. Opt. Express, 2013 (published Jan. 27, 2014), 5(2): 621-629.
Ghosh et al., "Influence of the order of the constituent basis matrices on the Mueller matrix decomposition-derived polarization parameters in complex turbid media such as biological tissues", Opt. Comm., 2010, 283(6): 1200-1208.
Côté et al., "Robust concentration determination of optically active molecules in turbid media with validated three-dimensional polarization sensitive Monte Carlo calculations", Opt. Express, 2005, 13(1): 148-163.
Antonelli et al., "Mueller matrix imaging of human colon tissue for cancer diagnostics: how Monte Carlo modeling can help in the interpretation of experimental data", Opt. Express, 2010, 18(1): 10200-10208.
Pierangelo et al., "Polarimetric imaging of uterine cervix: a case study", Opt. Express, 2013, 21(12): 14120-14130.
Rodriguez-Brenes et al., "Minimizing the risk of cancer: tissue architecture and cellular replication limits", J. R. Soc. Interface, 2013, 10(86): 20130410 (pp. 1-12).

* cited by examiner

Relative abundance
m/z
279.2328 Linoleic acid[M-H]-
281.2487 Oleic acid [M-H]-
303.2341 Arachidonic acid [M-H]-
331.2670 Adrenic acid [M-H]-
885.5495

Relative abundance
m/z
279.2328
281.2487 Oleic acid [M-H]-
Linoleic acid [M-H]-
303.2341 Arachidonic acid [M-H]-
331.2670 Adrenic acid [M-H]-

Comparison of PIRL MS spectra of mouse organs

Statistical discrimination of mouse organs based on PIRL MS sampling

SOFT IONIZATION SYSTEM AND METHOD OF USE THEREOF

CROSS REFERENCE TO RELATED APPLICATION

This application is a 35 USC § 371 national stage entry of International Patent Application No. PCT/CA2017/050713, filed June 9, 2017, which claims the benefit of United States Provisional Patent Application No. 62/348,478, filed June 10, 2016, entitled "SOFT IONIZATION SYSTEM AND METHOD OF USE THEREOF"; the entire contents of each of which are hereby incorporated herein in their entirety by reference.

FIELD

The various embodiments described herein generally relate to a system and method of use for soft ionization of materials.

BACKGROUND

Rapid Evaporative Ionization Mass Spectrometry (REIMS) technology has been instrumental in the development of the Intelligent' surgical knife (iKnife) which is an electrocautery blade with its smoke evacuation line attached to an REIMS interface[1-3]. The iKnife is used for the purpose of in situ, intraoperative tissue identification[1].

REIMS uses a jet of Nitrogen gas rapidly mixed with tissue plume from electrocautery[1] or laser ablation[4] through a Venturi pump that facilitates both the transport of tissue plume (e.g. smoke, desorptive particles or larger aerosols) to the mass spectrometer and the evaporation of water or solvent molecules from tissue material present in the plume, resulting in evaporative ionization of the plume content and subsequent detection with Mass Spectrometry (MS) as shown in FIG. 1. The basic idea behind this methodology is similar to an air flow-assisted ionization method where mixing of air with aerosols produced from material facilitates ionization[5].

Ionizing lasers capable of ablation/desorption and simultaneous ionization of material have been directly coupled to MS for analysis of material[6]. However, with the discovery of non-ionizing lasers capable of 'gentle' desorption of neutral molecules such as Nanosecond or Picosecond Infra-Red Laser (PIRL), post ablation ionization by means of ElectroSpray Ionization is required to produce ionized materials[7,8]. Ionization of the laser plume by means of REIMS[4], or ElectroSpray Ionization (ESI) as in Laser Ablation ElectroSpray Ionization (LAESI)[7,8] remain two prominent methodologies to provide post ablation/desorption ionization of laser processed materials for MS analysis.

A mass spectrometer is comprised of a mass analyzing or sensing unit that operates in vacuum, an interface to mediate the transport of analytes from the atmosphere to vacuum, and an ion source which employs a mechanism to generate ions required for mass spectrometry analysis. The MS interface may additionally contain an analyte (or aerosol) transport tube or capillary or an extension thereof to facilitate the transfer of analytes from a distance to the mass spectrometer. The ion source (or ion generating mechanism) may be atmospheric or in vacuum (e.g. ions may be either generated in the atmosphere and transported to vacuum or may be generated in vacuum after the transport of analytes). The transport of analytes to the mass spectrometer may either be facilitated by an intrinsic pressure gradient between a mass analyzing unit, an interface and the ion source and may further be aided by differential pumping or an active mechanism.

SUMMARY OF VARIOUS EMBODIMENTS

In a broad aspect, at least one embodiment described herein provides a method for ionizing molecules for the purpose of analysis by mass spectrometry, wherein the method comprises: generating predominantly gaseous material from a sample substrate, wherein the gaseous material is generated using laser desorption using a laser having a pulse range of about 1-1000 picoseconds to produce the gaseous material; heating the gaseous material to generate ions from the molecules present in the gaseous material where the amount of heat that is applied is in the temperature range of 45° C. to 250° C. and the applied heat results in soft ionization of said molecules; and transporting the ionized molecules to a mass spectrometer for analysis.

In at least some embodiments, the method is utilized to differentiate between tumour subtypes.

In at least some embodiments, the differentiated tumour subtypes are brain tumour subtypes In another broad aspect, at least one embodiment described herein provides a method for ionizing molecules present in a gaseous material, a vapourized material, a plume of material, a desorbed material, or an aerosolized material for the purpose of analysis by mass spectrometry, wherein the method comprises: heating the gaseous material, the vapourized material, the plume material or the aerosolized material to facilitate heat-induced evaporative soft ionization of said molecules.

In another broad aspect, at least one embodiment described herein provides a method for ionizing molecules present in a gaseous material, a vapourized material, a plume material, a desorbed material, or an aerosolized material for the purpose of analysis by mass spectrometry, wherein the method comprises: generating the gaseous material, the vapourized material, the plume material, the desorbed material or the aerosolized material; heating the gaseous material, the vapourized material, the plume material, the desorbed material, or the aerosolized material to generate ions from the molecules present in the gaseous material, the vapourized material, the plume material, the desorbed material, or the aerosolized material, where an amount of heat is used to achieve heat-induced evaporative soft ionization of said molecules, the heating being applied in the temperature range of 45° C. to 250° C.; and transporting the ions to a mass spectrometer for analysis.

In at least some embodiments, the heating may be applied to remove solvent from the gaseous material, the vapourized material, the plume material, the desorbed material or the aerosolized material while generating the ions using heat-induced evaporative soft ionization.

In at least some embodiments, a heat-induced soft ionization source may be located to apply heat in the temperature range at any point between a site of aerosol, plume, gas or vapour generation and an entrance of the mass spectrometer.

The amount of heating used is generally below the amount of heating used to generate thermal, plasma or corona (glow) ionization.

In at least some embodiments, the gaseous material, the vapourized material, the plume material, the desorbed material or the aerosolized material may be produced using one of laser ablation, laser desorption, joules heating, cauterization, electrocautery, radio frequency ablation, ultrasonic aspiration, chemical extraction and aerosol generation using mechanical or acoustic means.

In at least some embodiments, the gaseous material may arise directly from volatile material.

In at least some embodiments, the method may comprise using electrocautery to produce the gaseous material.

In at least some embodiments, the method may comprise using pico-second infrared laser ablation or desorption to produce the gaseous material.

In at least some embodiments, the method may comprise using nanosecond infrared laser ablation or desorption to produce the gaseous material.

In at least some embodiments, the method may comprise producing the gaseous material in the presence of additional solvent or matrix materials.

In at least some embodiments, the heating is applied in the range of 50° C. to 150° C.

The amount of heat applied is generally below a level that causes fragmentation or disintegration of one or more molecules of interest.

In another broad aspect, at least one embodiment described herein provides a method for ionizing molecules from a sample for the purpose of differentiating between tumour subtypes analysis using mass spectrometry, wherein the method comprises: generating predominantly gaseous material from the sample, the gaseous material being generated using nanosecond infrared laser ablation or desorption with a laser having a pulse range of about 1-1000 picoseconds to produce the gaseous material; heating the gaseous material to generate ions from the molecules present in the gaseous material where the amount of heat that is applied is in the temperature range of 45° C. to 250° C. and the applied heat results in soft ionization of said molecules; and transporting the ionized molecules to a mass spectrometer for analysis.

In another broad aspect, at least one embodiment described herein provides a device for ionizing molecules for the purpose of analysis by mass spectrometry, comprising an input for receiving predominantly gaseous material from a sample substrate, the gaseous material being generated using laser desorption using a laser having a pulse range of about 1-1000 picoseconds to produce the gaseous material; a transport tube coupled to the input and being configured to allow for conduction of heat to facilitate heat-induced evaporative soft ionization of molecules in the gaseous material, where the amount of heat that is applied is in the temperature range of 45° C. to 250° C. and the applied heat results in soft ionization of said molecules; and an output coupled to the transport tube for providing the ionized molecules to a downstream mass spectrometer for analysis.

In at least some embodiments, the device is used to differentiate between tumour subtypes.

In at least some embodiments, the device is used to differentiate between brain tumour subtypes.

In another broad aspect, at least one embodiment described herein provides a device comprising an input for receiving a gaseous material, a vapourized material, a plume material, a desorbed material or an aerosolized material; a transport tube coupled to the input and being configured to allow for conduction of heat to facilitate heat-induced evaporative soft ionization of molecules in the gaseous material, the vapourized material, the plume material, the desorbed material or the aerosolized material, where an amount of heat is applied to achieve heat-induced evaporative soft ionization of said molecules, the heating being applied in the temperature range of 45° C. to 250° C.; and an output coupled to the transport tube for providing the ionized molecules to a downstream mass spectrometer for analysis.

In at least some embodiments, the transport tube is heated using a heat source and a controller coupled to the heat source for controlling the amount of heat provided by the heat source.

In at least some embodiments, the device comprises the heat source and the controller.

In at least some embodiments, the transport tube may be heated using a heat source such as a tape heater or a Peltier element.

In at least some embodiments, the transport tube may be heated using infrared radiation.

In at least some embodiments, the gaseous material, the vapourized material, the plume material, the desorbed material or the aerosolized material may be transported to the mass spectrometer via a flexible tubing attached to an analyte collection tube of an interface of the mass spectrometer.

In at least some embodiments, the analyte collection tube may be an analyte collection tube of a commercial Desorption ElectroSpray Ionization source.

In at least some embodiments, the heating may be applied to the analyte collection tube of the mass spectrometer through elevating a temperature of the mass spectrometer interface and the analyte collection tube is metallic.

In at least some embodiments, the temperature of the mass spectrometer interface may be maintained at an optimal, manufacturer-suggested working temperature to facilitate the heat-induced evaporative soft ionization of molecules.

In at least some embodiments, the heating may be applied to a metallic analyte collection tube of the mass spectrometer via an external heating element including one of a tape heater, a Peltier element, or an infrared radiation source.

In at least some embodiments, the transport tube generally is made of a material having a thermal conductivity, surface area and length that allow for effective heating and conduction of deposited/present heat to the gaseous material as it is transported through the transport tube.

In another broad aspect, at least one embodiment described herein provides a device for ionizing molecules from a sample for the purpose of differentiating between tumour subtypes analysis using mass spectrometry, wherein the device comprises: an input for receiving predominantly gaseous material from the sample, the gaseous material being generated using nanosecond infrared laser ablation or desorption with a laser having a pulse range of about 1-1000 picoseconds to produce the gaseous material; a transport tube coupled to the input and being configured to allow for conduction of heat to facilitate heat-induced evaporative soft ionization of molecules in the gaseous material, where the amount of heat that is applied is in the temperature range of 45° C. to 250° C. and the applied heat results in soft ionization of said molecules; and an output coupled to the transport tube for providing the ionized molecules to a downstream mass spectrometer for analysis.

In at least some embodiments, the transport tube is heated using a heat source and a controller coupled to the heat source for controlling the amount of heat provided by the heat source.

In another broad aspect, at least one embodiment described herein provides a method of identification of material by mass spectrometry, wherein the method comprises: identifying and exposing a surface of a material to be analyzed; generating a gaseous variant of the material using the methods defined according to the teachings herein;

transporting the gaseous material towards a heat source using a pressure gradient provided by the inner workings of the mass spectrometer device (vacuum) in the absence of an auxiliary pump or added gas flow; generating ionized molecules by using the heat source to facilitate heat-induced evaporative soft ionization of molecules in the gaseous material according to the teachings herein; analyzing said ionized molecules with a mass spectrometer to obtain mass spectra; comparing said mass spectra against a database of known mass spectrometer profiles; and identifying a material type through matches with the database.

In at least some embodiments, the identifying comprises matching the material based on type of cancer or type of disease.

In at least some embodiments, the identifying comprises matching the material based on cancer subtypes or closely related subclasses of a same cancer type.

In at least some embodiments, the identifying comprises using multivariate statistical comparison between a mass spectrometry profile of the material to known profiles of said material present in a library, wherein said multivariate statistical comparison uses only a portion of the entire mass spectrum.

In at least some embodiments, only a selected subset of mass peaks in the mass spectrum are used in the multivariate statistical comparison.

In at least some embodiments, the selected subset of mass peaks correspond to at least one of known biomarkers of a disease, a cancer type and a cancer subtype.

In at least some embodiments, the multivariate statistical comparison comprises using MS data normalized to total intensity of the selected subset of mass peaks.

Other features and advantages of the present application will become apparent from the following detailed description taken together with the accompanying drawings. It should be understood, however, that the detailed description and the specific examples, while indicating preferred embodiments of the application, are given by way of illustration only, since various changes and modifications within the spirit and scope of the application will become apparent to those skilled in the art from this detailed description.

BRIEF DESCRIPTION OF THE DRAWINGS

For a better understanding of the various embodiments described herein, and to show more clearly how these various embodiments may be carried into effect, reference will be made, by way of example, to the accompanying drawings which show at least one example embodiment, and which are now described. The drawings are not intended to limit the scope of the teachings described herein.

LM2-4 breast cancer by Picosecond InfraRed Laser (PIRL) soft ionization mass spectrometry (independent repeat).

Figure 14:
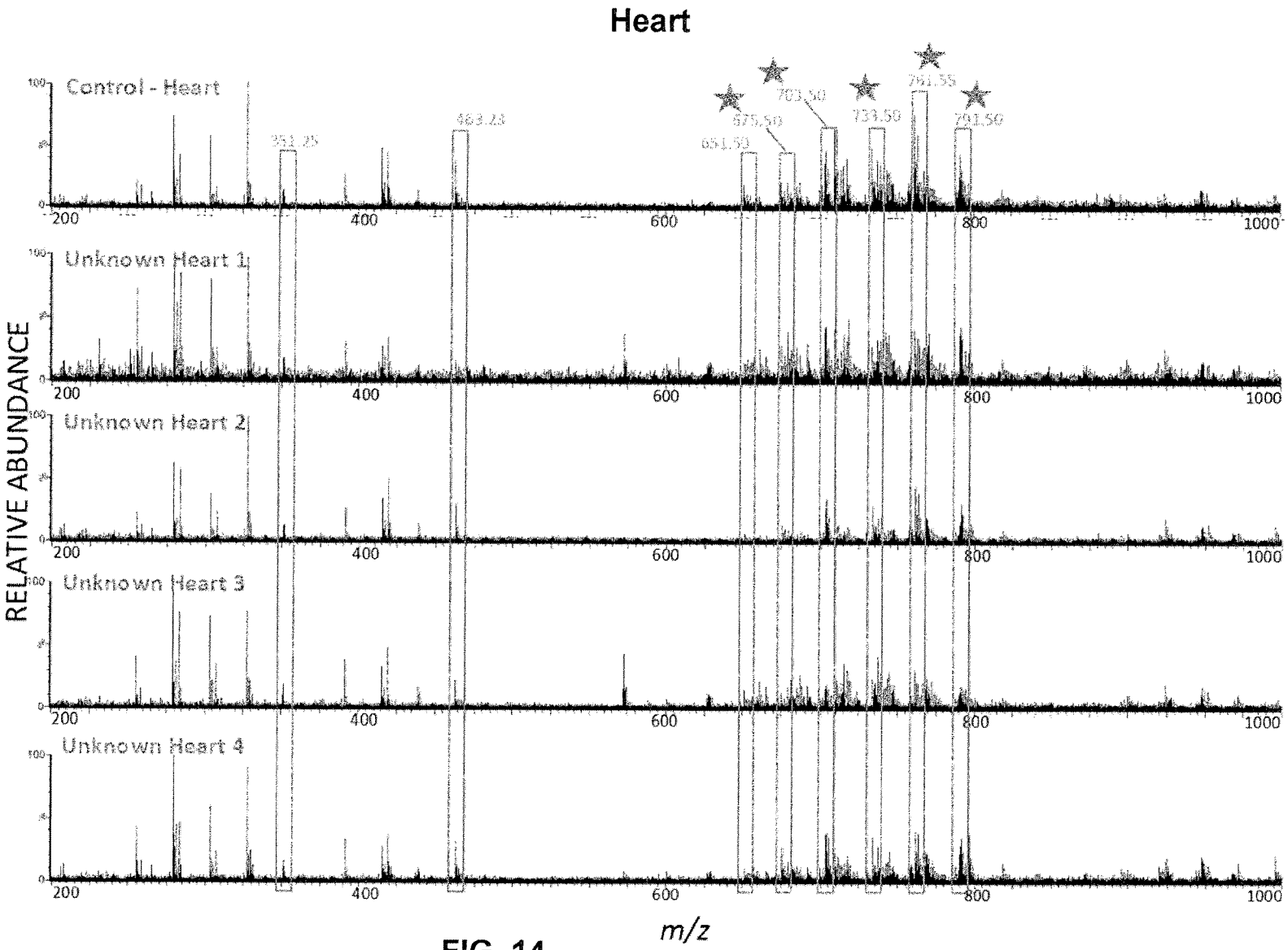

FIG. 14 shows an example of PIRL soft ionization MS analysis of several samples of mouse heart with ~10 seconds of in situ sampling.

Figure 15:
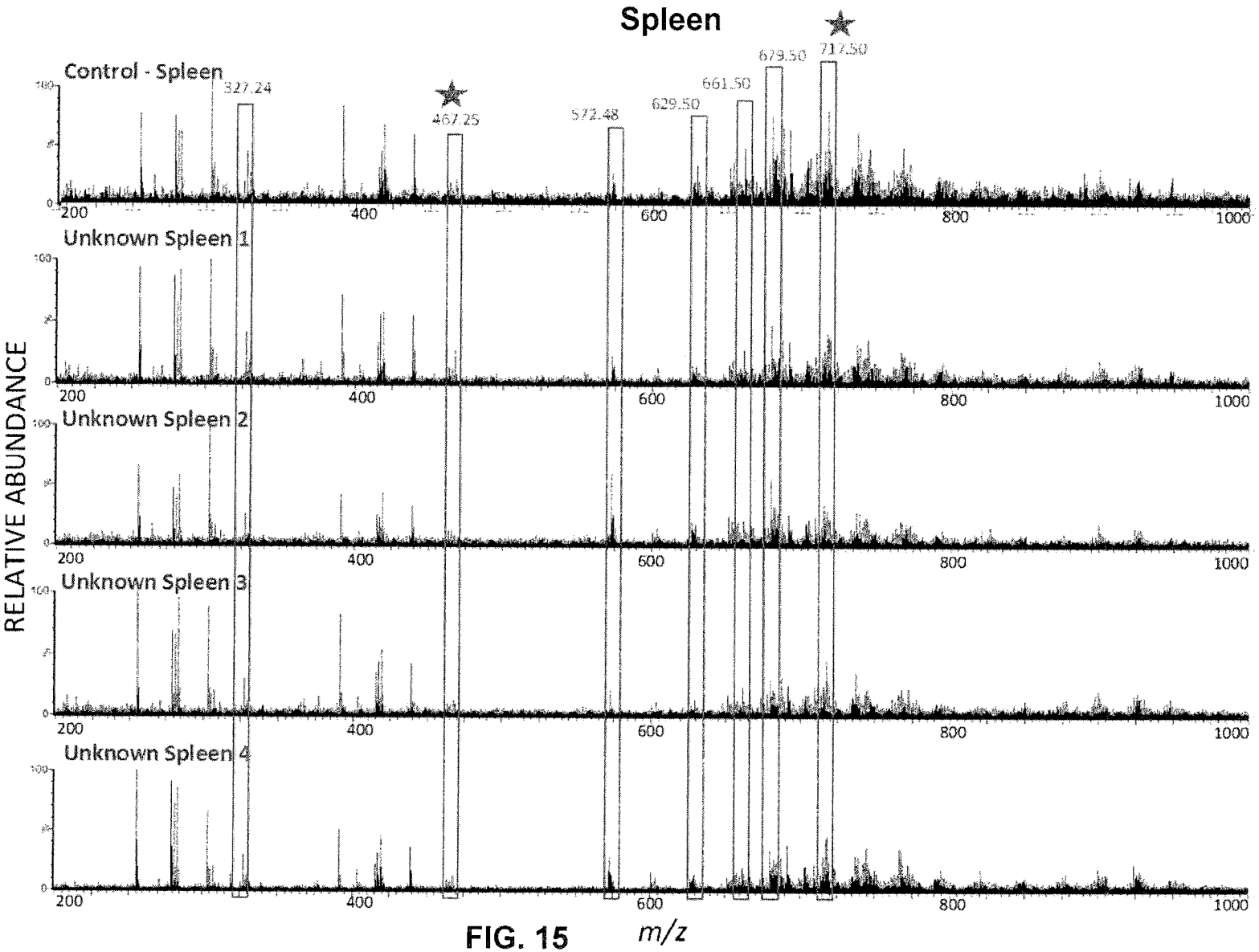

FIG. 15 shows an example of PIRL soft ionization MS analysis of several samples of mouse spleen with ~10 seconds of in situ sampling.

Figure 16:
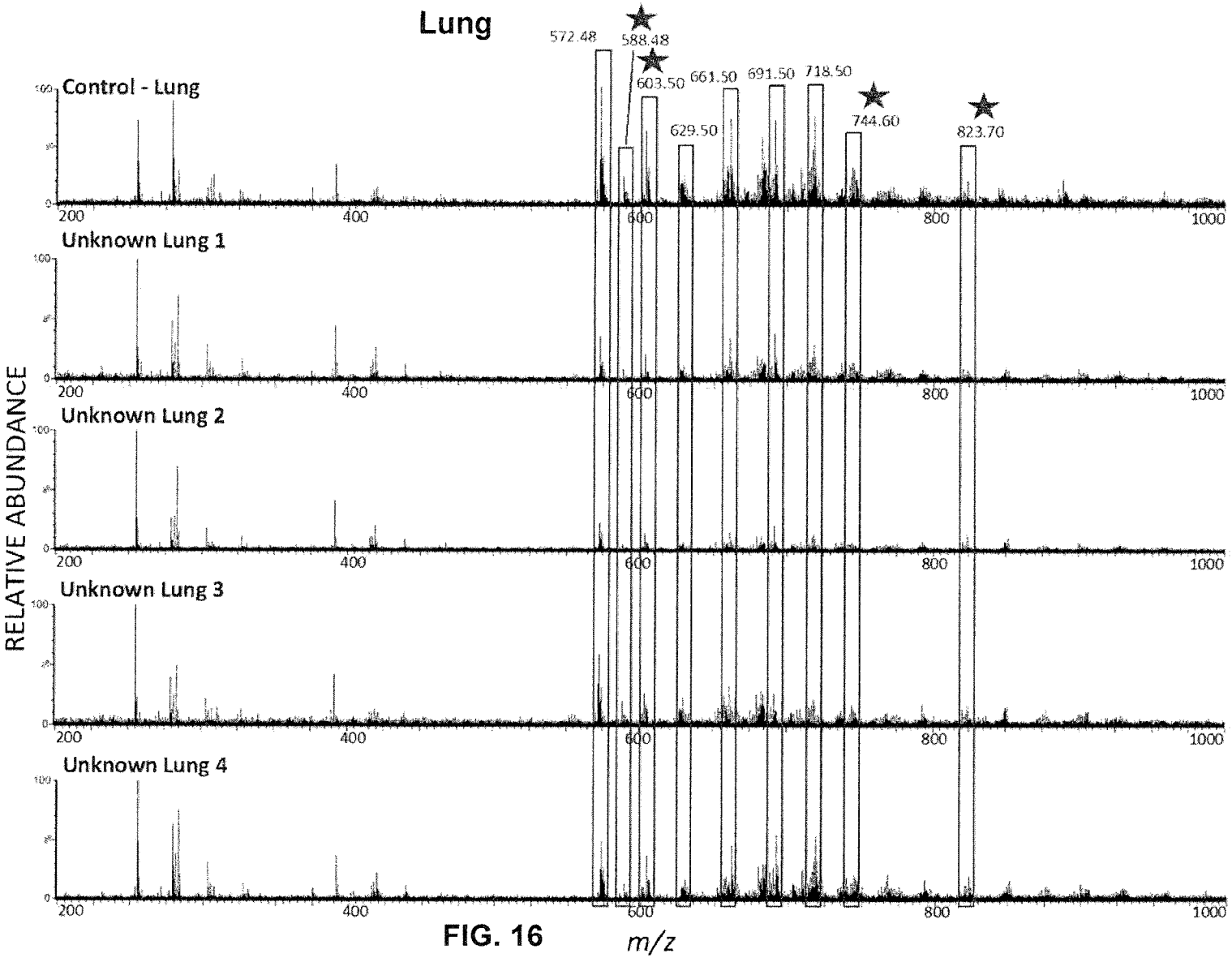

FIG. 16 shows an example of PIRL soft ionization MS analysis of several samples of mouse lung with ~10 seconds of in situ sampling.

Figure 17:
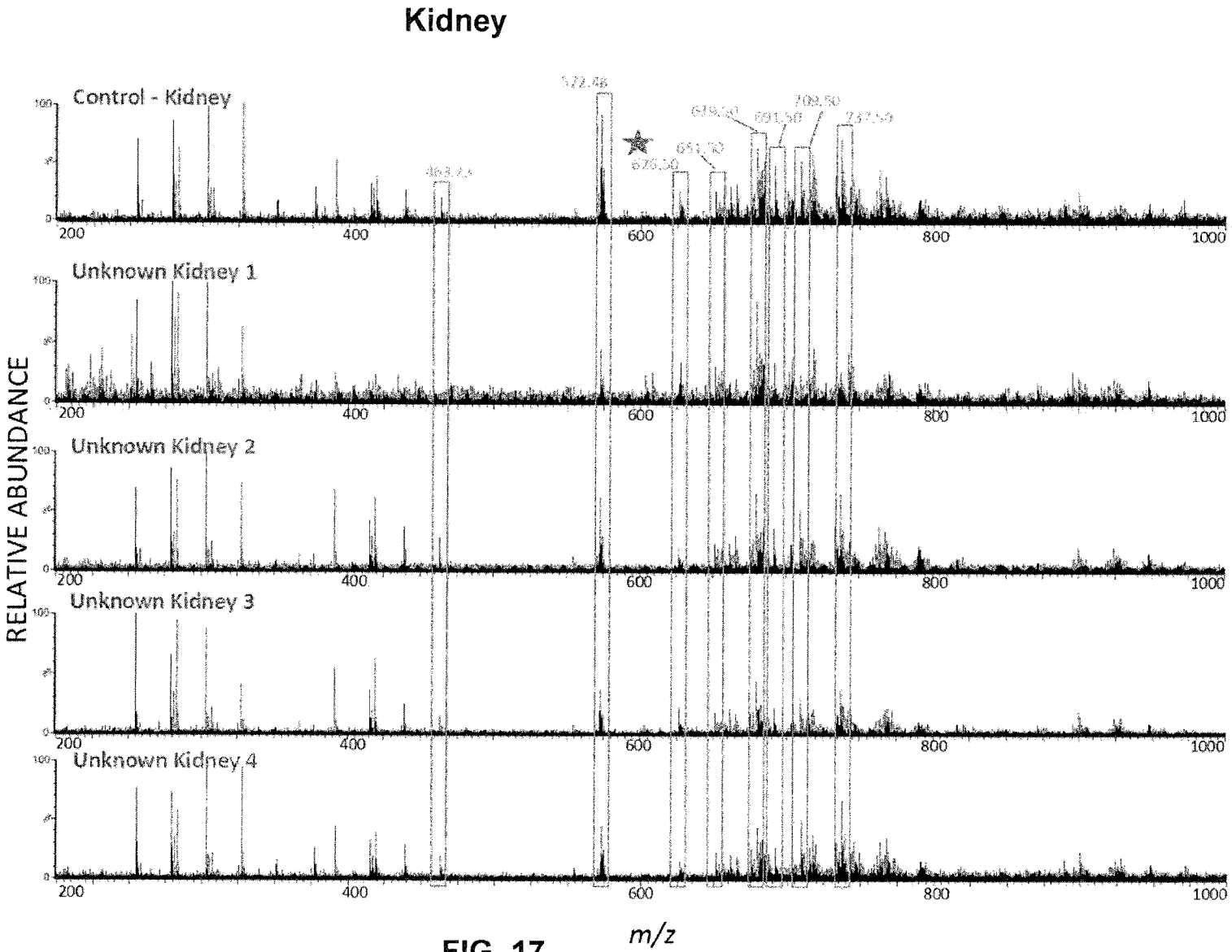

FIG. 17 shows an example of PIRL soft ionization MS analysis of several samples of mouse kidney with ~10 seconds of in situ sampling.

Figure 18:
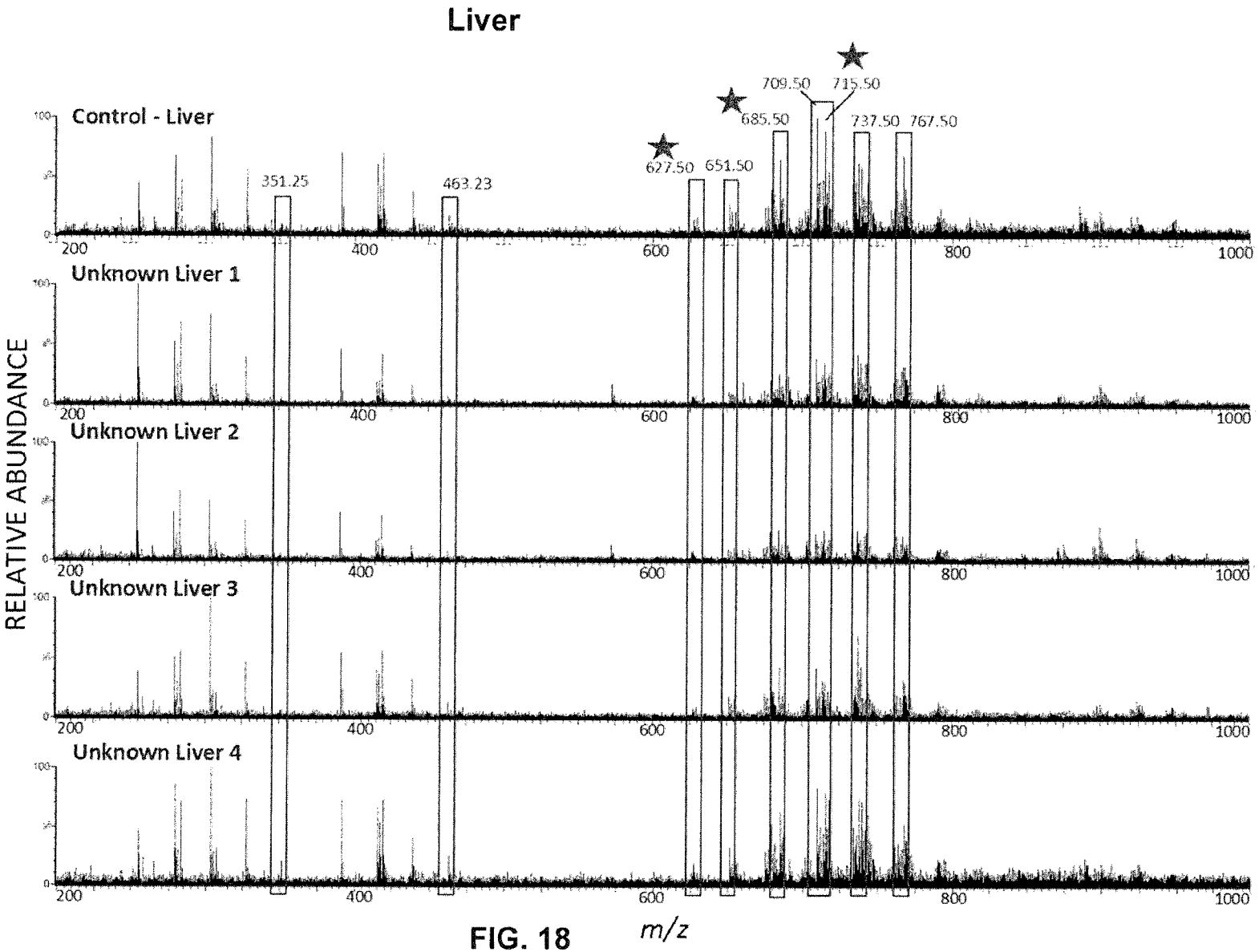

FIG. 18 shows an example of PIRL soft ionization MS analysis of several samples of mouse liver with ~10 seconds of in situ sampling.

Figure 19:
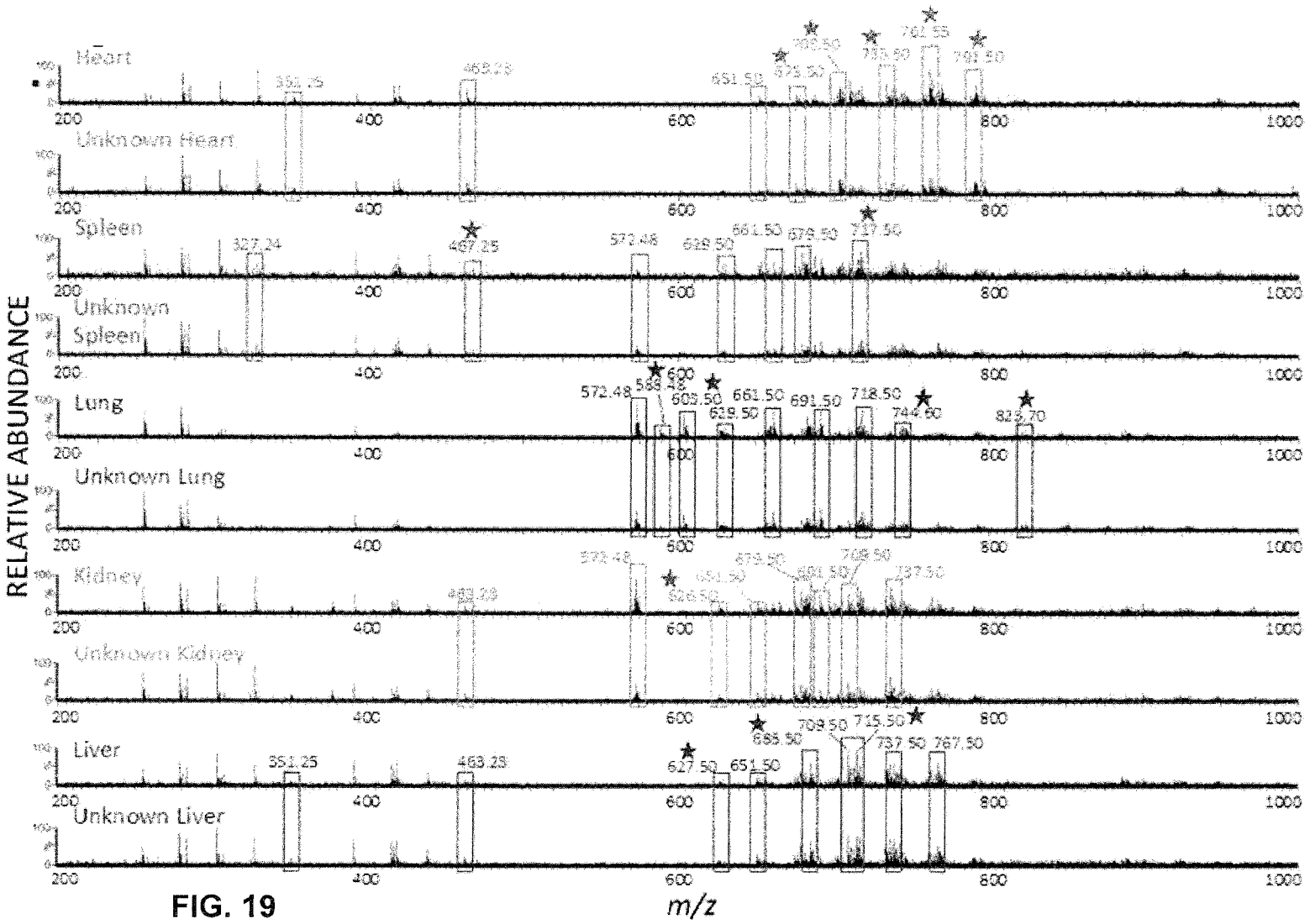

FIG. 19 shows an example of identification of several mouse organs with ~10 seconds of sampling with hand held PIRL ablation MS sampling device.

Figure 20:
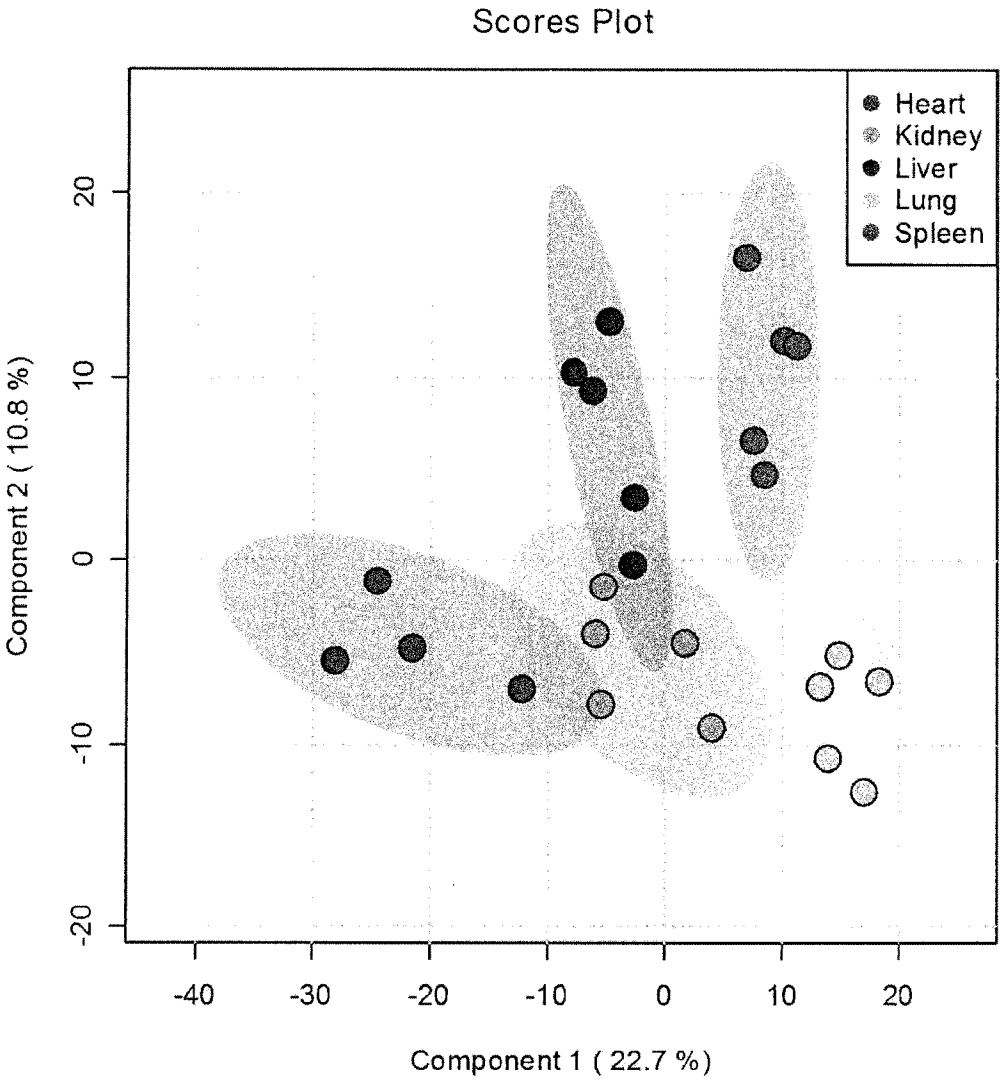

FIG. 20 shows the statistical discrimination between PIRL MS profiles of different mouse tissues examined in an experimental study for identifying mouse organs by molecular analysis of mouse tissue sample.

Figures 21A, 21B:
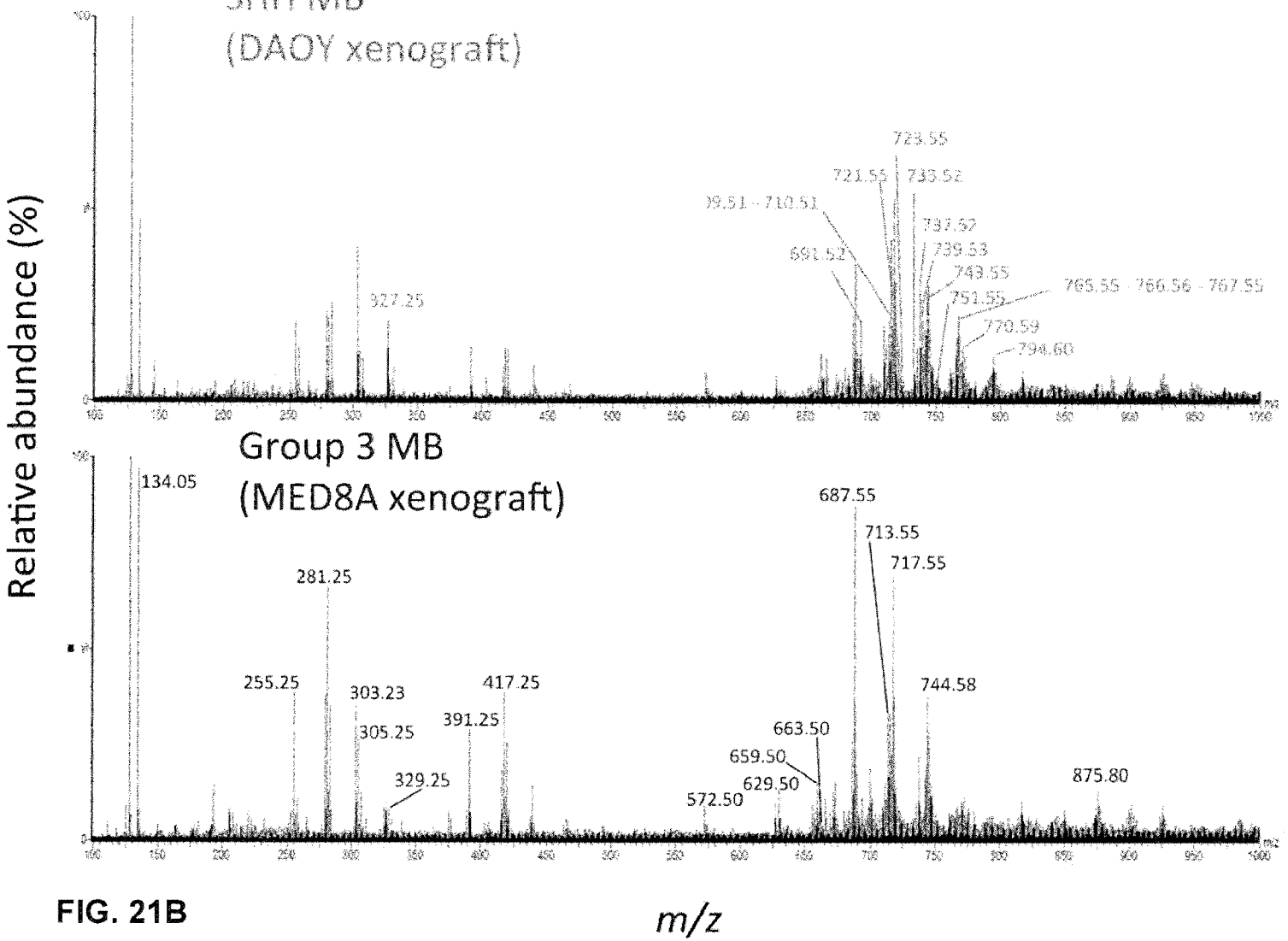

FIG. 21 shows an example of PIRL-MS spectra of Sonic HedgeHog (SHH) MB and Group 3 MB tumours.

FIGS. 22A-22D show the schematics of the PIRL MS experimental setup for the determination of MB subgroup affiliation.

Figure 23A:
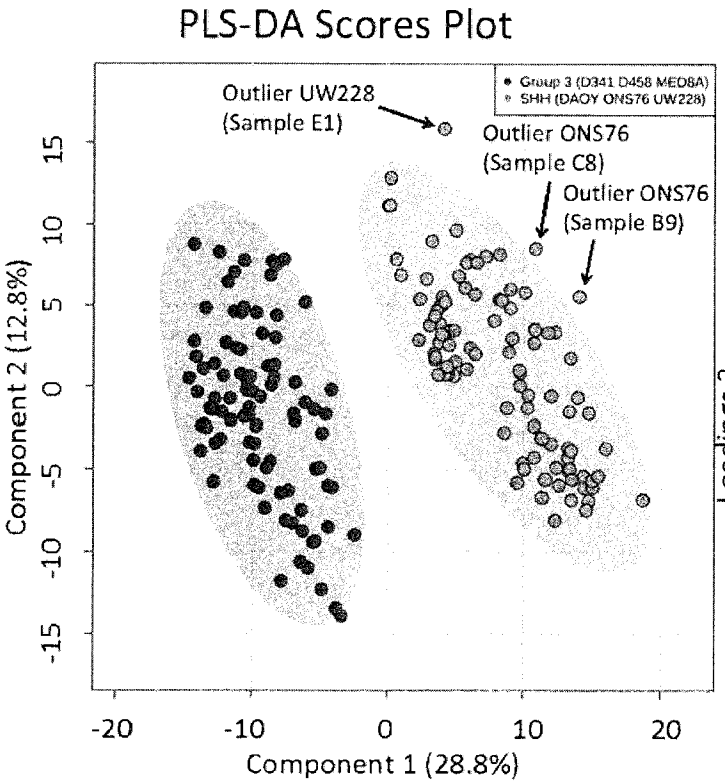
Figure 23B:
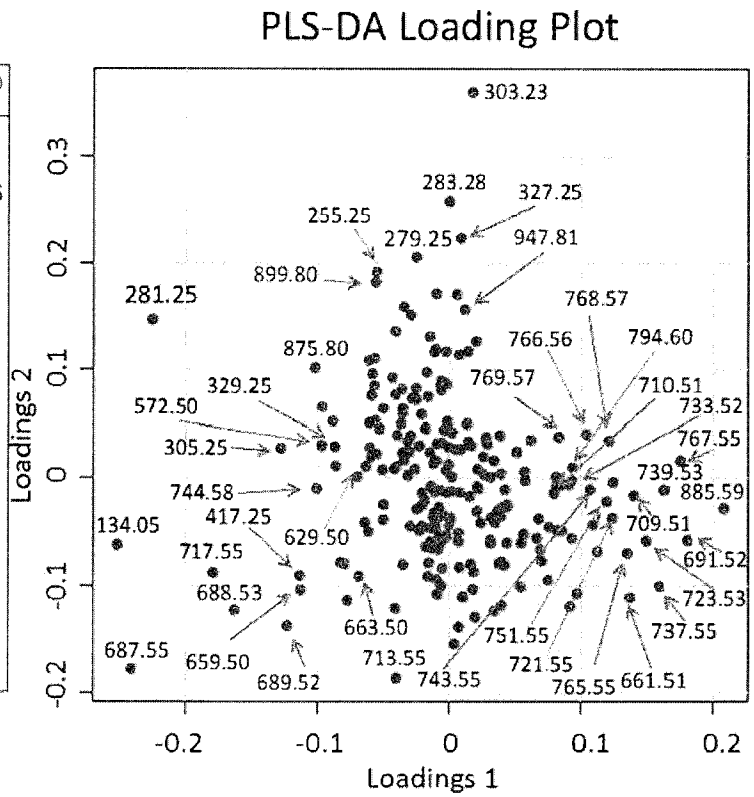

FIGS. 23A-23B show statistical discrimination of the SHH and Group 3 MB based on 5-10 second PIRL-MS analysis.

Figure 24:
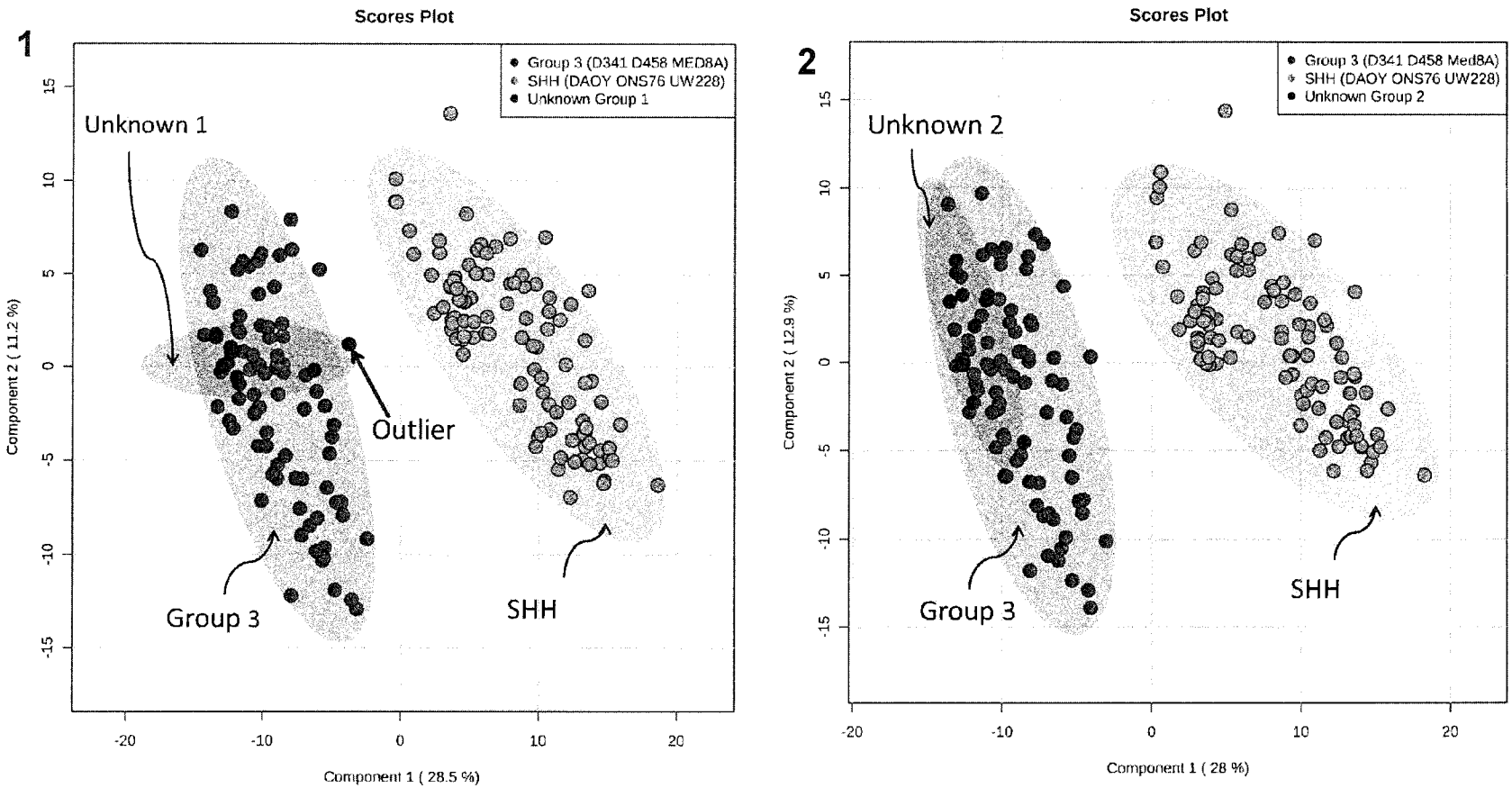
Figure 24:
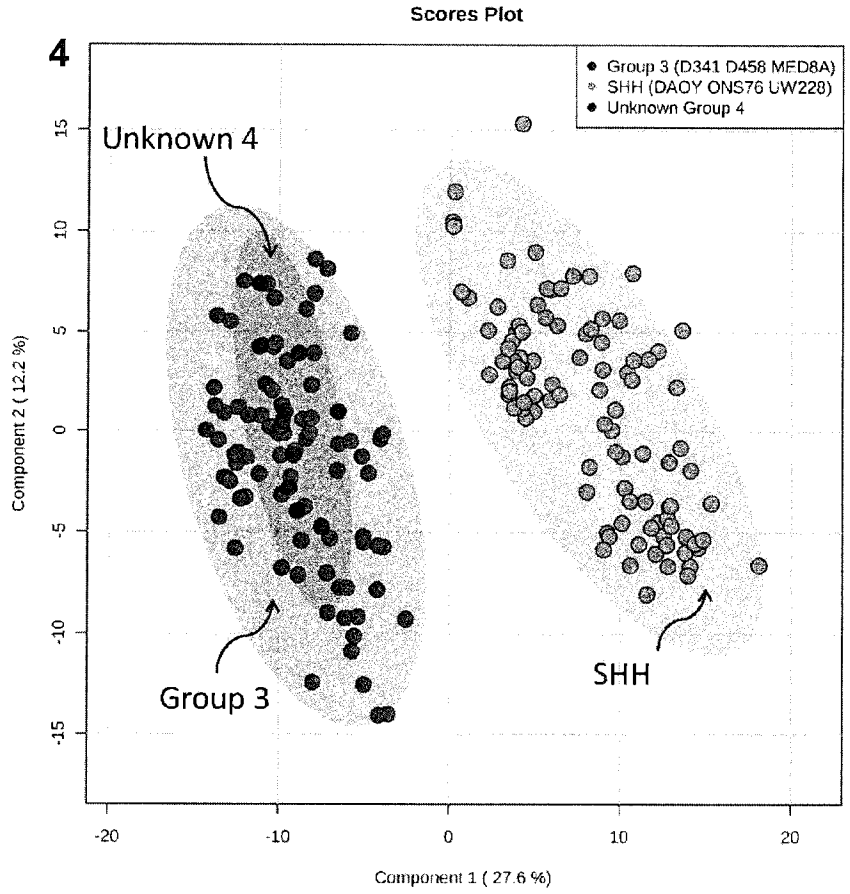
Figure 24:
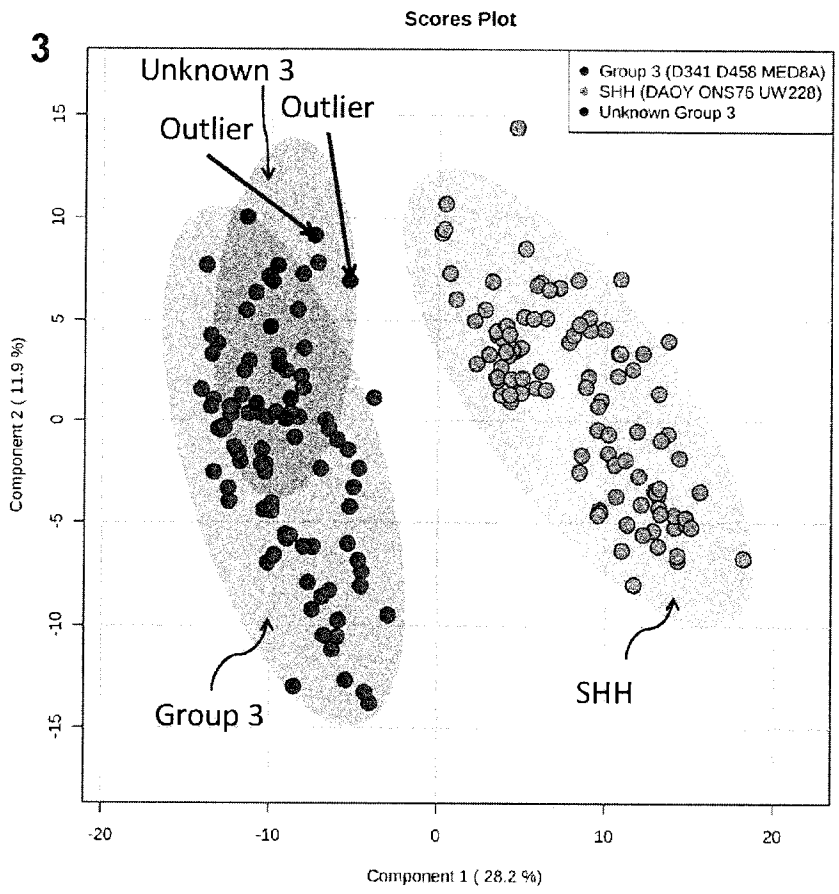
Figure 24:
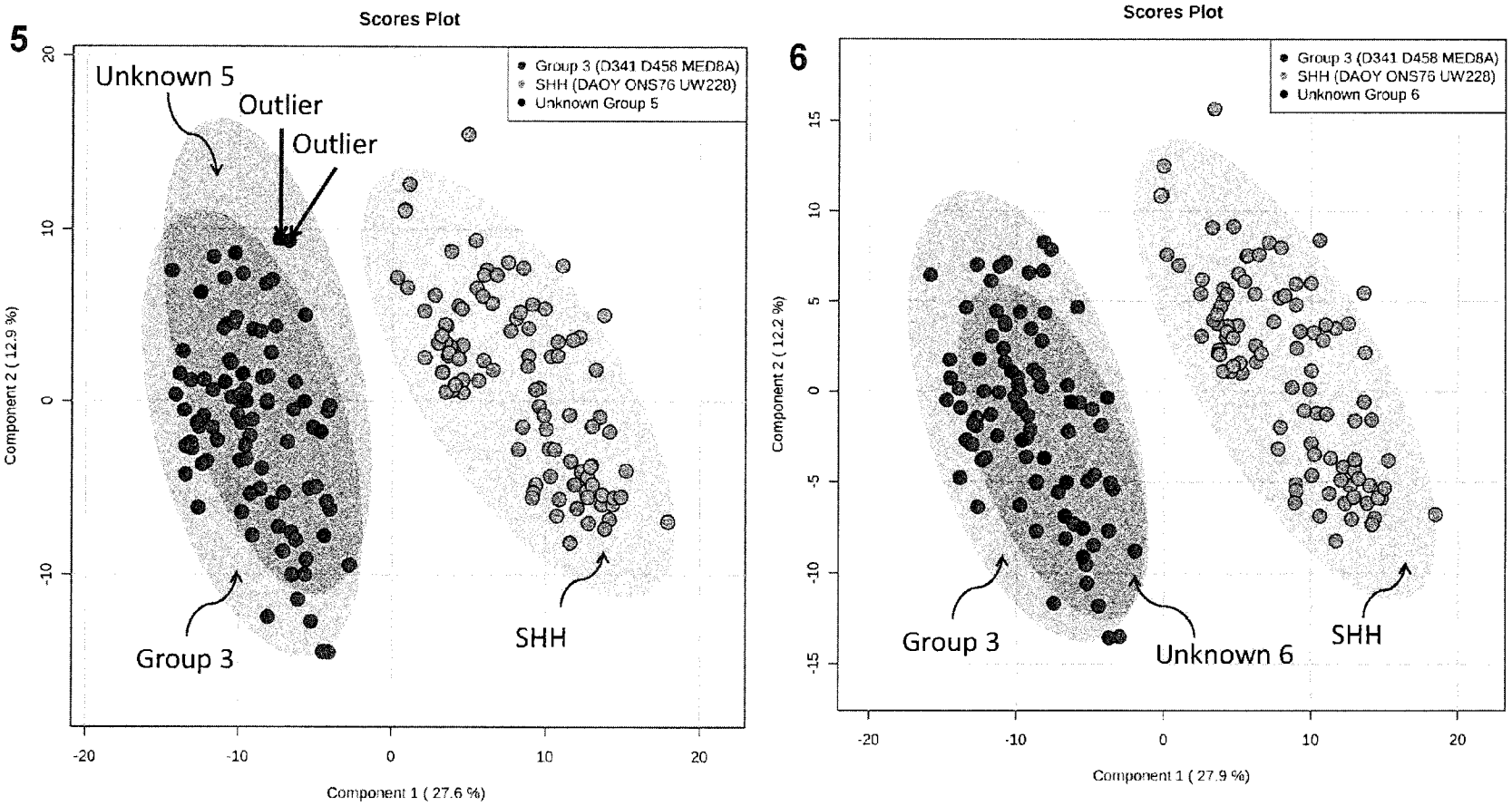
Figure 24:
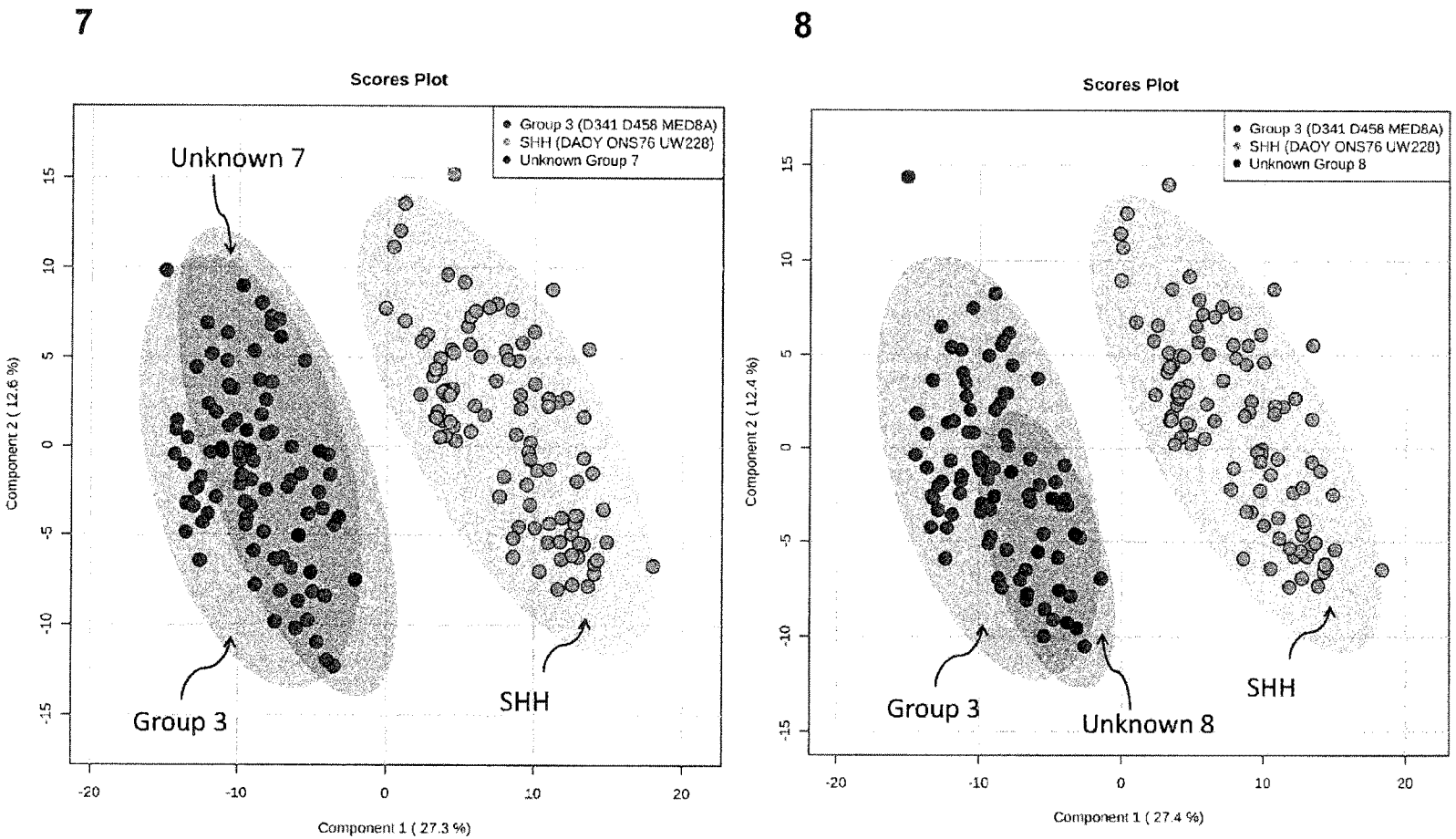
Figure 24:
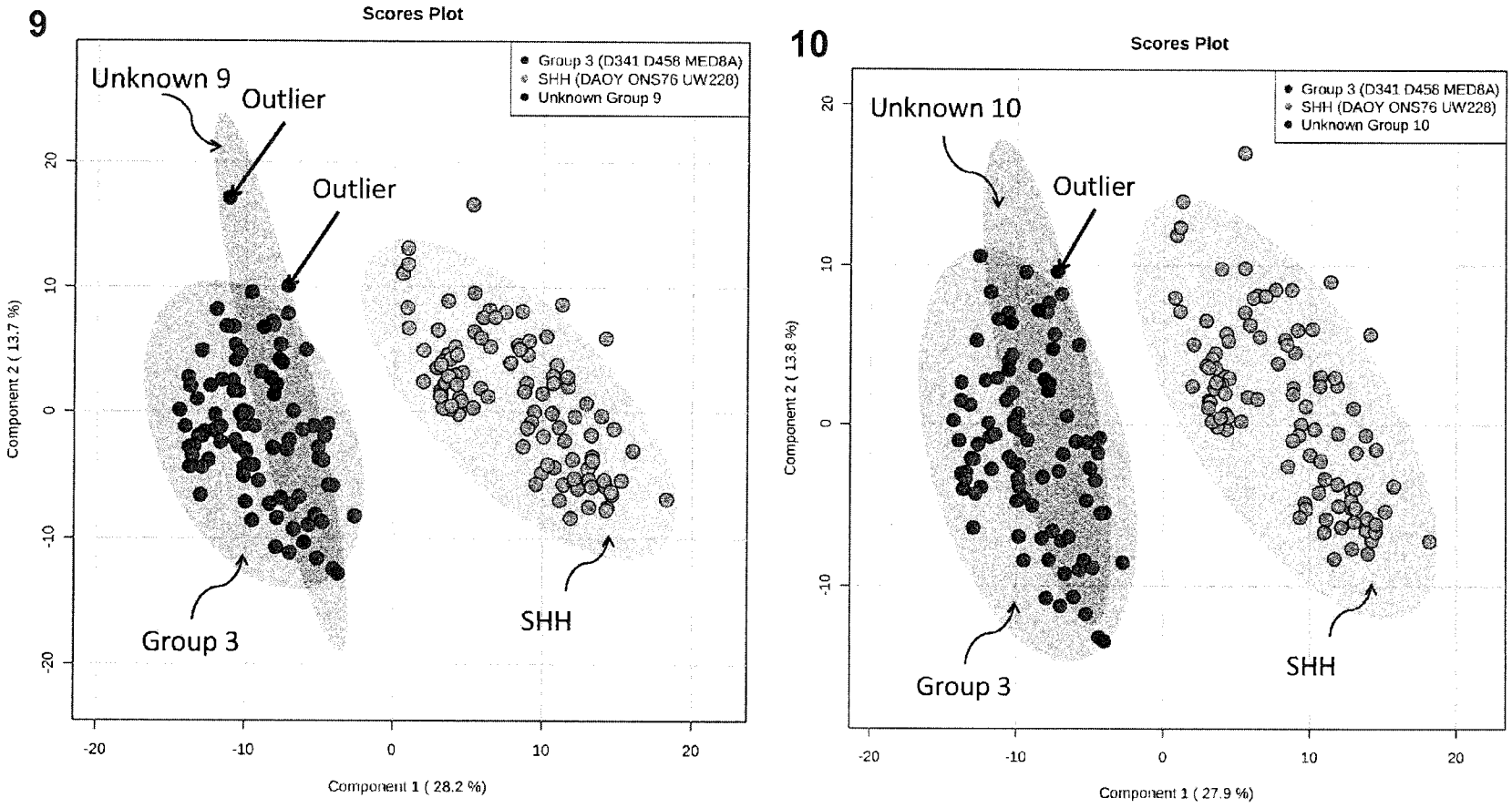
Figure 24:
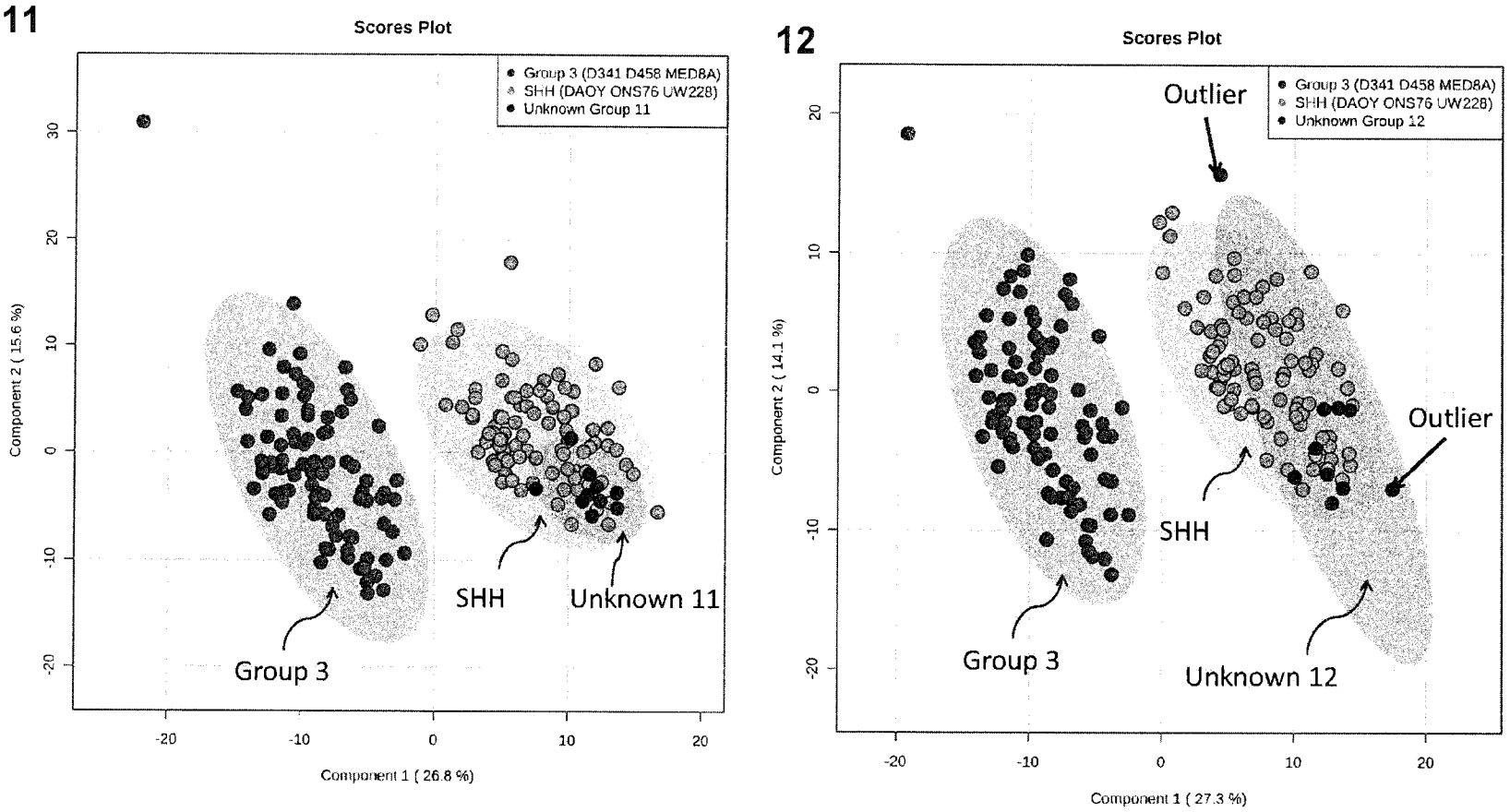
Figure 24:
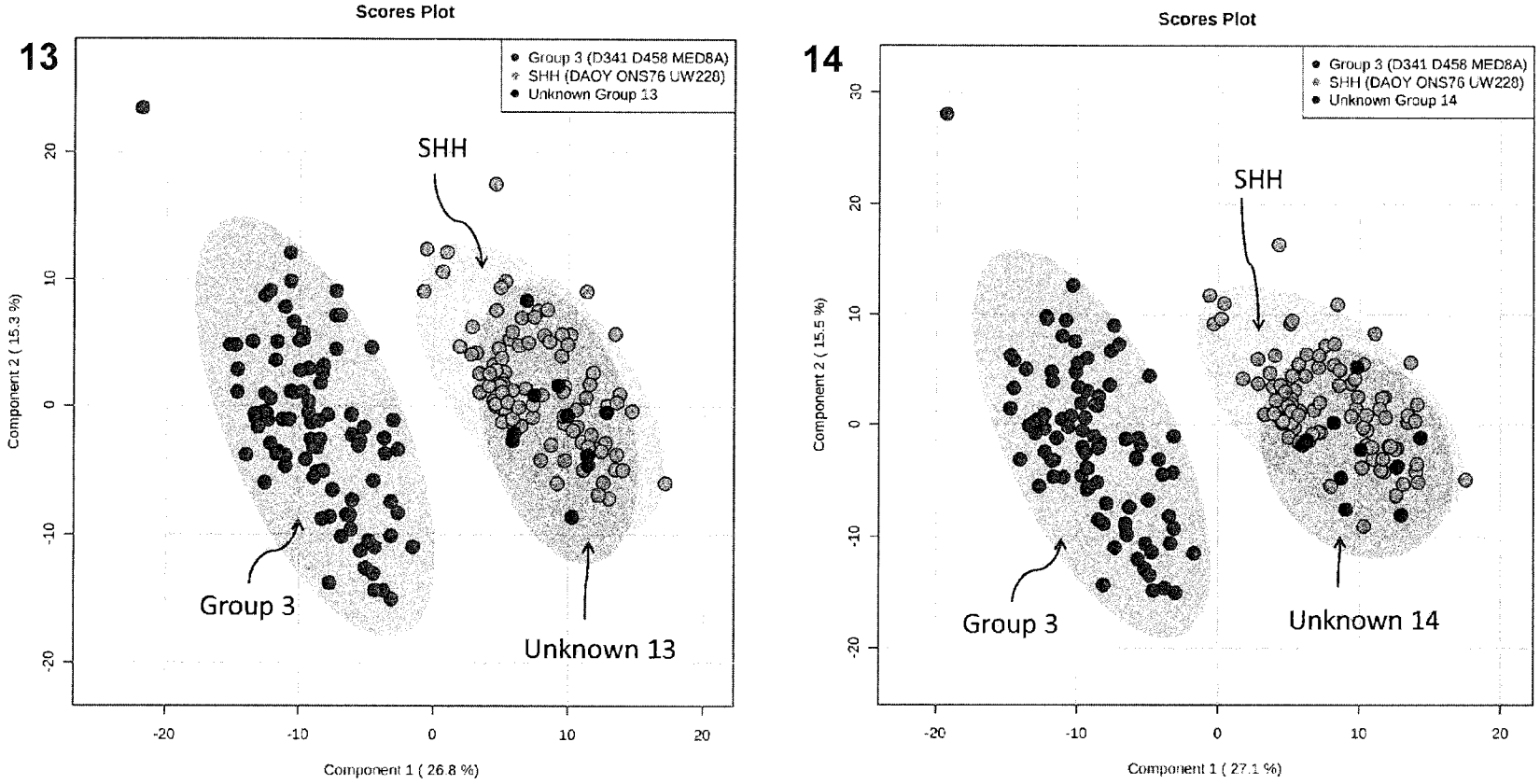
Figure 24:
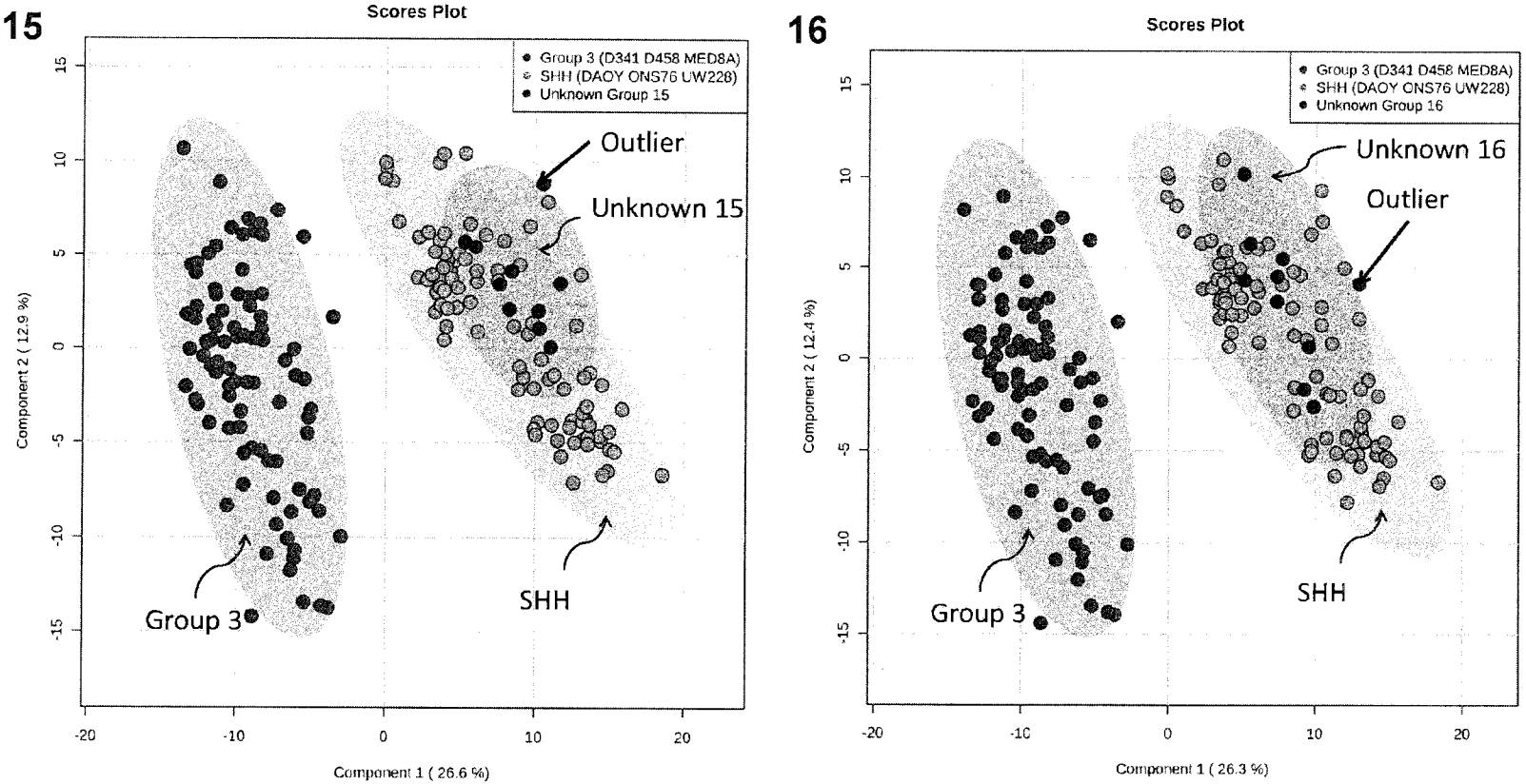
Figure 24:
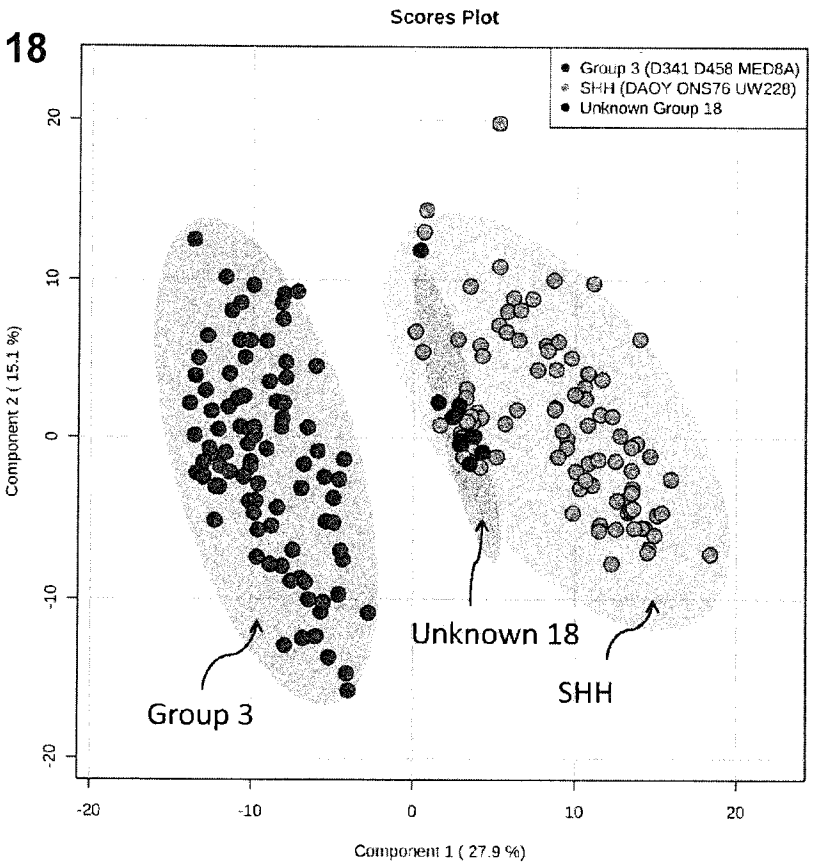
Figure 24:
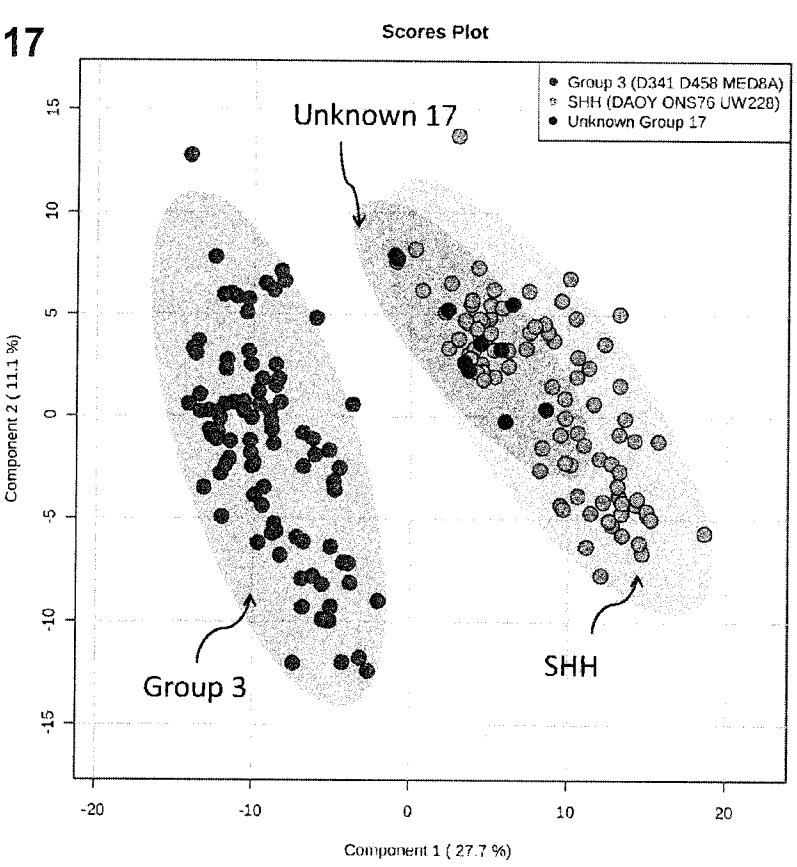
Figure 24:
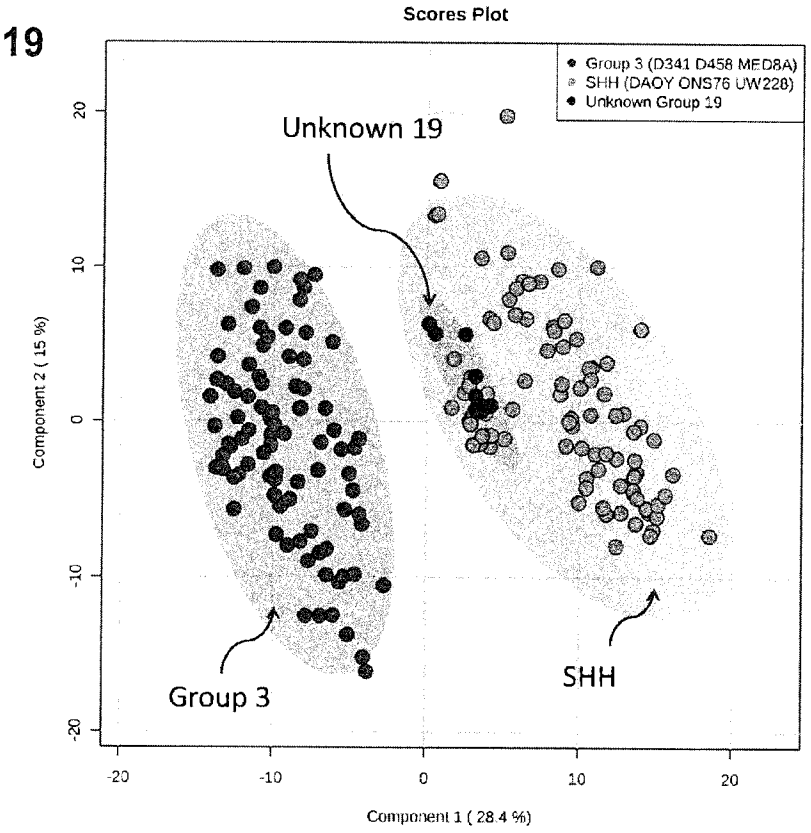
Figure 24:
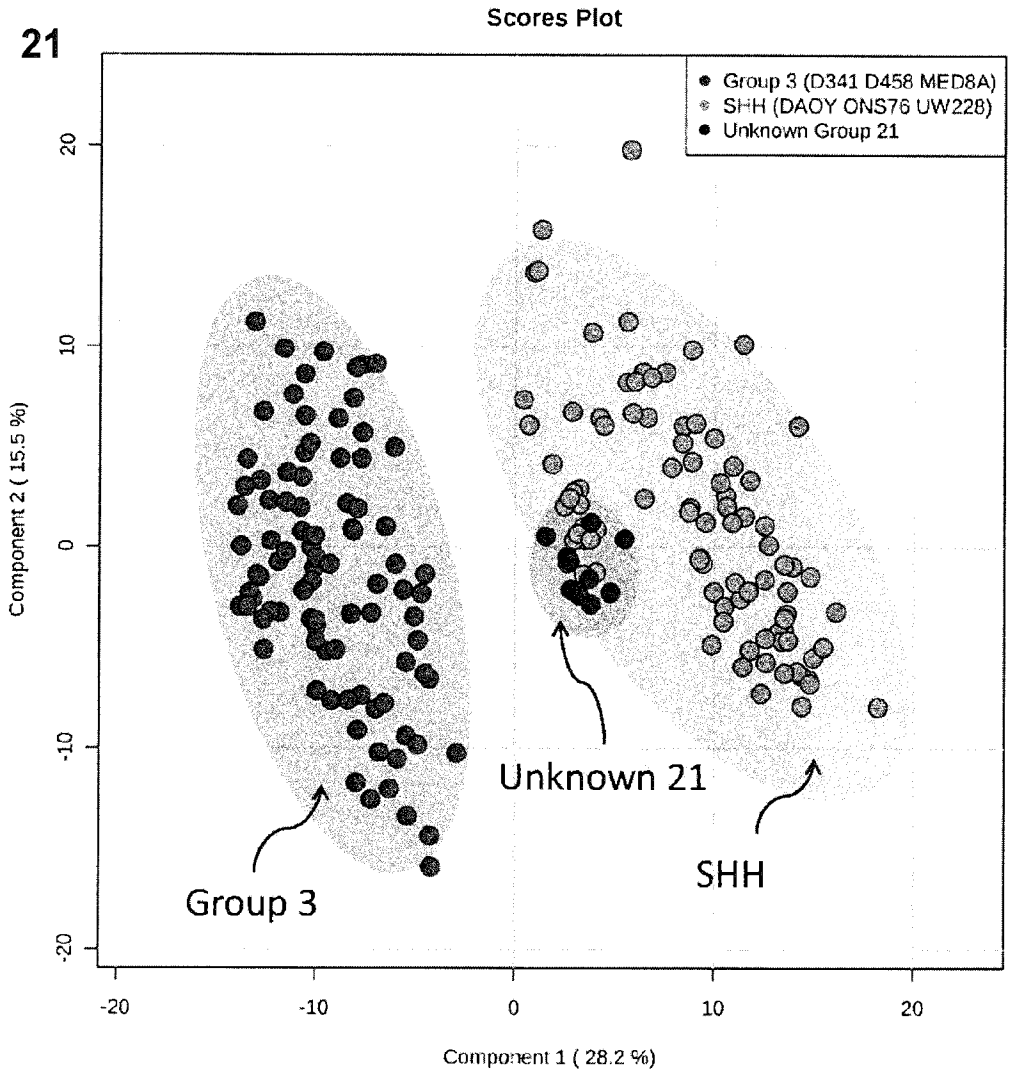

FIG. 24 shows several plots indicating the statistical robustness of MB subclass prediction with PIRL MS through a 5% leave out and remodel test.

Figure 25:
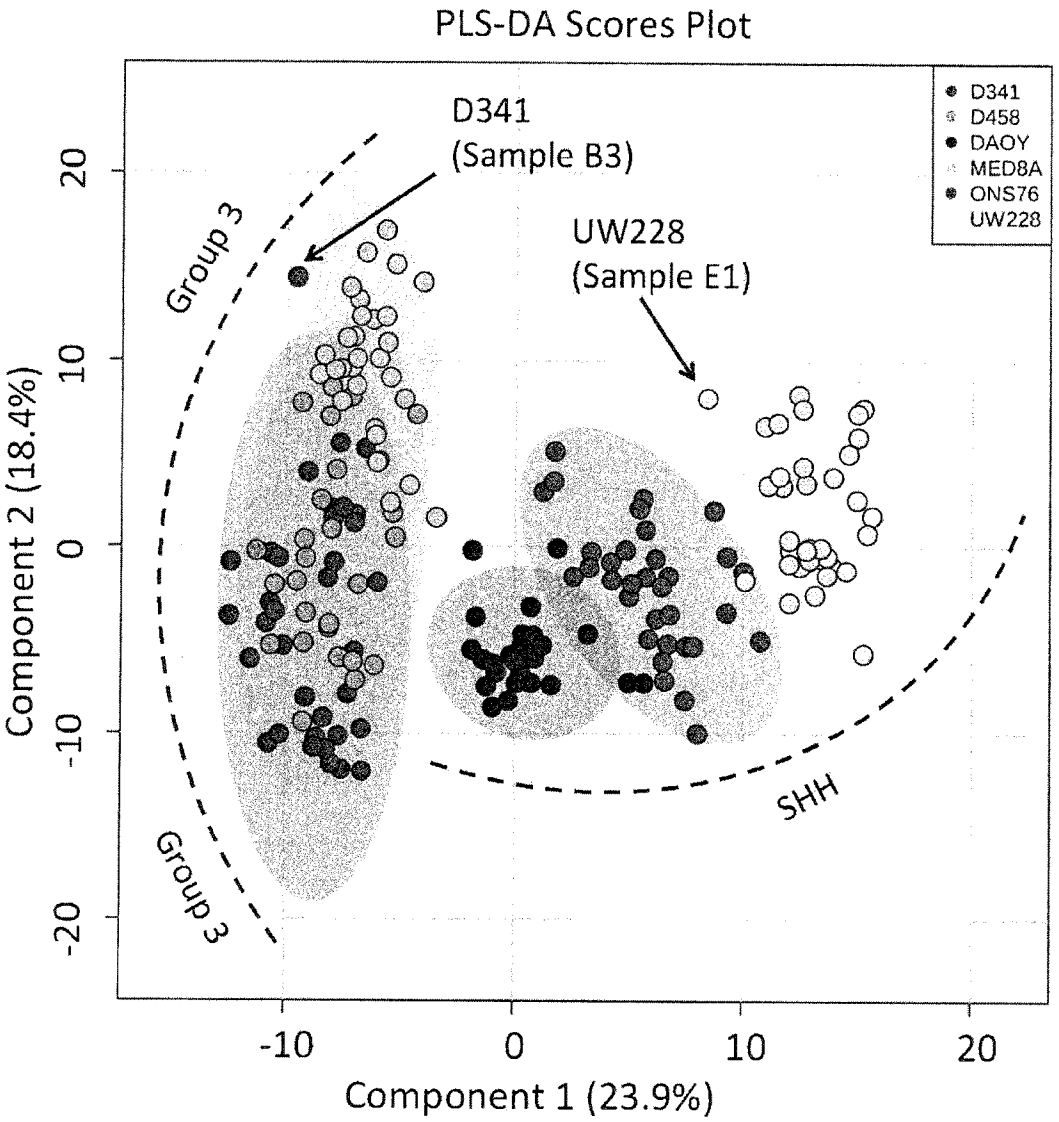

FIG. 25 shows a plot of specificity of PIRL-MS analysis allows statistical discrimination of some MB cell lines based on lipid content.

Figure 26A:
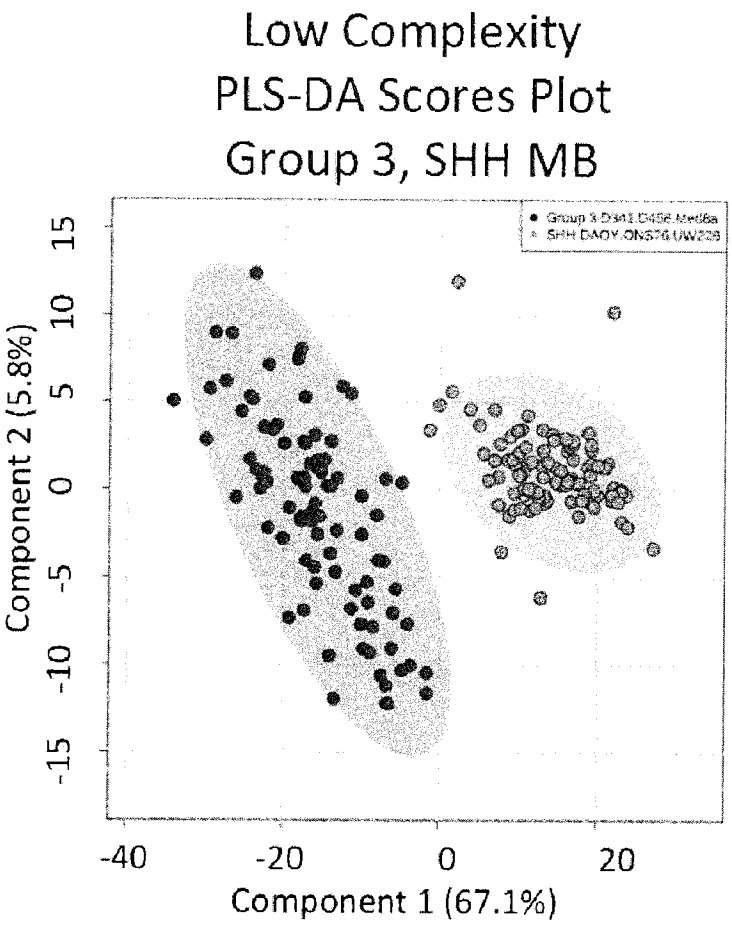
Figure 26B:
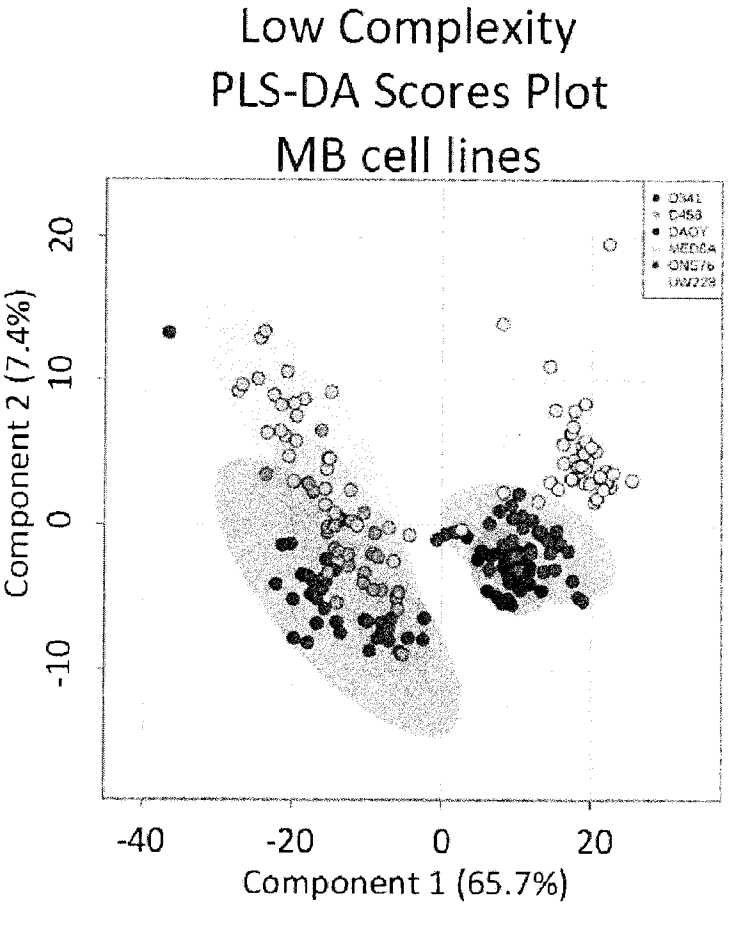

FIGS. 26A-26B show a Low complexity Partial Least Squares Discriminant Analysis (PLS-DA).

Further aspects and features of the embodiments described herein will appear from the following description taken together with the accompanying drawings.

DETAILED DESCRIPTION OF THE EMBODIMENTS

Various embodiments in accordance with the teachings herein will be described below to provide an example of at least one embodiment of the claimed subject matter. No embodiment described herein limits any claimed subject matter. The claimed subject matter is not limited to devices or methods having all of the features of any one of the devices or methods described below or to features common to multiple or all of the devices and or methods described herein. It is possible that there may be a device or method described herein that is not an embodiment of any claimed subject matter. Any subject matter that is described herein that is not claimed in this document may be the subject matter of another protective instrument, for example, a continuing patent application, and the applicants, inventors or owners do not intend to abandon, disclaim or dedicate to the public any such subject matter by its disclosure in this document.

It will be appreciated that for simplicity and clarity of illustration, where considered appropriate, reference numerals may be repeated among the figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

It should also be noted that the terms "coupled" or "coupling" as used herein can have several different meanings depending in the context in which these terms are used. For example, the terms coupled or coupling can have a mechanical, electrical or fluid (i.e. gaseous) connotation. For example, as used herein, the terms coupled or coupling can indicate that two elements or devices can be directly connected to one another or connected to one another through one or more intermediate elements or devices via an electrical signal, a mechanical element, such as, conduits and the like or fluid transport means, such as transport or collection tube, for example, depending on the particular context.

It should also be noted that, as used herein, the wording "and/or" is intended to represent an inclusive-or. That is, "X and/or Y" is intended to mean X or Y or both, for example. As a further example, "X, Y, and/or Z" is intended to mean X or Y or Z or any combination thereof.

It should be noted that terms of degree such as "substantially", "about" and "approximately" as used herein mean a reasonable amount of deviation, such as 1%, 2%, 5% or 10%, of the modified term such that the end result is not significantly changed. These terms of degree may also be construed as including a deviation of the modified term if this deviation does not negate the meaning of the term it modifies.

Furthermore, the recitation of numerical ranges by endpoints herein includes all numbers and fractions subsumed within that range (e.g. 1 to 5 includes 1, 1.5, 2, 2.75, 3, 3.90, 4, and 5). It is also to be understood that all numbers and fractions thereof are presumed to be modified by the term "about" which means a variation of up to a certain amount of the number to which reference is being made if the end result is not significantly changed, such as 1%, 2%, 5%, or 10%, for example.

In conventional mass spectral analysis, a material is first brought to the gas phase for MS analysis (this process is known as desorption). For non-volatile, this may be achieved using a variety of desorptive methods such as laser desorption, solvent mediated-extraction or aerosolization such as those provided by laser ablation, electrocautery or solvent desorption in desorption electrospray ionization. MS additionally requires ionized material for the detection of molecules present in the plume of laser ablation/desorption or electrocautery. However, a flow of Nitrogen gas in REIMS[2-4], or air as in Air Flow Assisted Ionization method[5], is not the only means by which evaporative ionization can take place. Alternatively, volatile materials do not need to be brought to the gas phase with laser or electrocautery, for example. Rather, for volatile materials, an input end of the collection tube is placed in close proximity to the volatile material to capture the vapour pressure. Accordingly, in the case of volatile material, the gaseous material can be obtained without generating the plume using an active process.

Figure 1:
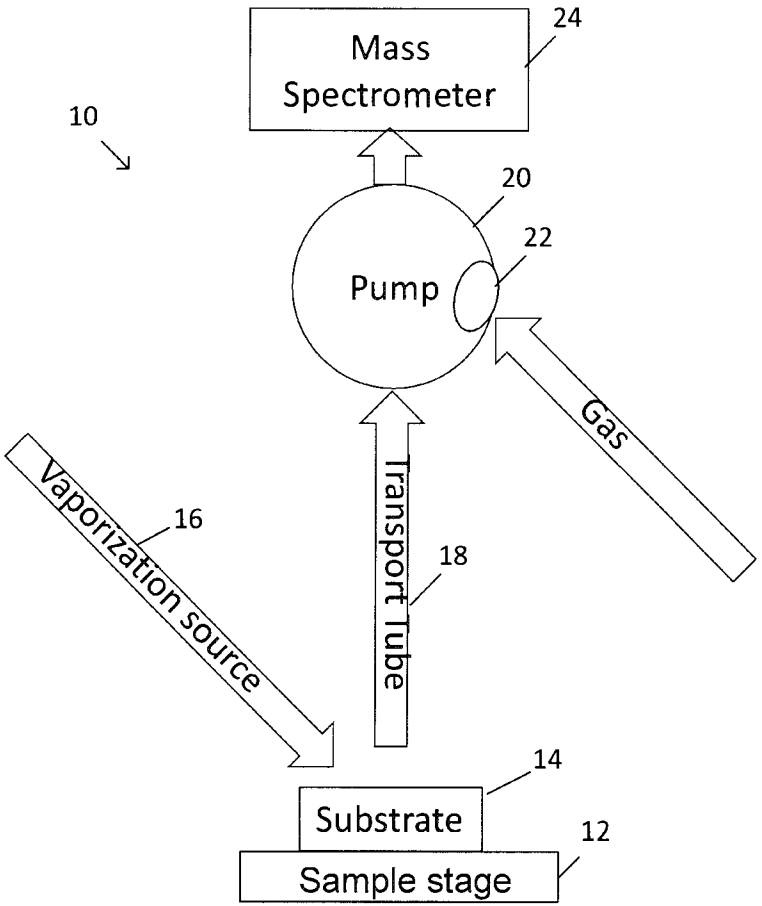
FIG. 1 shows components of an example embodiment of a conventional Rapid Evaporative Ionization Mass Spectrometry Interface.

Referring now to FIG. 1, shown therein is a block diagram indicating the components of an example embodiment of a conventional Rapid Evaporative Ionization Mass Spectrometry (REIMS) Interface 10. The REIMS interface 10 comprises a sample stage 12 for holding a substrate 14, a vaporization source 16, a transport tube 18, and a pump 20 comprising an input port (not shown) for receiving gas from a gas source (not shown). For example, the pump 20 may be a Venturi pump and the gas may be Nitrogen gas. The substrate 14 is a sample which is to be analyzed. For example, the substrate 14 may be tissue. In other cases, the substrate 14 may include, but is not limited to, healthy tissue, tumour tissue, as well as any water containing material including bone, tooth enamel, plant leaves, hydrogels and synthetic material containing at least 3% water, for example. These substrates may be used with the various embodiments described in accordance with the teachings herein.

During use, the vaporization source 16 applies a vaporization technique (i.e. vaporization method) to the substrate 14 to create gaseous material or an aerosolized species (not shown). The gaseous material or the aerosolized materials are then sent to a mass spectrometer 24 by the action of the pump 20, which receives Nitrogen gas at the input port 22 and mixes the Nitrogen gas with the aerosolized material or the gaseous material to promote evaporation of the solvent and soft evaporative ionization of analytes present in the plume.

However, in accordance with the teachings herein, it has been determined that with the application of heat, soft ionization may be used prior to MS analysis, which is beneficial for various reasons that are described throughout this application. In accordance with the teachings herein, in one aspect an example embodiment of a device is provided wherein the device comprises an input for receiving gaseous material, vapourized material, plume material or aerosolized material; a transport tube coupled to the input and being configured to allow for conduction and dissipation of heat to its contents (i.e. to the gaseous material, the vapourized material, the plume material or the aerosolized material) to facilitate heat-induced evaporative soft ionization of molecules in the gaseous material, the vapourized material, the plume material or the aerosolized material; and an output coupled to the transport tube for providing the ionized molecules to a downstream mass spectrometer for analysis, for example. An amount of heat is applied to achieve heat-induced evaporative soft ionization of the molecules. The heating can be applied in the temperature range of 45° C. to 250° C., for example.

In another aspect, an alternative embodiment of a device is provided for ionizing molecules for the purpose of analysis by mass spectrometry. The device comprises an input for receiving predominantly gaseous material from a sample substrate where the gaseous material is generated using laser desorption using a laser with a pulse range of about 1-1,000 picoseconds to produce the gaseous material; a transport tube coupled to the input and configured to allow for conduction of heat to facilitate heat-induced evaporative soft ionization of molecules in the gaseous material, where the amount of heat that is applied is in the temperature range of 45° C. to 250° C. and the applied heat results in soft ionization of said molecules; and an output that is coupled to the transport tube for providing the ionized molecules to a downstream mass spectrometer for analysis.

The gaseous material, the vapourized material, the plume material, the desorbed material or the aerosolized material may be produced using one of laser ablation, laser desorption, joules heating, cauterization, electrocautery, radio frequency ablation, ultrasonic aspiration, chemical extraction and aerosol generation using mechanical or acoustic means.

Figure 2:
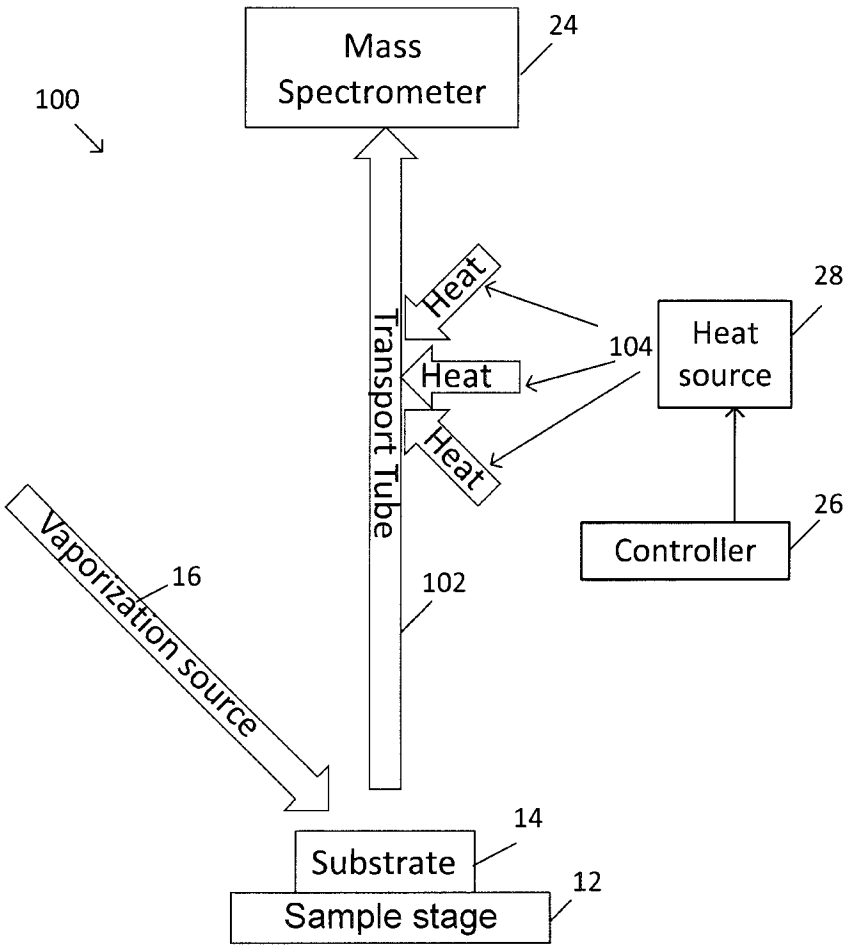
FIG. 2 shows components of an example embodiment of a soft ionization mass spectrometry interface in accordance with the teachings herein.

Referring now to FIG. 2, shown therein are components of an example embodiment of a soft ionization Mass Spectrometry Interface 100 in accordance with the teachings here. The soft ionization MS interface 100 comprises the vaporization source 16 and a transport tube 102. The transport tube 102, as well as variations thereof in accordance with the teachings herein, can be referred to as an analyte transport tube. The sample stage 12 is separate from the interface 100 and is used to hold the substrate 14.

In some embodiments, the interface 100, and the variations described herein, may not include the vaporization source 16 and in these cases the interface 100 is used with a standalone vaporization source 16.

During use, the vaporization source 16 applies a vaporization method to the substrate 14 to create a plume of gaseous or aerosolized species (i.e. gaseous material or aerosolized material) that are sent to the mass spectrometer 24 by the suction provided by inner turbo pumps (not shown) of the mass spectrometer 24 through an extension of a collection tube (not shown) into the transport tube 102. The transport tube 102 is coupled to the collection tube of the MS 24.

Heat 104 is applied to the transport tube 102 to promote evaporation of solvent and soft evaporative ionization of analytes present in the plume. The heat can be applied by heat source 28. The heat source 28 can be any appropriate heating source such as, but not limited to, a tape heater, a Peltier heater, or an infrared heater. The heat source 28 can be part of the interface 100 (as well as for the interfaces of the alternative embodiments herein) or it may be provided separately from the interface 100.

A controller 26 can be used to control the operation of the heat source 28 so that it applies a desired amount of heat in a desired temperature range to the transport tube 102. The controller 26 may be implemented using known techniques such as a processor, an ASIC, an FPGA, a laptop, a desktop computer, or a handheld mobile device. The controller 26 provides an appropriate signal or electrical current to the heat source 28 so that the heat source 28 can provide heat in the desired temperature range. The controller 26 can be part of the interface 100 (as well as for the interfaces of the alternative embodiments herein) or it may be provided separately from the interface 100.

In alternative embodiments, the mass spectrometer 24 may include an extension tube that may act as the transport tube 102 and be heated. Accordingly, the term collection tube may be used herein interchangeably with the terms extension tube or transport tube. In some embodiments, the transport tube 102 may be a metallic tube and may be referred to as a collection capillary or capillary. Alternatively, in some embodiments, the transport tube 102 may be a tube that is flexible and long (e.g. greater than 50 cm) or a portion of the transport tube may include such a tube. Alternatively, in some embodiments, the transport tube 102 can be replaced with the inlet collection tube or inlet capillary of a mass spectrometer. It should be noted that the terms inlet capillary, inlet collection tube or capillary of a mass spectrometer can be used interchangeably.

The transport tube 102 may comprise a heated area or heated chamber (not shown), such as a heated capillary inlet, in which collisions between solvated molecules present in laser and cautery plumes (or aerosols) and the heated air contained in the heated chamber under atmospheric ambient or near atmospheric conditions, may also cause evaporation of the substrate leading to collisional, heat-induced evaporative ionization. Alternatively, in some embodiments, the transport tube 102 may be a flexible tygon tube that is coupled to a metallic inlet capillary of the mass spectrometer 26 and this inlet capillary is heated.

The extent of the heating proposed herein is below the level required for Thermal Ionization MS, Plasma Ionization MS[9] or Corona Discharge Ionization[10], and the amount of heating proposed in accordance with the teachings herein is at the very least in in the temperature range of 45° C. to 250° C. which has been validated experimentally. This is in contrast to most standard ionizing methods which use temperatures of 800° C. or higher. It should be noted that droplets from PIRL are small and so applying heat in other temperature ranges may also work, although perhaps not as efficiently. In alternative embodiments, narrower temperature ranges may be used such as a temperature range of 50° C. to 150° C. In other alternative embodiments, the temperature range may be defined to have a maximum temperature that is less than 450° C. or less than 350° C. It is possible that applying heat at 450° C. or higher may cause too much fragmentation and/or disintegration. It should be noted that these various temperature ranges can be used with the other various soft ionization embodiments described in accordance with the teachings herein. It should be noted that the soft ionization described herein is different than thermal emission ionization that uses temperatures around 2,000 to 3,000 degrees Celsius.

Some desorption techniques create large droplets that are typically not ionizable with such low heat. However, in cases where very small aerosolized materials, such as in the sub-nanometer, nanometer or micrometer size range, are created, it has been discovered, in accordance with the teachings herein, that low or mild heating allows for ionization of the material to occur. This application of low heating provides several advantages including, but not limited to, lower energy usage, lower manufacturing costs, lower manufacturing complexity and allows for the use of materials that do not have to withstand larger temperatures. The heating in accordance with at least one of the embodiments described herein has been seen to provide an ionized material cohort that is similar in composition to those obtained with other ionization methods such as DESI. This makes existing molecular signatures available in DESI libraries applicable to laser desorption/soft ionization experiments for various purposes including, but not limited to, identification of cancer or identification of a biological tissue under study.

The heating time depends on how fast the plume is travelling. It is preferable if the plume comes in direct contact with a heated surface, preferably a bend in the inlet or collection tube or the transport tube (as shown in some embodiments herein), as this collision with a hot surface leads to better heat transfer and more efficient ionization. In this case there may be a large flexible tube that is attached to a rigid metallic collection inlet or inlet capillary of a mass spectrometer which together form the transport tube described herein and the metallic collection inlet or inlet capillary is heated to provide the soft thermal ionization.

However, the plume may also be ionized by heating the plume without direct contact or collision with a hot inlet wall but rather through convection or radiation heating or through heat conduction. Also, the plume transport time through the heated region results in sufficient evaporation of solvent to allow evaporative ionization. Sufficient evaporative ionization is indicated by an increase in total ion count detected by the MS.

In some embodiments, the amount of heating may be adjusted to affect how fast thermal convection takes place in the transport tube in order to obtain an MS signal within a reasonable amount of time. For example a temperature level can be used that is sufficient to allow complete thermalization at the desired temperature of the plume traveling at a given speed determined by the gradient of MS 24. Adjusting the amount of heating is advantageous since without this various flow rates may be needed to increase the residency for the plume material but adjusting the flow speed is difficult as typically it is dictated by the intrinsic pressure gradient of the MS device.

In accordance with the teachings herein, at least one embodiment of an evaporative ionization interface is provided that does not use a flow of air/gas and a pump, such as but not limited to a Venturi pump, to transport gaseous material, as described previously[1-3], to produce ionized material used for MS analysis. This method of ionization in accordance with the teachings herein is particularly suited to desorptive methods that generate very small droplets, in the micrometer or nanometer size, or pure gas phase species (solvated molecules) that are readily evaporatively ionized in the absence of rapid air/gas flow as in REIMS or electrospray charging as in Charge Assisted Laser Desorption Ionization Mass Spectrometry[11], or carrier gas chemical ionization[12].

Figure 3:
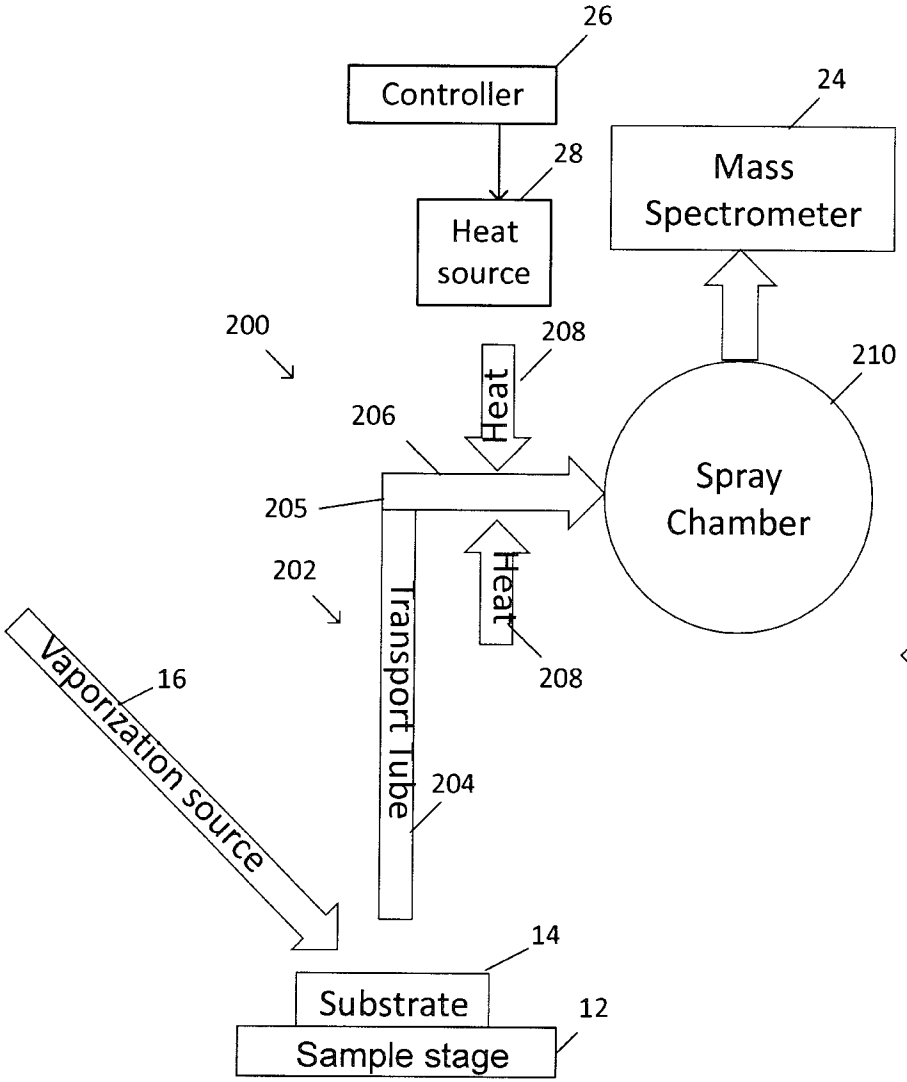
FIG. 3 shows components of an alternative example embodiment for a soft ionization Mass Spectrometry interface in accordance with the teachings herein.

Referring now to FIG. 3, shown therein are components of another example embodiment for a soft ionization mass spectrometry interface 200 in accordance with the teachings here. The interface 200 comprises the transport tube 202, the controller 26 and the heat source 28. The transport tube 202 is coupled to a spray chamber 210. The transport tube 202 has straight sections 204 and 206 that are coupled by a bend 205 in its physical structure which allows an orthogonal analyte spray into the inner workings of the mass spectrometer 24 and provides the optimal point to deliver external heat to promote evaporation of solvent and soft evaporative ionization of analytes present in the plume. This is because the bend 205 provides physical collision and contact exchange of heat due to the rapidly changing trajectory of the plume material.

In an example embodiment, in accordance with the teachings herein, the transport tube 202 having the physical bend 205 may be an extension inlet tube of a mass spectrometer interface such as the aerosol carrier tube of a Desorption ElectroSpray Ionization (DESI) interface possessing a 90 degree bend in the aerosol or analyte carrier tube (or collection tube). The 90 degree bend may be used to provide an effective base for collisional heat-induced evaporative ionization under ambient conditions, upon being heated by an external heat source such as, but not limited to, a tape heater, a Peltier unit, or internally by elevating the temperature of the mass spectrometer's orthogonal spray chamber through thermal diffusion. For example, the increased temperature of the spray chamber 210 allows heat exchange through both convection and collisional heat exchange that results in desolvation of material.

Figure 4:
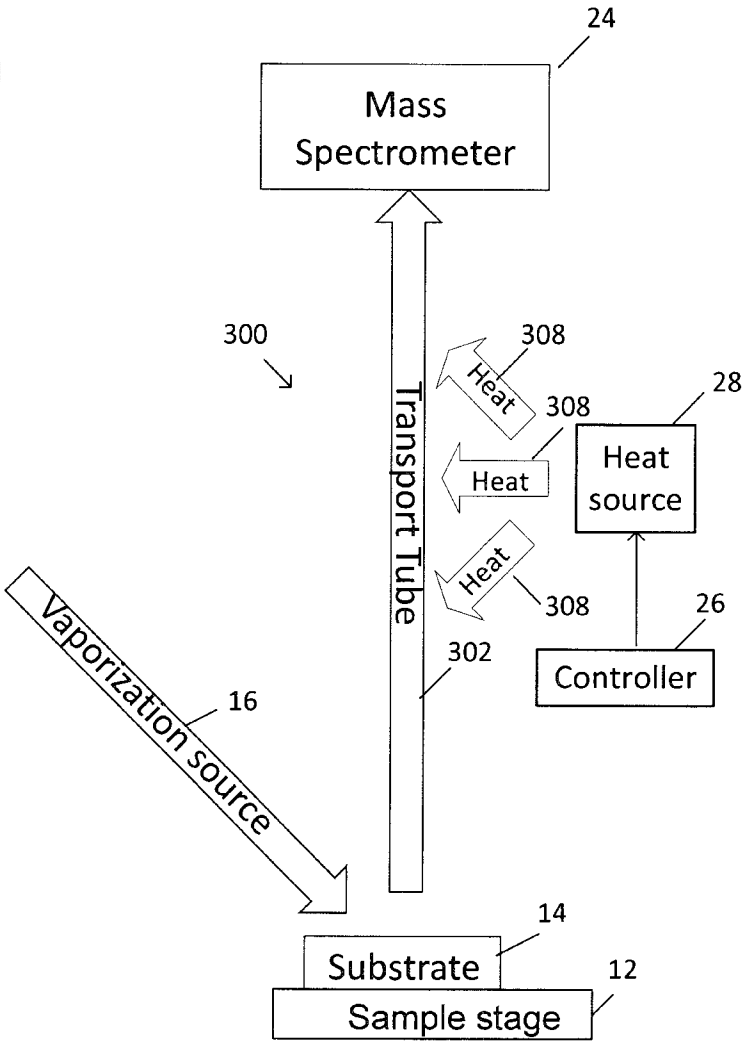
FIG. 4 shows components of another alternative example embodiment for a soft ionization mass spectrometry interface comprising an extension to an MS entrance to promote transport of plume material for soft evaporative ionization in accordance with the teachings herein.

Referring now to FIG. 4, shown therein is another alternative example embodiment for a soft ionization mass spectrometry interface 300 comprising a transport tube 302, a controller 26 and a heat source 28. In this example embodiment, the transport tube 302 is an extension to an MS entrance of the mass spectrometer 24 that promotes transport of plume material for soft evaporative ionization. In the absence of the orthogonal spray geometry described in FIG. 3, any portion of the transport tube 302 or the entire transport tube 302 can be heated. This embodiment may be used with other commercial MS interface extension inlet tubes that are present in other MS interfaces, such as DESI interfaces, that lack the 90 degree bend and heat-induced evaporative ionization can be achieved through heating the entire length of the transport tube 302 although this may be less optimal than MS interfaces which have a 90 degree bend.

However, in alternative embodiments, MS interfaces may be modified, in accordance with the teachings herein, to contain spiral passes, or a zigzag pattern for more effective dissipation of heat to facilitate evaporative ionization without requiring the flow of air or nitrogen gas and the Venturi pump. The modifications may be introduced to the DESI interface at a proximal portion (e.g. close to the plume/substrate) to allow for more efficient collisional, heat-induced evaporative ionization without altering the orthogonal spray design at the MS entrance.

Figure 5:
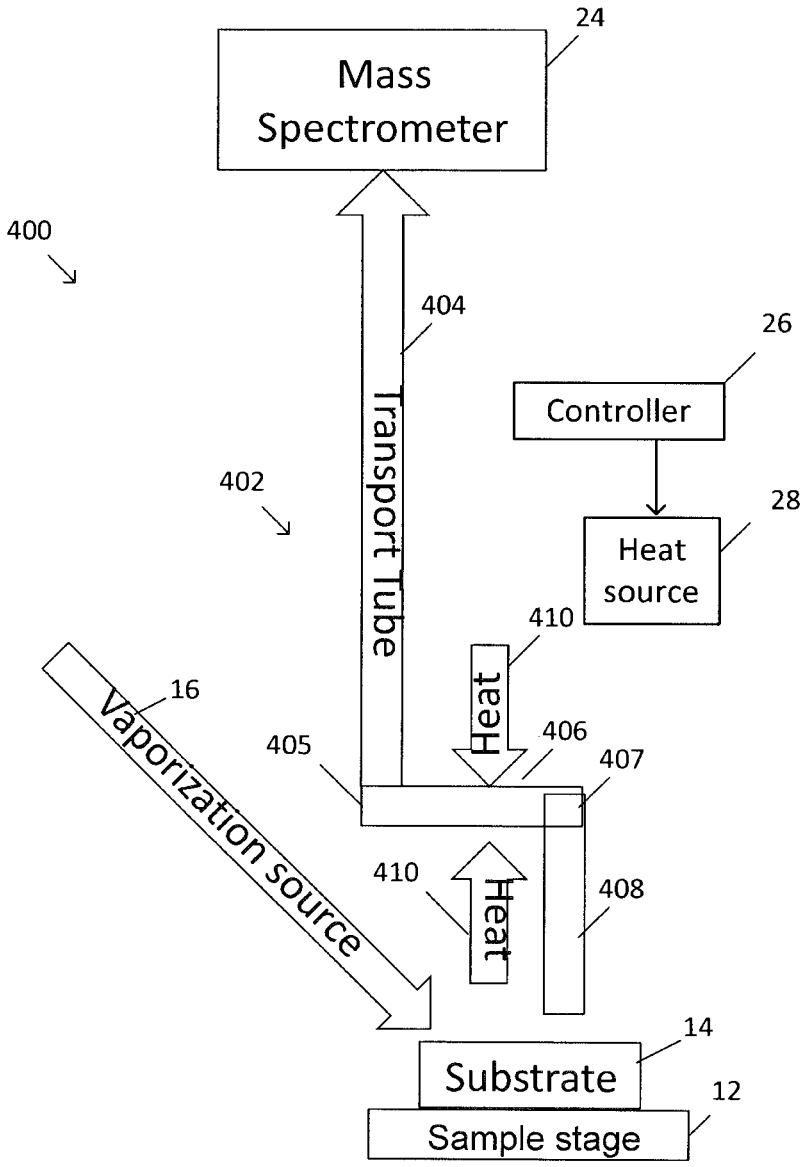
FIG. 5 shows components of another alternative example embodiment for a soft ionization mass spectrometry Interface of an MS interface in accordance with the teachings herein.
Figure 6A:
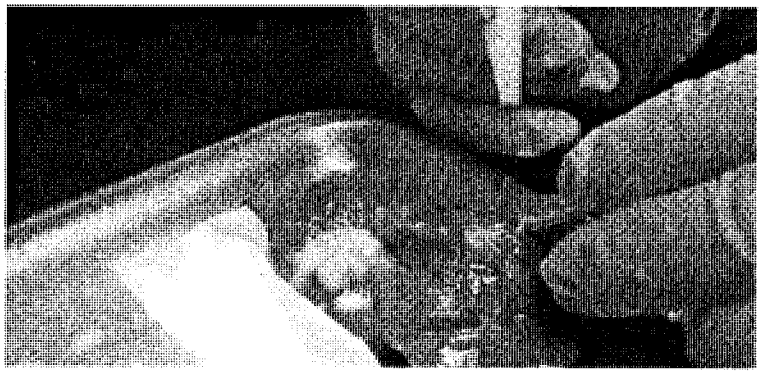
FIGS. 6A-6D show an example of real time analysis of biological tissues with a Picosecond InfraRed Laser (PIRL) ablation soft evaporative ionization method.
Figure 6B:
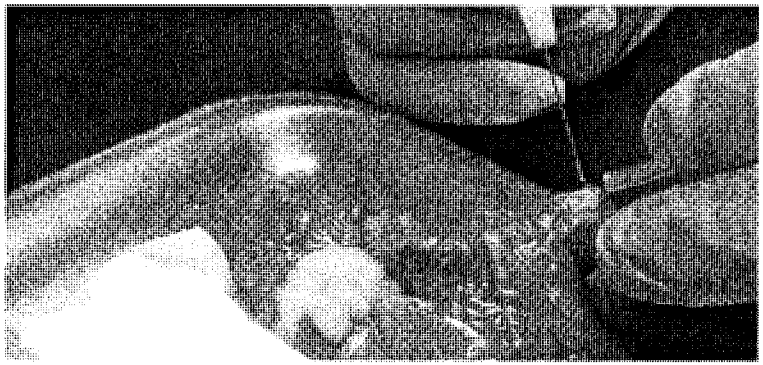
Figure 6C:
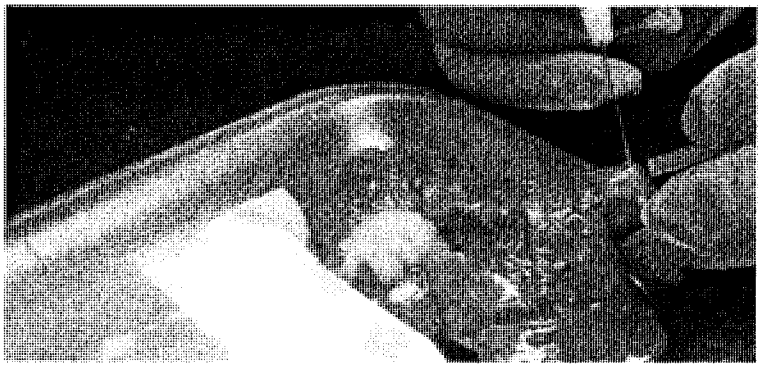
Figure 6D:
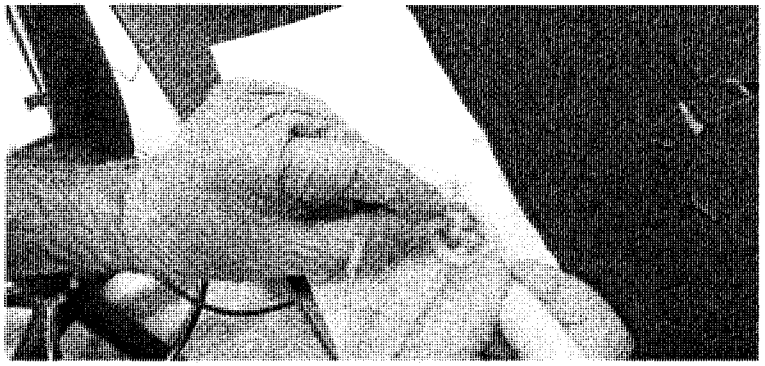

Referring now to FIG. 5, shown therein is an example embodiment of an MS interface 400 comprising the vaporization source 16, and a transport tube 402. In this example embodiment, the adaptation of optimal geometry allows for creation of an optimal heating point along the transport tube 402 when heat 410 is applied such that the attachment geometry to the entrance of the mass spectrometer 24 remains unaltered. For example, in this embodiment, the transport tube 402 has been optimized to include three straight sections 404, 406 and 408 and two bent portions 405 and 407. The bent portion 405 couples the straight sections 404 and 406 while the bent portion 407 couples the straight sections 406 and 408. It should be noted that a 90 degree bend or any internal structure such as a mesh, a ring or a ball that creates a contact point with the plume can be used. The interface 400 shows that the heating takes place closer to the substrate 14 than the MS 24.

The orthogonal spray collection at the entrance of the MS 24 prevents large droplets in the plume/aerosolized material from entering the ion optics of the MS 24 and contaminating the system. The large droplets have a velocity trajectory that prevents them from entering the MS 24. Electric potential and suction may then be used to only draw in ions and small droplets into the MS 24. The amount of electric potential and the amount of suction that is used may be based on the design of the MS 24 including the size of the ion entrance orifice and the vacuum provided by the inner workings of the MS 24. The amount of electric potential applied to the heater can be adjusted such that complete thermalization of the moving plume material may take place during the residency time at the heat contact point.

In the various example embodiments described in accordance with the teachings herein, at least a portion of the transport tube is made of a material that provides a suitable thermal conductivity for dissipation of heat to facilitate heat-induced evaporative soft ionization of molecules in the gaseous, vapourized plume or aerosolized material. For example this material can be stainless steel, gold or conductive heat resistant plastic.

FIGS. 6A-13 show an actual example implementation and proof of principle data using direct coupling of Picosecond InfraRed Ablation (PIRL) with heated DESI from 100 cm away from a mass spectrometer.

For example, FIGS. 6A-6D are photos of a PIRL being used to perform ablation and the soft ionization method, in accordance with the teachings herein, for the real time analysis of biological tissues. In particular, FIGS. 6A-6D shows the end of the transport tube and that plume is captured by holding the transport tube about 2-3 mm away from the site of laser desorption. These figures show a laser tip and a Tygon tube that is attached to an extension tube (not shown) which is in turn coupled to a collection inlet (not shown) of a mass spectrometer (not shown). The Tygon tube in combination with the collection inlet acts as a transport tube and the collection inlet can be heated. The transport tube can be combined with the laser tip in a single hand-held device. It should be noted that the Tygon tube may also be referred to as a sniffing tube in this example embodiment.

Generally, in the experiments, in ~2 seconds of laser ablation spectra characteristic of breast cancer was obtained. The spectra are indistinguishable from direct analysis of tissue by DESI-MS, tumour extraction by DESI-MS and two-step capture and analysis of PIRL plume by DESI-MS. The spectra also contains all key molecular markers that characterize tissue material (marked on the spectra in FIGS. 7A-13C in which the tissue material included materials such as chicken liver, beef liver, salmon, fish, and breast cancer tissues).

Experimental Methods of Study on the Identification of Mouse Organs

A study on the identification of mouse organs and tissues based on molecular finger printing with soft ionization picosecond infrared laser desorption was conducted and is described herein. All animal studies were conducted in accordance with institutional guidelines and approved by the animal use committee (Animal Use Protocol at the University Health Network, Toronto, Canada). Chicken or beef liver and salmon fish were purchased from a local grocery store.

An LM2-4 human breast cancer tumors model was established in female Severe Combined ImmunoDeficient (SCID) mice (Harlan). The mice were inoculated in their left inguinal mammary fat pad with $5\times10^6$ cells in a volume of 3-40 μL. The animals were then housed for 2 weeks to allow the primary tumour to reach a volume>250 $mm^3$ (caliper measurements). Primary tumors were surgically removed, flash frozen over liquid $N_2$ vapour, and stored at −80° C. For laser ablation, samples were thawed at room temperature and subjected to ablation by a fiber coupled PicoSecond InfraRed (PIRL) laser system PIRL 3000 from Attodyne Inc. operating at 1 kHz. Plume was collected using 100 cm long Tygon tube (I.D. 1/16" O.D. 1/8" from McMaster Carr) fitted onto the aerosol carrier tube of a Waters' DESI-MS interface. The temperature at the orthogonal bend was maintained and varied between 50-250 degrees Celsius. External heating by means of a tape heater was also used.

Mass spectrometry was performed using a Xevo G2XS Quadrupole-Time-Of-Flight Mass Spectrometer (Q-TOF-MS, Waters). For comparison, DESI-MS analysis of tissue smears, sections, lipid extracts of tissue or plume of PIRL collected on a filter paper was also performed.

Lipid extract was prepared by adding water (150 μL), methanol (190 μL) and chloroform (370 μL) to a tissue sample of ~10 $mm^3$ in size and vortexing for 2 min, followed by two rounds of centrifugation at 13,000 rpm for 5 min to separate the apolar phase. Extracted lipids after complete evaporation of solvent were resuspended in a small amount of chloroform for analysis and spotting on DESI-MS slides.

A filter paper (VDW Grade 415) was placed inside a custom-made funnel that was attached to a vacuum pump to collect the plume of laser-ablated material. To prevent ablative large tissue chunks from impacting the filter and contaminating the signal, the filter was placed 12 cm away from the laser ablation site and inspected for the presence of large tissue material. The filter paper was then placed onto a glass microscope slide and subjected to DESI-MS profiling.

Frozen tumours were mounted onto a metal specimen holder of cryostat with a small amount of Optimal Cutting Temperature (OCT) compound (Sakura Finetek USA Inc) to provide support. Slices each having a thickness of 10 pm were prepared using a CM1950 cryostat (Leica), and mounted onto a Superfrost Plus microscope slide. The slides were stored at −80° C. until imaged with DESI-MS.

Glass microscope slides containing samples (spotted extract), tissue sections or tissue smears or the filter paper containing the plume were mounted on a 2D moving stage and subjected to DESI-MS analysis in the negative ion mode over the mass range m/z 200 to 1000. A 1:1 mixture of acetonitrile and dimethylformamide (HPLC-MS grade, Sigma Aldrich, Oakville, ON, Canada), containing Leucine Enkephalin (150 pg/μL) for correction of m/z values, was used as the spray solvent, and delivered at a flow rate of 1 μL $min^{-1}$. The sprayer-to-surface distance was 1.0 mm, the sprayer to inlet distance was 5 mm, and incident spray angle was set to 68°. The source parameters were 150° C. capillary temperature, 3.6 kV capillary voltage, and nitrogen spray at 100 psi. Tissues were raster-scanned at a constant velocity in the range of 100 μm/s, with a scan time of 1 s, at a spatial resolution of 100 μm. Spectra were recalibrated for high mass accuracy using the accurate mass of Leucine Enkephalin in the solvent spray.

Figures 7A, 7B, 7C:
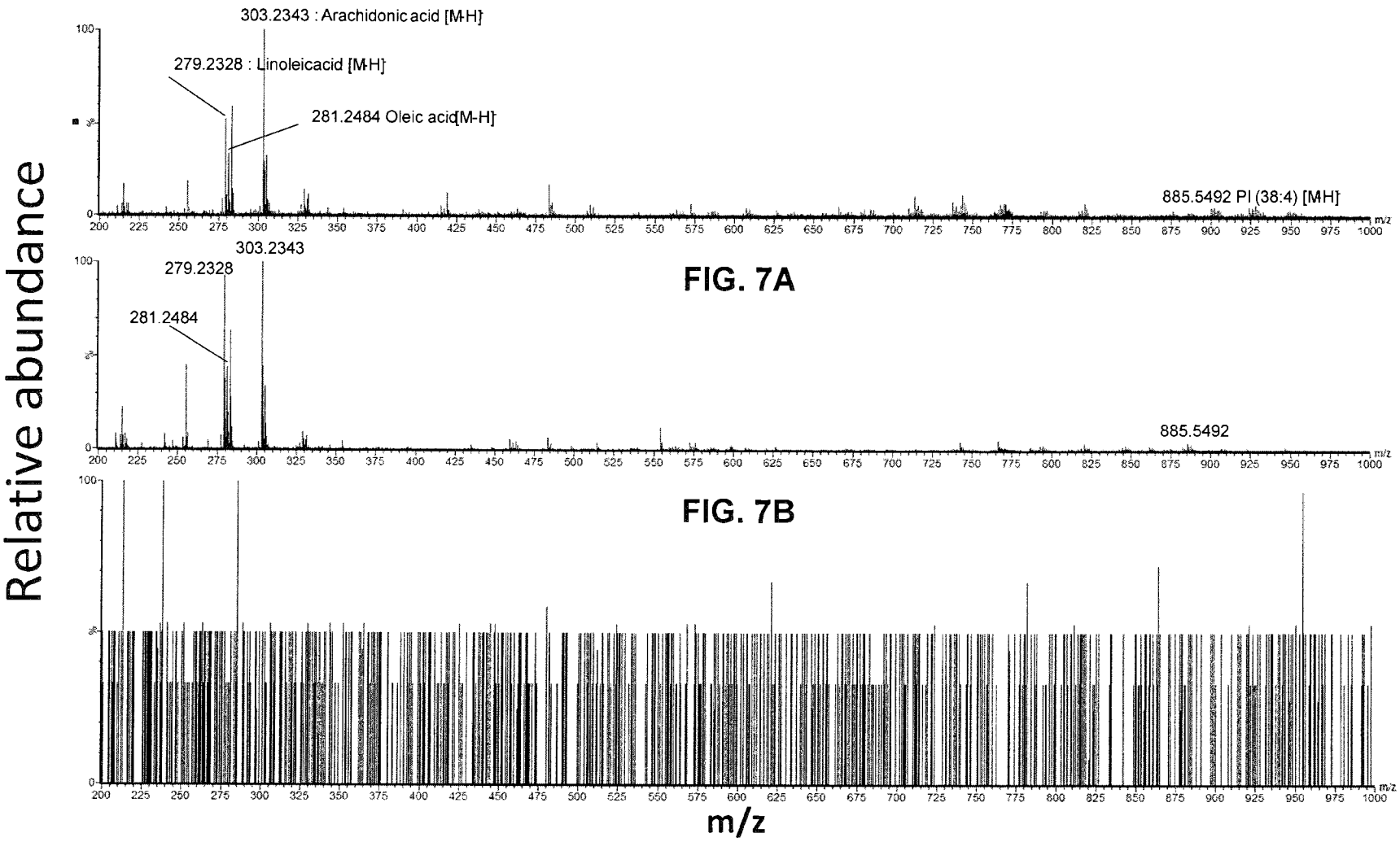
FIGS. 7A-7C show an example of real time analysis of cow liver by Picosecond InfraRed Laser (PIRL) soft ionization mass spectrometry.

Referring now to FIGS. 7A-7C, shown therein is an example of real time analysis of cow liver by Picosecond InfraRed Laser (PIRL) soft ionization mass spectrometry. FIG. 7A shows PIRL+Soft Ionization MS of Cow Liver. FIG. 7B shows Direct Desorption ElectroSpray Ionization Mass Spectrometry of Cow Liver smear and FIG. 7C shows background noise without PIRL. Lipids known to populate the mass spectrum of this tissue are presented with their identity assignments.

Figures 8A, 8B, 8C, 8D:
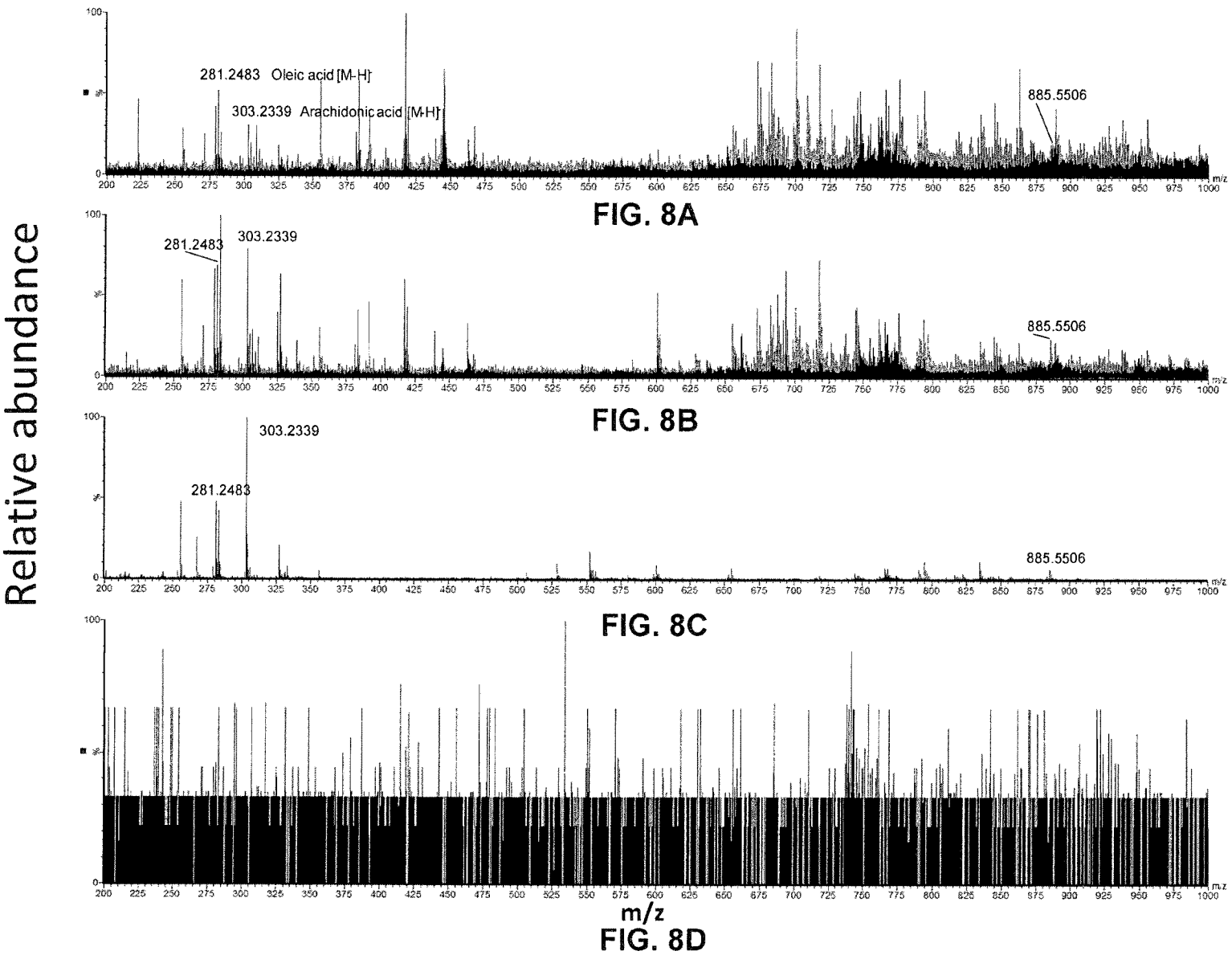
FIGS. 8A-8D show an example of real time analysis of mouse brain by cauterization AND by Picosecond InfraRed Laser (PIRL) soft ionization mass spectrometry.

In one instance, tissue smoke from mouse brain (equivalent to what is produced by electrocauterization in iKnife using REIMS) can be ionized with an example embodiment in accordance with the teachings herein Referring now to FIGS. 8A-8D, shown therein is an example of real time analysis of mouse brain by cauterization AND by Picosecond InfraRed Laser (PIRL) soft ionization mass spectrometry. FIG. 8A shows Cautery+Soft Ionization of mouse brain. FIG. 8B shows PIRL+Soft Ionization MS of the mouse brain sample. FIG. 8C shows Direct Desorption ElectroSpray Ionization Mass Spectrometry of mouse brain smear. In other words, the same brain tissue was subjected to two different mass spectrometry techniques. FIG. 8D shows background noise without PIRL. Lipids known to populate the mass spectrum of this tissue are presented with their identity assignments.

Figures 9A, 9B, 9C:
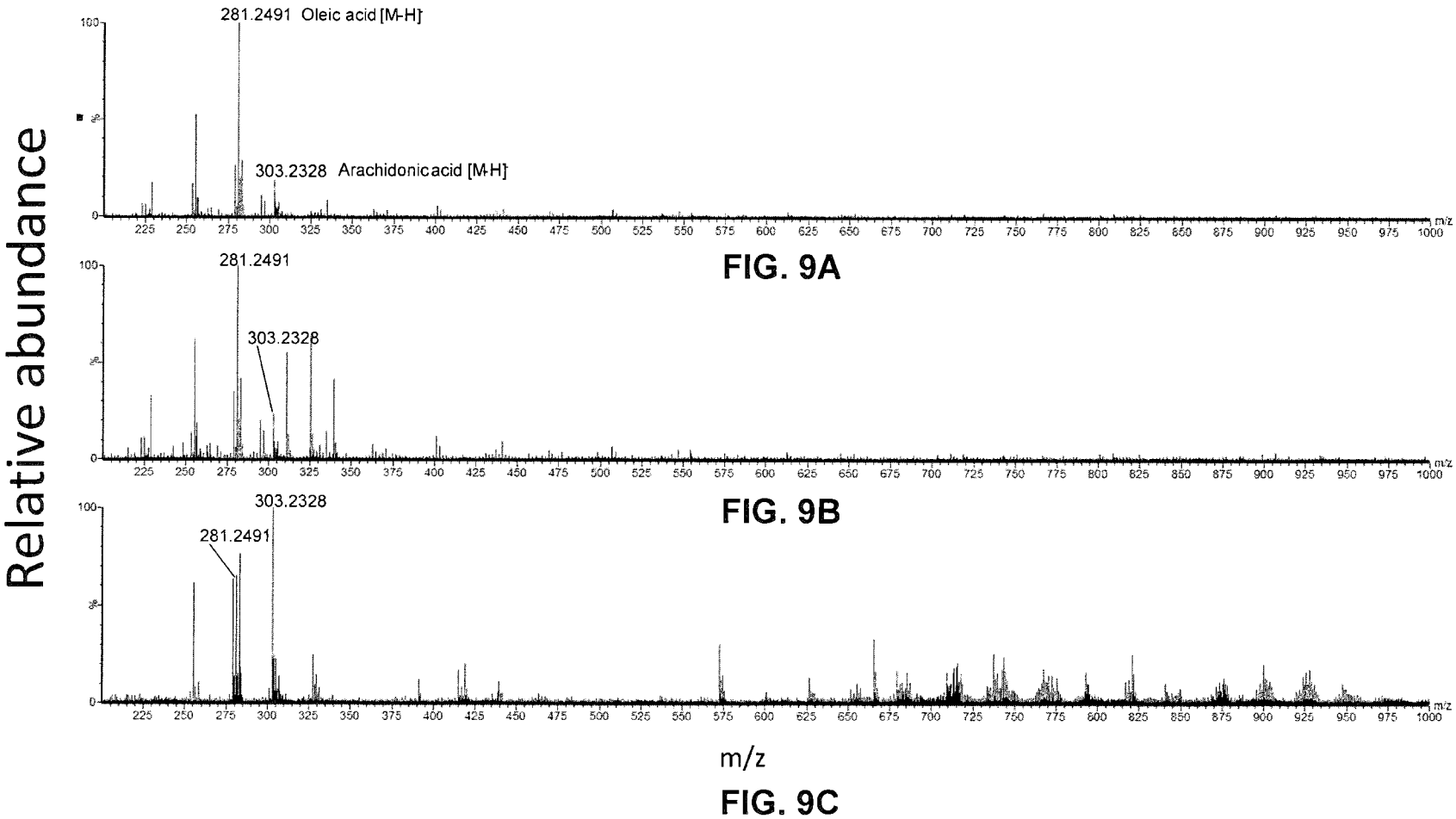
FIGS. 9A-9C show an example of real time analysis of chicken liver by Picosecond InfraRed Laser (PIRL) soft ionization mass spectrometry.

Referring now to FIGS. 9A-9C, shown therein is an example of real time analysis of chicken liver by Picosecond InfraRed Laser (PIRL) soft ionization mass spectrometry. FIG. 9A shows Direct Desorption ElectroSpray Ionization Mass Spectrometry of lipid extract from chicken liver. FIG. 9B shows Desorption ElectroSpray Ionization Mass Spectrometry of the plume of PIRL laser ablation of chicken liver collected on filter paper. FIG. 9C shows PIRL+Soft Ionization MS of chicken liver. In other words, the same liver sample was subjected to two different mass spectrometry techniques. Lipids known to populate the mass spectrum of this tissue are presented with their identity assignments.

Figures 10A, 10B, 10C:
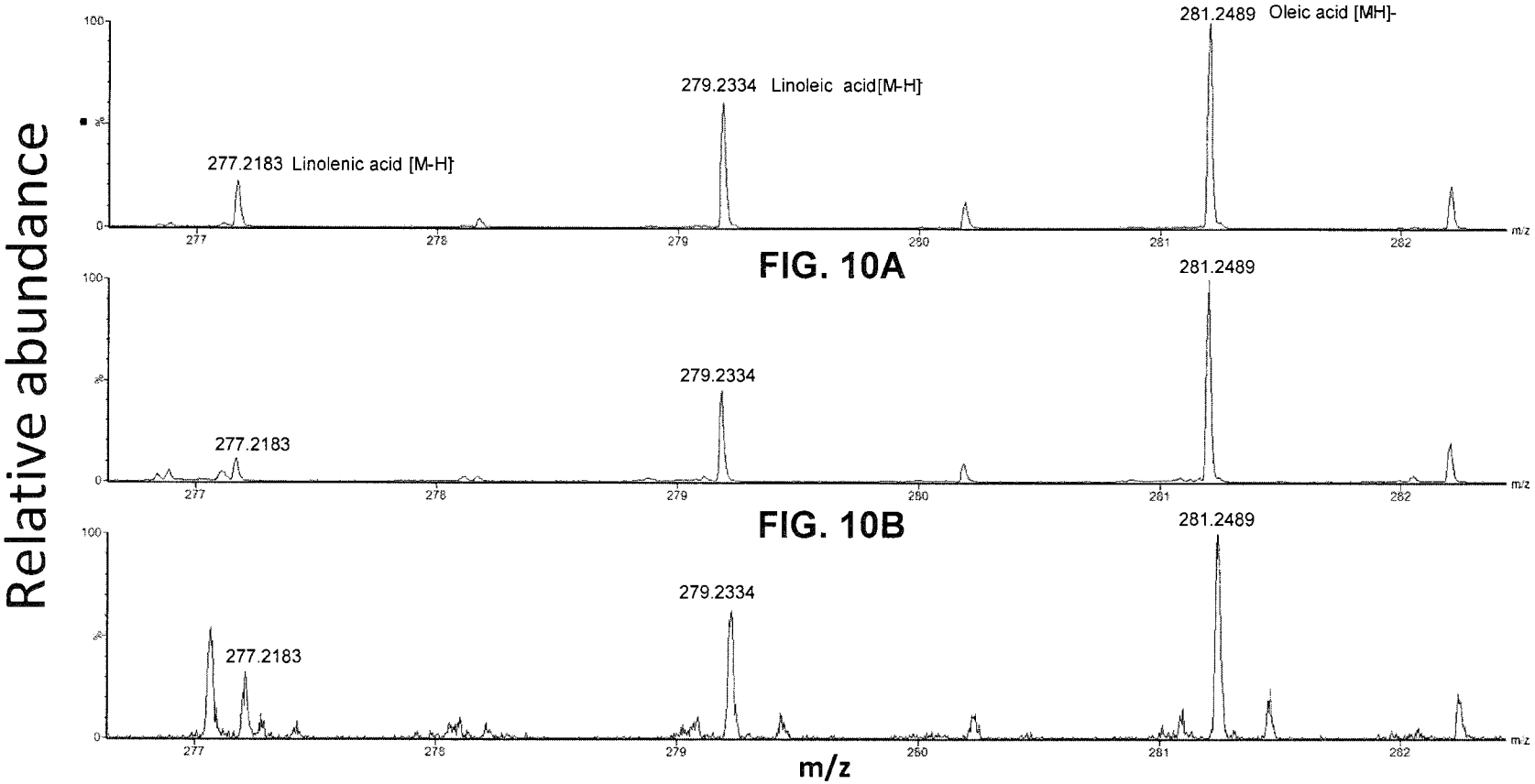
FIGS. 10A-10C show an example of real time analysis of salmon by Picosecond InfraRed Laser (PIRL) soft ionization mass spectrometry (zoomed view of spectra).

Referring now to FIGS. 10A-10C, shown therein is an example of real time analysis of salmon by Picosecond InfraRed Laser (PIRL) soft ionization mass spectrometry (zoomed view of spectra). FIG. 10A shows Direct Desorption ElectroSpray Ionization Mass Spectrometry of lipid extract from salmon. FIG. 10B shows Desorption ElectroSpray Ionization Mass Spectrometry of the plume of PIRL laser ablation of salmon collected on filter paper. FIG. 100 shows PIRL+Soft Ionization MS of salmon. In other words, the same salmon sample was subjected to two different mass spectrometry techniques. Lipids known to populate the mass spectrum of this tissue are presented with their identity assignments.

Figures 11A, 11B, 11C:
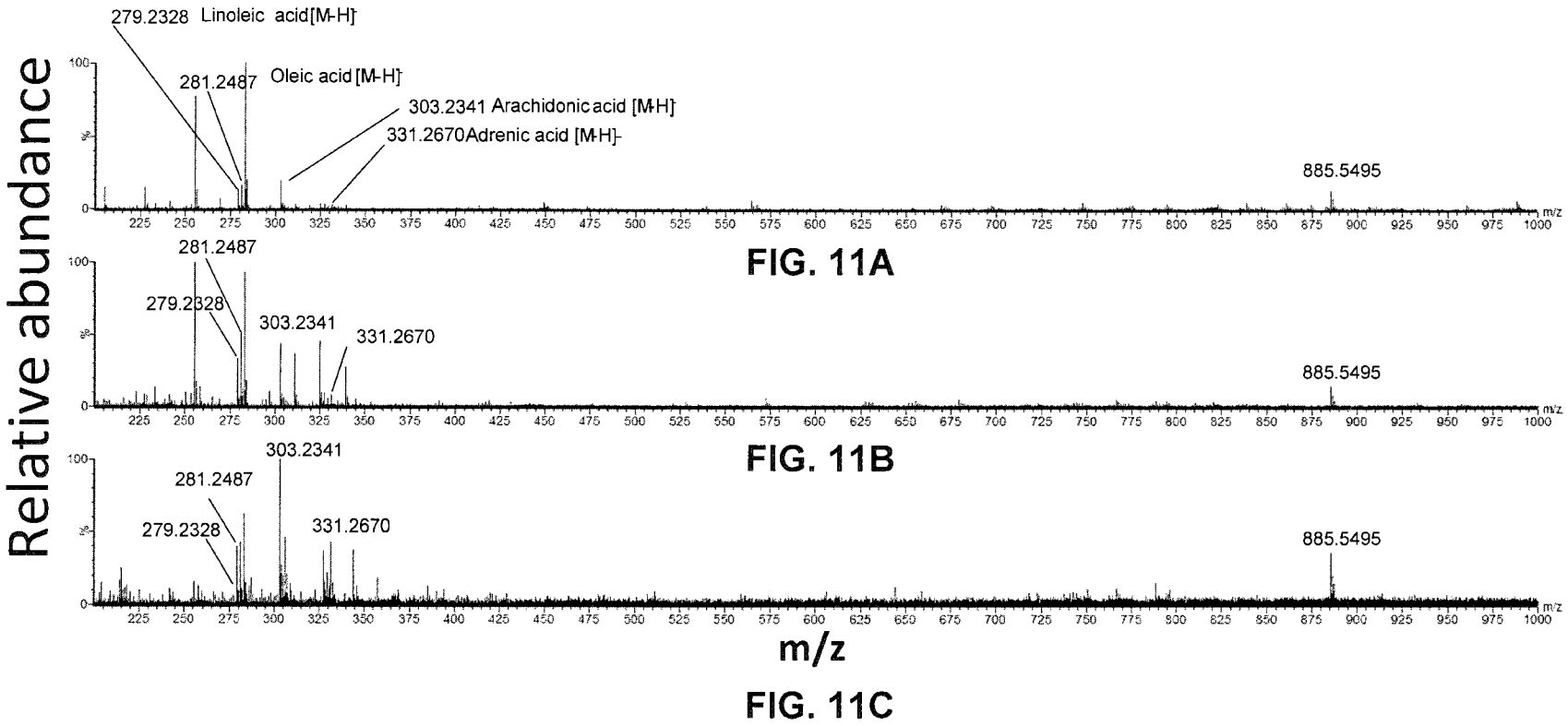
FIGS. 11A-11C show an example of real time analysis of human MDA-MB-231 breast cancer by Picosecond InfraRed Laser (PIRL) soft ionization mass spectrometry.

Referring now to FIGS. 11A-11C, shown therein is an example of real time analysis of human MDA-MB-231 breast cancer by Picosecond InfraRed Laser (PIRL) soft ionization mass spectrometry. FIG. 11A shows Direct Desorption ElectroSpray Ionization Mass Spectrometry of lipid extract from human MDA-MB-231 breast cancer tumour grown in mice FIG. 11B shows Desorption ElectroSpray Ionization Mass Spectrometry of the plume of PIRL laser ablation of human MDA-MB-231 breast cancer tumour collected on filter paper. FIG. 11C shows PIRL+Soft Ionization MS of human MDA-MB-231 breast cancer tumour grown in mice. All samples were from the same tumour and were subjected to different mass spectrometry techniques. Lipids known to populate the mass spectrum of this tissue are presented with their identity assignments.

Figures 12A, 12B, 12C:
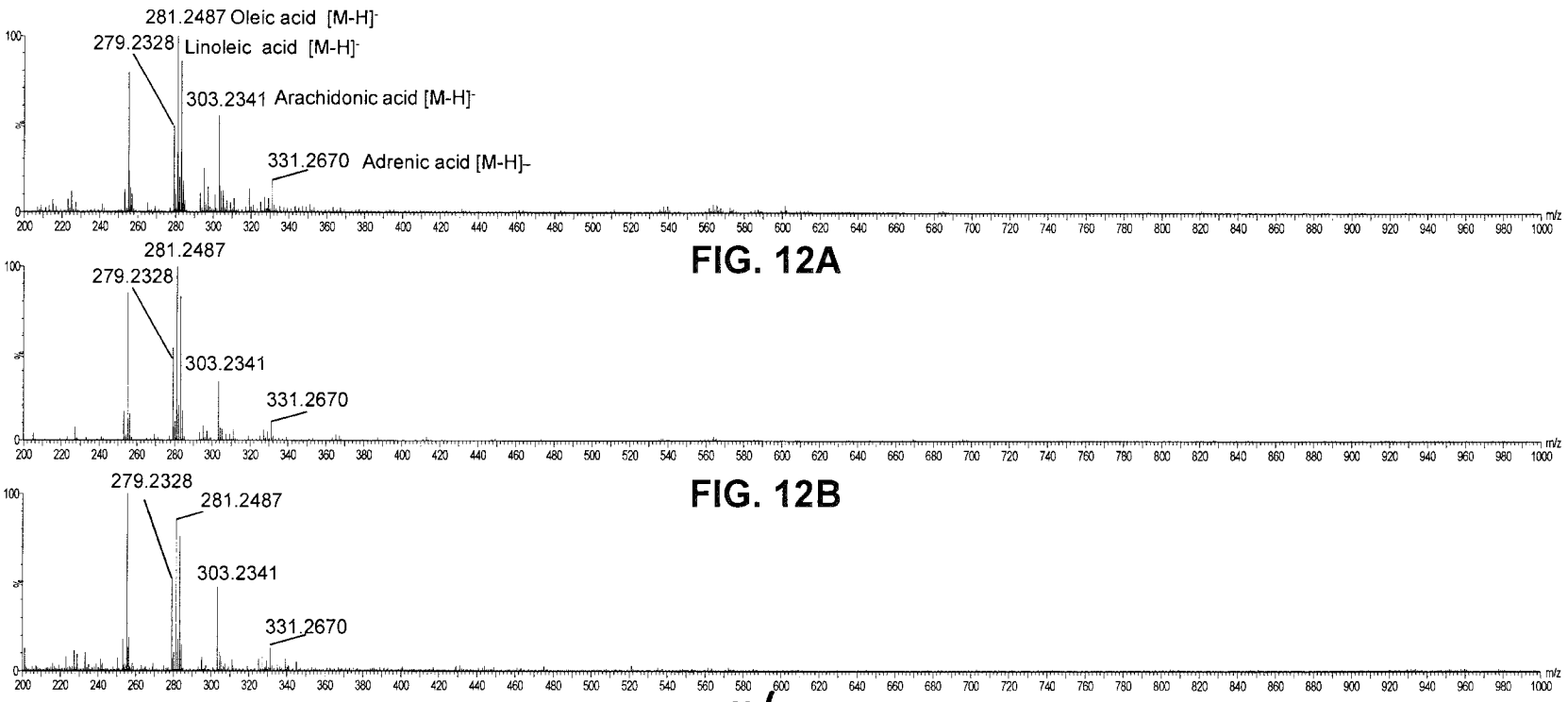
FIGS. 12A-12C show an example of real time analysis of human MDA-MB-231 breast cancer by Picosecond InfraRed Laser (PIRL) soft ionization mass spectrometry (independent repeat).

Referring now to FIGS. 12A-12C, shown therein is an example of real time analysis of human MDA-MB-231 breast cancer by Picosecond InfraRed Laser (PIRL) soft ionization mass spectrometry (independent repeat). FIG. 12A shows PIRL+Soft Ionization MS of human MDA-MB-231 breast cancer tumour grown in mice. FIG. 10B shows Direct Desorption ElectroSpray Ionization Mass Spectrometry of lipid extract from human MDA-MB-231 breast cancer tumour grown in mice. FIG. 100 shows Desorption ElectroSpray Ionization Mass Spectrometry of the plume of PIRL laser ablation of human MDA-MB-231 breast cancer tumour collected on filter paper. All samples were from the same tumour and were subjected to different mass spectrometry techniques. Lipids known to populate the mass spectrum of this tissue are presented with their identity assignments.

Figures 13A, 13B, 13C:
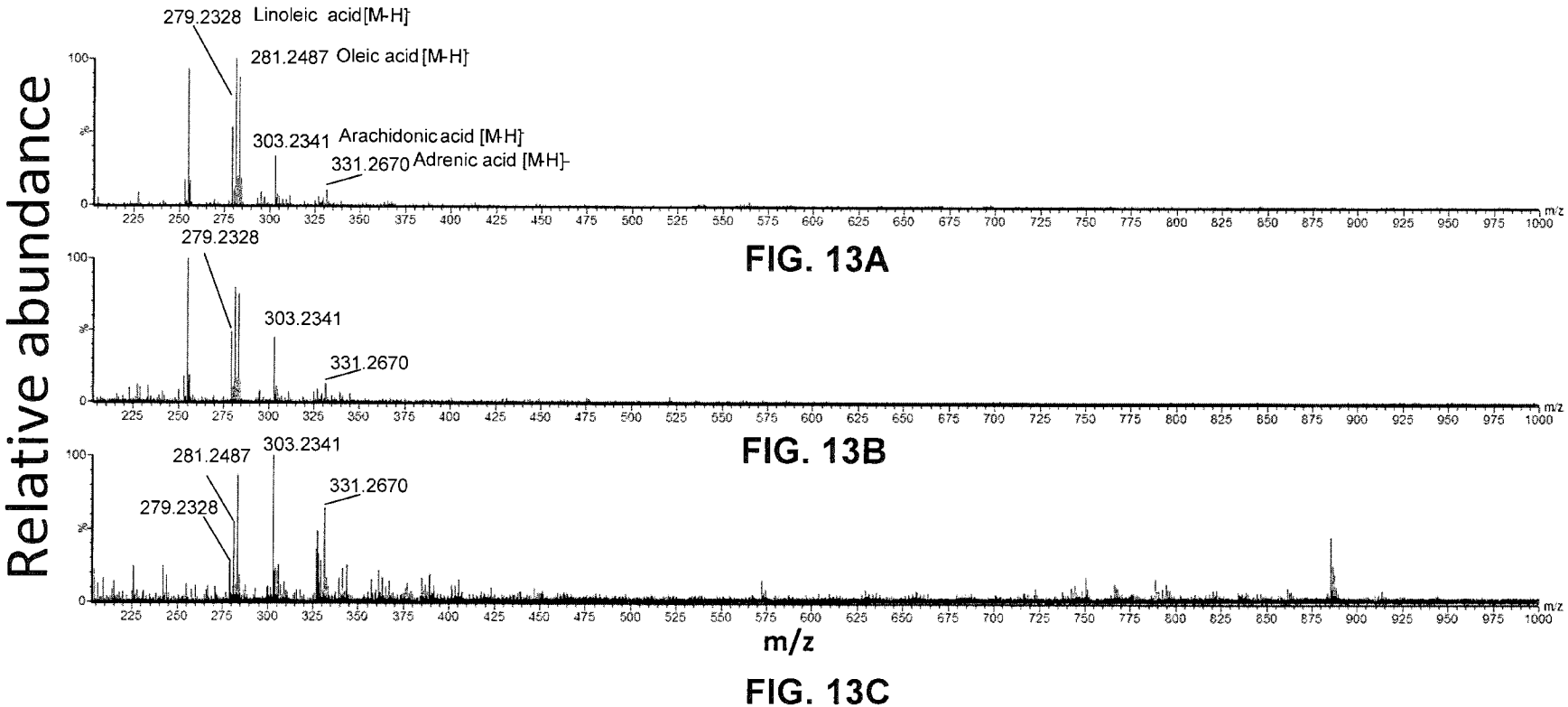
FIGS. 13A-13C show an example of teal time analysis of human

Referring now to FIGS. 13A-13C, shown therein is an example of real time analysis of human LM2-4 breast cancer by Picosecond InfraRed Laser (PIRL) soft ionization mass spectrometry (independent repeat). FIG. 13A shows Direct Desorption ElectroSpray Ionization Mass Spectrometry of lipid extract from human LM2-4 breast cancer tumour grown in mice. FIG. 13B shows Desorption ElectroSpray Ionization Mass Spectrometry of the plume of PIRL laser ablation of human LM2-4 breast cancer tumour collected on filter paper. FIG. 13C shows PIRL+Soft Ionization MS of human MDA-LM2-4 breast cancer tumour grown in mice. All samples were from the same tumour and were subjected to different mass spectrometry techniques. Lipids known to populate the mass spectrum of this tissue are presented with their identity assignments.

Hand-Held Laser Ablation and Soft Ionization Mass Spectrometry

A hand-held laser ablation device based on Picosecond InfraRed Laser (PIRL) technology was developed and demonstrated to be a suitable MS desorption source when coupled to a post ionization method[7]. A PIRL ablation device, shown to provide rapid extraction of molecules from tissue—including molecules already in a solvated ionic state such as phospholipids and fatty acids, was coupled to a custom-made soft thermal ionization interface capable of desolvating ionized tissue materials in accordance with the interface 200 shown in FIG. 3. PIRL ablation. Generally, a pulse duration in the range of 1-1000 picoseconds has been shown to not cause significant thermal and mechanical damage to tissue[14]. The pulse duration used for the data discussed herein was in the range of about 200 to 400 picoseconds. This range for this laser ablation method further allows efficient desorption of highly desolvated molecules without causing thermal and mechanical damage to tissue samples as well as higher quality molecular signatures and the ability to distinguish between several tumor subtypes as will be discussed herein.

It should be noted that other laser ablation devices and methods can be used with soft ionization in order to differentiate subtypes of tumour such as nanosecond and femtosecond infrared laser systems.

In accordance with the teachings herein, a flexible Tygon tube was used to extend the collection capillary of a modified commercial DESI-MS interface, and was heated to provide desolvation and evaporative thermally induced ionization (i.e. soft ionization). Any metallic or heat conductive MS inlet capillary or transport tube can be used for this purpose. For example, a transport tube that has a bend in its structure (as shown in FIG. 3 or FIG. 5) and receives heat at the bend region can be used to possibly increase collisional heat exchange.

As few as 5-10s of point sampling over an area of ~2 $mm^2$ with PIRL ablation is sufficient to correctly classify phospholipid and fatty acid profiles of healthy mouse organ tissues. FIGS. 14-19 show the reproducibility of mouse organ PIRL-MS profiles obtained from 4 independent mice, with some repetitions therein. Tissue specific m/z values (allowing tissue classification) were able to be detected in all independent repetitions. The plume transport and ionization for PIRL MS analysis shown herein was completed without a Rapid Evaporative Ionization Mass Spectrometry (REIMS) interface used for real time analysis of electrocautery plume or other surgical aerosols including ablation plume for other laser systems[15-18]. However, the inventors anticipate that integration with a REIMS interface is may be possible to increase the robustness of the sampled signal and reproducibility of plume collection due to increased suction by Venturi action, and further allow for infusion of matrix solvent to optimize desolvation/ionization.

Referring now to FIG. 14, shown therein is an example of PIRL soft ionization MS analysis of several mouse heart samples with ~10 seconds of in situ sampling. The MS lipid profile was collected in 10 s of sampling with picosecond infrared laser ablation along with soft ionization mass spectrometry and is presented along with unique mass to charge (m/z) values (highlighted) that characterize this tissue. The m/z value(s) unique to heart are highlighted with a star.

Referring now to FIG. 15, shown therein is an example of PIRL soft ionization MS analysis of several samples of mouse spleen with ~10 seconds of in situ sampling. The MS lipid profile collected in 10 s of sampling with picosecond infrared laser ablation and using soft ionization mass spectrometry is presented along with unique mass to charge (m/z) values (highlighted) that characterize this tissue. The m/z value(s) unique to spleen are highlighted with a star.

Referring now to FIG. 16, shown therein is an example of PIRL soft ionization MS analysis of several samples of mouse lung with ~10 seconds of in situ sampling. The MS lipid profile collected in 10 s of sampling with picosecond infrared laser ablation and using soft ionization mass spectrometry is presented along with unique mass to charge (m/z) values (highlighted) that characterize this tissue. The m/z value(s) unique to lung are highlighted with a star.

Referring now to FIG. 17, shown therein is an example of PIRL soft ionization MS analysis of several samples of mouse kidney with ~10 seconds of in situ sampling. The MS lipid profile collected in 10 s of sampling with picosecond infrared laser ablation and using soft ionization mass spectrometry is presented along with unique mass to charge (m/z) values (highlighted) that characterize this tissue. The m/z value(s) unique to kidney are highlighted with a star.

Referring now to FIG. 18, shown therein is an example of PIRL soft ionization MS analysis of mouse liver with ~10 seconds of in situ sampling. The MS lipid profile collected in 10 s of sampling with picosecond infrared laser ablation and using soft ionization mass spectrometry is presented along with unique mass to charge (m/z) values (highlighted) that characterize this tissue. The m/z value(s) unique to liver are highlighted with a star.

Referring now to FIG. 19, shown therein is an example of Identification of several mouse organs with ~10 seconds of sampling with a hand held PIRL ablation MS sampling device with an interface such as the interface 200 shown in FIG. 3 or with the setup shown in FIG. 6. The MS lipid profiles for a variety of mouse organs collected in only 10 s of sampling with picosecond infrared laser ablation and using soft ionization mass spectrometry is presented along with the mass to charge (m/z) values (highlighted) that characterize each organ. The coincidence between these m/z values and those from known organs is used to classify organ types in a blind experiment. In each panel, the m/z value(s) unique to each organ type are highlighted with a star.

To investigate whether PIRL-MS spectra had statistical relevance for discriminating between tissue types the PIRL-MS spectra of various mouse tissues from 4 independent mice was subjected to Partial Least Squares Data Analysis (PLS-DA). Referring now to FIG. 20, shown therein are the results of the statistical discrimination between PIRL MS profiles of different mouse tissues examined in the study for identifying mouse organs by molecular analysis of mouse tissue sample. The MS lipid profiles that were collected in 10 s of sampling with picosecond infrared laser ablation and soft ionization mass spectrometry were subjected to Partial Least Squares Data Analysis (PLS-DA) method using the MetaboAnalyst platform (details for the location and use of this program on the Internet are discussed below). The scores plot with a 96% confidence interval is shown and the graphical results suggest that there is clear grouping between data obtained for different mouse organs from 4 independent mice based on their PIRL-MS spectra (collected in 10 s).

Real-time MS profiling with PIRL ablation can thus be used to identify in situ tissue types in 10 s of sampling using the interface embodiment 200 shown in FIG. 3. The success of PIRL-MS in rapid tissue profiling is largely due to efficient coupling of vibrational excitation of water molecules to ablative modes using impulsive deposition of heat through picosecond IR radiation[19]. The high efficiency in converting incident optical energy to ablation produces highly desolvated gas phase phospholipids and fatty acids. This vapour is readily ionizable upon slight desolvation with soft techniques such as thermal ionization or evaporative ionization. Unlike electrocautery approaches that produce aerosolized tissue material for real time capture and MS analysis[20,21,18] PIRL uses a "cold" ablation laser that does not thermally damage tissue surrounding the sampling site, with minimal amounts of post ablation scar tissue and avoidance of the cellular stress response[22]. It is thus anticipated that a cold ablation scalpel may have utility in negative cancer margin assessment where the damage to the healthy tissue due to sampling must be kept to a minimum.

Medulloblastoma (MB) is a malignant pediatric brain tumour that is comprised of at least 4 distinct molecular subgroups (SHH, WNT, Group 3 and Group 4)[23]. The response to treatment, the prognosis and the overall survival rates are different between MB subgroups. Therefore, molecular subgrouping is en route to become part of the risk stratification of MB patients[24]. With molecular analysis capabilities becoming available at a larger number of clinical sites, molecular subgrouping is already playing an important role in management of patients with gliomas[25] and is expected to play a pivotal role in the personalized approaches to MB patient care as well. Currently, however, no rapid intraoperative means of determining subgroup affiliation exists to guide extent of resection, thereby minimizing postoperative neurological morbidity. While histopathology and immunohistochemistry methods, along with genomic NanoString DNA analysis and DNA methylation profiling are used to classify MB subgroups[26], intraoperative utility is lacking due to lengthy turnaround times. In the quest to determine MB subgroup affiliation information in a manner that is actionable during surgery a new analytical platform capable of rapid determination of tumour subgroups must be developed.

Ambient Mass Spectrometry (MS) is a powerful analytical platform capable of resolving the molecular heterogeneity of biological tissues examined under atmospheric conditions[27-29]. The ambient attribute enables direct in vivo, in situ or ex vivo tissue sampling, often in the absence of extensive sample preparation requirements. The molecular heterogeneity profile of the tissue, also referred to as its MS profile, is comprised of mass to charge (m/z) ratios of its constituent molecules. This profile can be obtained on timescales suitable for future intraoperative use[28,29], and is characteristic of each tissue type[29]. Capitalizing on this notion, experimentally recorded MS profiles can thus be used to identify tissue types. In this quest, rapid tissue identification uses multivariate statistical comparison methods that query the experimentally recorded MS profile of an unknown tissue against those present in a library of validated tissue MS profiles[27,29]. The multivariate methods are not computationally costly, and generally can be performed in a fraction of a second in an online fashion, as the MS spectra are acquired. Online model building methods capable of real time MS analysis have been reported[29].

Progressing beyond the tissue differentiation paradigm in distinguishing diseased and healthy tissues, the lipid and small molecule metabolite profiles of biological tissues are shown to have utility in cancer type identification or even tumour subtype determination with many ambient MS methods[30-37,27,38,29]. These classes of molecules thus offer superb diagnostic power in determining subtypes of the same cancer type based on the specific MS profile of lipids unique to each tumour subtype[35]. Good concordance with pathology-based classification methods is reported for a variety of human brain tumours[35] and other cancers[27,39,29].

Many of these pioneering studies have used Desorption ElectroSpray Ionization Mass Spectrometry (DESI-MS) [40] where charged microdroplets of a solvent material focused on the surface of a tissue slice or tissue smear[38,41] bring about extraction, desorption and ionization of tissue lipids and small molecule metabolites. DESI-MS has risen to an era of widespread utility in rapid cancer characterization in the biomedical domain[27,29].

While, a typical DESI-MS scan on the order of ~1 second is often sufficient to provide robust tissue MS lipid profiles[41,42], in vivo utility is lacking based on conventional techniques. The DESI-MS source in its current form cannot be used in vivo due to requirements for high electric potential, and the use of solvent materials toxic to the human body. To facilitate intraoperative applications two conventional approaches have been developed. One uses ex vivo tissue samples or tissue smears taken to a mass spectrometer located in close proximity to the operating room for off-line analysis, and the other uses real time capture and analysis by MS of the plume of electrocautery widely used in many surgical procedures for online assessment of cancerous tissue in vivo[21]. While electrocautery is thermally destructive to and thus cannot be used over healthy tissues due to concerns of damage, residual lipid and small molecule metabolites present in the tumour core survive the diathermy process. These molecules persist in the aerosols generated during diathermy, and can be taken up and desolvated for further online analysis with MS. Tremendous progress has been made in the cancer characterization domain with very high correct tissue classification rates corroborated by gold standard pathology methods[29].

To expedite the future clinical adoption of in vivo cancer characterization with online MS, a rapid tissue lipid and small molecule extraction method must be developed that (1) is efficient, allowing for reduced sample consumption (i.e. tissue area to be examined); and (2) minimally damages the tissue surrounding the sampling site, such that the method can be used with fewer reservations in both tumour bed examinations and negative margin assessments in vivo.

The current implementation of the electrocautery based MS methods[21] requires a priori and unequivocal determination of the cancerous region using a surgeon's input or other image modality data to provide an avoidance mechanism for healthy tissue, but is nevertheless a valuable tool for in vivo tumour grading. The proposed gentle means of extracting tissue lipids for online MS analysis may be hyphenated (i.e. combined) with the robust Rapid Evaporative Ionization Mass Spectrometry (REIMS) interface, developed initially for the analysis of the plume of electrocauteryl[15] and subsequently shown to also be compatible with a variety of tissue aerosolization methods, including ultraviolet (UV) and infrared (IR) laser ablation[4], and ultrasonic aspiration[17]. In this sense, gentle means that it does not result in fragmentation.

Recently, Picosecond InfraRed Laser (PIRL) ablation has been shown to rapidly extract[13], in the absence of significant thermal damage[22], tissue molecular content in the form of a gas phase plume[7] expanding rapidly in the atmosphere[43]. Subsequent capture and analysis by mass spectrometry of this plume has been demonstrated to be feasible upon coupling to an appropriate post ablation ionization source for MS imaging applications[7]. Tissue ablation with a picosecond IR pulse is a highly efficient process due to the strong coupling between ablative and vibrational modes of water on this timescale[19]. The bulk of the impulsive energy deposited into vibrational mode of tissue water molecules is converted into ablation, liberating water and tissue constituent molecules, ejecting them to the gas phase in the absence of significant thermal damage to the tissue[22] (Amini-Nik, Kraemer et al. 2010).

Capitalizing on the highly efficient nature of laser ablation with PIRL[19], which even allows for cutting of bone material[44] with low water content compared to soft tissue, the inventors believe that highly desolvated lipid species may be expected. Based on this assumption, the inventors recently demonstrated online coupling between PIRL ablation and MS for real time diagnostic applications through use of a 2 m long flexible collection tube (i.e. transport tube) coupled to a modified heated inlet capillary of a Time of Flight (TOF) MS instrument, capable of resolving transient input signals that are typical in laser ablation mass spectrometry methods. The heated inlet promotes thermal desolvation of the laser extracted, negatively charged tissue lipids as determined and reported by the inventors[45], condensed and possibly resolvated during the rapid cooling and plume expansion stage of the PIRL ablation process under atmospheric conditions[43]. The MS interface, implemented in accordance with the teachings herein, was shown to allow real time tissue profiling with in situ sampling in 5-10 seconds of total data collection, followed by post collection data analysis and statistical treatment as determined and reported by the inventors[45].

In a second experimental study, 19 independent subcutaneous murine xenograft tumours from 6 different established human MB cell lines belonging to MB subgroups of Sonic Hedgehog (SHH) and Group 3 were analyzed. A successful MB subgroup affiliation (98% accuracy) was achieved using PIRL-MS analysis with 5-10 seconds of sampling, assessed through supervised multivariate statistical analysis, utilizing close to 200 data points, with robustness confirmed with an iterative 5%-leave-out-and-remodel test. Additional high resolution LC-MS study of the captured laser ablation plumes allowed identification of m/z values that contributed the most to the statistical discrimination of PIRL-MS profiles of MB subgroup tumours. To support the clinical utility of this technique, a detailed discussion of analytical performance of the platform, origin of the outlier data points and the duty cycle is presented herein. A proof-of-principle demonstration of the utility of the online PIRL-MS setup (i.e. real-time desorption and MS detection) previously developed and reported by the inventors[45] for rapid determination of MB subgroup affiliation.

To examine the potential utility in the determination of MB subgroup affiliation with 5-10 seconds of tissue sampling with the handheld PIRL-MS analysis tool recently reported by the inventors' research group[45], subcutaneous murine xenograft tumours were prepared belonging to two MB subgroups (Sonic Hedgehog (SHH) and Group 3) for which multiple established human cell lines existed, and subjected ex vivo tumour samples thereof to PIRL-MS data analysis.

A drawback with xenograft studies is that a murine model prepared from a single established cancer cell line does not capture the heterogeneity seen in tumours from a patient population. It is thus important to ensure subgroup classification using PIRL-MS is not hampered by the intrinsic biological heterogeneity of tumour samples. To address this caveat to some extent, xenograft tumours from 6 different established MB cell lines were used including: D341, D458, MED8A (for Group 3) and ONS76, DAOY, UW228 (for the SHH subgroup). The PIRL-MS data of these tumours was combined into their respective MB subgroups such that some level of intrinsic biological heterogeneity, albeit to a lesser extent than expected from patient samples, is captured in the analysis presented herein.

The inventors hypothesized that laser extracted molecules present in the m/z 100-1000 range of the 194 PIRL-MS spectra recorded (5-10 seconds of laser ablation sampling per spectrum) may provide subgroup-specific MS profiles that may be used to distinguish Group 3 MB from its SHH counterpart. FIG. 21 shows representative PIRL-MS spectra for both Group 3 MB, as represented by a MED8A xenograft tumour, and for the SHH subgroup, as shown by xenograft tumours prepared from the DAOY cell line. These two particular tumours were chosen only on the basis of sample availability. These PIRL-MS spectra were collected with 5-10 seconds of sampling in the negative ion mode using the interface developed by the inventors[45]. These PIRL-MS spectra contain unique, subgroup-specific m/z values, as labeled, which differentiate from the samples from one another. The PIRL-MS spectra of Group 3 and SHH MB are significantly different from each other, attesting to the specificity of laser extraction of tissue lipids with PIRL ablation. Table 1 provides a list of the m/z ratios characteristic to each MB subgroup. FIG. 22 illustrates the schematics of the experimental setup used for ex vivo tissue analysis with PIRL-MS.

TABLE 1 m/z values that separate classes of MB from each other

| MED8A m/z for direct PIRL MS | DAOY m/z for direct PIRL MS |
|---|---|
| 134.05 | 327.25 |
| 255.25 | 691.52 |
| 281.25 | 709.51 |
| 303.23 | 710.51 |
| 305.25 | 721.55 |
| 329.25 | 723.53 |
| 391.25 | 733.52 |
| 417.25 | 737.55 |
| 572.50 | 739.53 |
| 629.50 | 743.55 |
| 659.50 | 751.55 |
| 663.50 | 765.55 |
| 687.55 | 766.56 |
| 713.55 | 767.55 |
| 717.55 | 770.59 |
| 744.58 | 794.60 |
| 875.80 | |

Figures 22A, 22B, 22C, 22D:
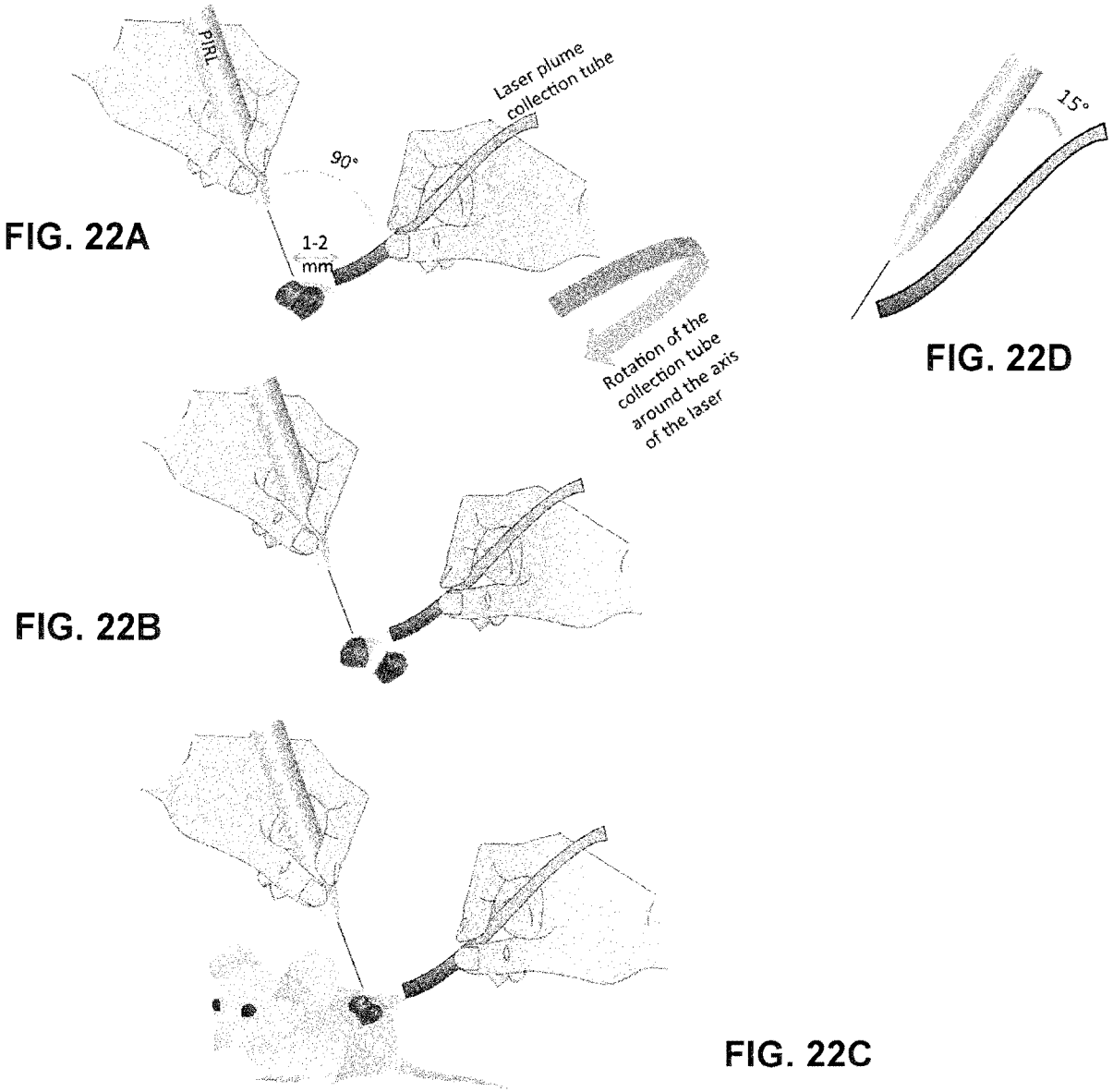

Referring now to FIGS. 22A-22D, shown therein are the schematics of the PIRL MS experimental setup for the determination of MB subgroup affiliation. Murine xenograft tumours were surgically exposed, resected and subjected with PIRL MS sampling as ex vivo tissue as indicated in FIG. 22A and FIG. 22B for analysis of tumour surface (see FIG. 22A) and tumour cores (see FIG. 22B). Note that in situ sampling as shown in FIG. 22C is also possible with the current platform but was not pursued for the subcutaneous tumours analyzed in this second study. The angle between the laser tip and the collection tube was about 90 degrees. The fixed geometry between the longitudinal axis of the laser tip and the longitudinal axis of the collection tube shown in FIG. 22D was also attempted but was found not to be optimal (other variations of this include using an angle of about 0 to 9 degrees and alternatively a collinear setup). The rotation of the collection tube around the axis of the laser tip to optimize the sampled signal is shown in FIG. 22A.

In Vivo Mouse Tissue Identification

In vivo mouse tissue profiling study used NOD SCID gamma (NSG) mice (Jackson Laboratory). Mice were maintained in accordance with the Toronto Centre for Phenogenomics (TCP) institutional animal protocols, and sacrificed by $CO_2$ inhalation. Organ tissues were dissected, and kept on ice for further analysis. Animal-use protocol (AUP) was approved by the TCP committee under AUP 0293H. Tissue water content values (in rats) can be found in this reference[46].

PIRL Ablation MS Implementation

In the second experimental study a 2 m long Tygon tube with the inner diameter of 1.6 mm (McMaster Carr) was used as the transport tube and attached to the collection capillary of a commercial DESI-MS interface (Waters). The length (2 m) was sufficient to reach the analysis table without blocking instrument access. The interface 200 shown in FIG. 3 was used and the capillary was heated at the bend, using an external heater, to ~50-100° C. to facilitate desolvation of phospholipids and fatty acids extracted from the tissue with PIRL. Laser ablation was performed at a wavelength of 3,000±100 nm with ~250 mW of power from the tip of a 2 m long flexible multimode sapphire fiber with core diameter of 425 μm that was coupled to a commercial solid state picosecond mid IR laser (Model PIRL 3000, Attodyne Lasers). The laser was operating at 1 kHz with pulse duration of 300±100 ps. The laser tip was manually rastered across the tissue surface with a typical speed of ~2-10 mm/s and the tip to surface distance was about ~1 mm, and the ablation plume was collected by holding the collection tube (i.e. transport tube) about 1-2 mm from the ablation surface. The fluence (average power/spot size) was calculated based on the measured output of the laser at the tip, and the laser spot of ~500 pm (approximately collimated beam after the fiber). Since the laser beam was fairly collimated to within 5 mm after the laser tip, this operation geometry produced an ablation fluence of ~0.15 $J/cm^2$. Typically, reasonable MS spectra with good signal to noise ratios were obtained from interrogating a ~1-5 $mm^2$ area with 5-10 s of sampling. MS analysis was performed in the negative ion mode. Because of manual movement and varying speed, accurate typical ablation depth information was not determined. However, estimating from the typical speed of movement a depth of 300 μm was anticipated. Characterization of open beam PIRL laser ablation using controlled imaging setup with translation stages is presented in Zou et al. 2015[7].

Statistical Analysis

MS peak lists (from m/z 200 to m/z 1000) were uploaded into the Metaboanalyst 3.0 web portal (http://www.metaboanalyst.ca), with a mass tolerance of 20 ppm. Data columns that contained greater than 80% missing values were removed, and the data were subjected to an Interquartile range (IQR) filter[47]. The ion abundances were normalized to the sum of m/z intensities for each spectrum, and then subjected to Pareto scaling[47]. Partial Least Squares Data Analysis (PLS-DA) was performed to examine the grouping of MS profiles for different mouse tissue types[48,49].

MB Murine Xenograft Tumours

All cells were cultured at 37° C. and 5% CO2. Human medulloblastoma cell lines were grown in media containing various concentrations of amino acids, salts, vitamins and between 10%-20% Fetal Bovine Serum (FBS) (Wisent Inc., St. Bruno, QC, Canada). All animal procedures were approved by the Animal Care Committee at the Toronto Centre for Phenogenomics (TCP). Animal-use-protocols were in accordance with the guidelines established by the Canadian Council on Animal Care and the Animals for Research Act of Ontario, Canada. Under isoflurane anesthesia, mice were injected with 2.5 million cells into both flank regions, for a total injection volume of about 100-200 μl into each flank. After the tumour volume had reached 500-800 $mm^3$ or 5 weeks post injection, the mice were euthanized and the tumours were resected for MS analysis. 19 tumours were used for PIRL-MS with the break down by cell line as follows: D341, n=4; D458, n=3; MED8A, n=2; DAOY, n=3; ONS76, n=3; UW228, n=4.

PIRL MS Analysis

The handheld PIRL-MS source[45] using a PIRL 3000 unit (Attodyne Lasers, currently Light Matter Interactions) was used as described previously with a 2 m long Tygon tube acting as the transport tube and connected to the heated inlet (150° C.) capillary of a DESI-MS collection source (Waters)[45]. The laser fiber tip (500 μm spot, 3,000±100 nm, 300±100 ps at 1 kHz, fluence of ~0.15 $J/cm^2$), was rastered over a ~1-5 $mm^2$ area for 5-10 seconds without touching the specimen, with the tip of the plume collection tube 1-2 mm away from the site of ablation. PIRL-MS spectra (from m/z 100 to m/z 1000) were collected on a Xevo G2XS Quadrupole-Time-Of-Flight Mass Spectrometer (Q-TOF-MS, Waters) in the negative ion mode. Additional details of laser ablation parameters and the setup developed by the inventors were reported[45]. For MB sample analysis, subcutaneous xenograft tumours were surgically exposed, harvested and subjected to PIRL-MS sampling with data collection times not exceeding 10 seconds. Each tumour was sampled at least 10 times from different regions both on the surface and from its core (tumours were halved) to capture spatial heterogeneities akin to those present in real world samples. A grand dataset of 194 PIRL-MS data points (i.e. spectra) collected over 5-10 seconds of PIRL-MS sampling was generated.

Data Analysis

The 194 data files were divided into two folders, one for Group 3 and one for the SHH group, and submitted to MetaboAnalyst for Partial Least Squares Discriminant Analysis (PLS-DA). Details of Metaboanalyst settings used by the inventors were reported[45] with 1 notable exception: mass tolerance was set to 100 mDa due to the lack of correction for mass shift. In cases where a 25 mDa tolerance was used, the spectra were corrected using the accurate mass of 717.5076 (see Table 1). While this peak was more intense in the Group 3 samples, it was present in all samples at levels well above the background.

Progressing beyond single MED8A and DAOY tumours as representatives of Group 3 and SHH MB, the collective PIRL-MS data from all 6 cell lines listed above was grouped into their respective MB subgroups. The grand dataset of 194 PIRL-MS spectra was then subjected to the supervised multivariate method of Partial Least Squares Discriminant Analysis (PLS-DA)[50] to assess the success rate of MB subgroup affiliation determination with 5-10 seconds of PIRL-MS sampling.

Referring now to FIGS. 23A-23B, shown therein is statistical discrimination of the SHH and Group 3 MB based on 5-10 second PIRL-MS analysis. Ten repetitions from each tumour were processed as described above and subjected to multivariate analysis using PLS-DA through the MetaboAnalyst portal.

FIG. 23A shows the PLS-DA scores plot that clearly demonstrates the statistical discrimination between PIRL-MS data points belonging to two MB subgroups examined. The shaded ovals represent the 95% confidence interval. Internal sample name designation names were used. Since each data point is collected with only 5-10 seconds of sampling the determination of subgroup affiliation achieved herein is considerably faster than the competing methods of immunohistochemistry and NanoString DNA sequencing. No overlap with the 95% confidence interval area (shaded ovals) between SHH and Group 3 data is seen over this large dataset. While a few outliers (n=3) locate to the outside of the 95% confidence interval boundaries, no misclassified data points are present. Misclassification is defined as a data point from one subgroup presenting itself within the 95% confidence interval of the other group. For these comparisons and throughout this application, data points that localized within the 95% confidence interval border of a subgroup were considered as belonging to that subgroup. The success rate for correct MB subgroup affiliation prediction, defined as the percentage of PIRL-MS spectral data points that are correctly classified into the 95% confidence interval of their expected MB subgroup, was 98%. Therefore, PIRL-MS spectra collected in only 5-10 seconds, in the absence of additional averaging, were sufficient to provide predictable MB subgroup classification statistics. For potential clinical applicability, additional discussions around the outlier data points and the statistical robustness of the observations shown herein are presented below.

Analytical Performance and the Duty Cycle

The PIRL-MS spectra of two of the 3 outliers noted in FIG. 23A (UW228 sample E1 and ONS76 sample C8) possessed 140 and 170 mass peaks, respectively, upon application of a 5% noise level threshold. While this constitutes 35-45% fewer mass peaks compared to the average of 265±70 mass peaks for data points within the confidence interval, the high standard deviation seen in the number of mass peaks across the dataset makes this drop insignificant. In a similar vein, in the PIRL-MS spectrum of the third outlier (ONS76, sample B9) 250 mass peaks could be identified, which is comparable to the average value of all data points. Likewise, examination of MS signal strength using Total Ion Count (TIC) values suggested that the outliers showed a maximum of only a 2 fold drop from the average TIC value of $(1.5\pm0.9)\times10^6$ exhibited by the grouped data points. A comparison with ablation site heterogeneity from histology could not be made (given the experiment design) to determine whether intrinsic sample heterogeneity (blood vessels, nerves etc) at the ablation site could have been responsible for the outlier behavior given they possessed good quality MS spectra. This comparison can be used in a workflow for analyzing human samples, where greater heterogeneity is expected. Due to the ablative nature of the rapid tumour grading platform described in accordance with the teachings herein, histology only at the vicinity of the laser ablation sites can be accessed with post PIRL-MS staining and microscopy assessment. This creates a nontrivial level of uncertainty that could only be resolved by showing that the observations hold over a large number of patient samples. The TIC and the number of expected mass peaks typical for MB samples determined above, however, may be further utilized to establish and implement analytic criteria for acceptable PIRL-MS data quality on the basis of TIC threshold, intensity of most abundant expected peaks, or the number of mass peaks. This information will provide data inclusion/exclusion rules for single PIRL-MS events in an unbiased manner prior to commencing statistical modeling. On the basis of this information, one PIRL-MS data point that only contained 16 mass peaks was excluded from the analysis.

The analytic reproducibility of the PIRL-MS platform described in FIG. 22 is now discussed. With the PIRL laser providing a minimum of ~250 mW of average power, close to 90% of all of the PIRL-MS sampling attempts resulted in acceptable MS spectra in which greater than 100 mass peaks were detected, after the application of a 5% noise threshold. The most prominent causes for the 10% failure rate in detecting MS signal were (1) laser tip contamination, (2) sample dehydration that resulted in tissue burning as opposed to desorptive ablation affecting the signal level, and (3) irreproducible plume capture due to flexible collection geometry and the weak suction at the proximal tip of the 2 m long collection tube. Cleaning the laser tip by dipping it in methanol for 5 seconds in between sampling events significantly improved the duty cycle. In the absence of a Venturi pump akin to that implemented in REIMS[15,21] (or recently with other infrared laser ablation systems[51] to increase efficiency of the laser plume collection), the capture of the ablation plume was optimized by manually rotating the proximal tip of the flexible 2 m collection tube held 1-2 mm from the laser fiber tip at a 90 degree angle around the laser tip. This allowed the operator to maximize the collection of the ablation plume, which was visible to the naked eye. This degree of freedom gave stronger, more reproducible signals compared to a fixed geometry that was also attempted (see FIG. 22D). The MS operator then guided the laser operator to continue sampling or whether to stop sampling after the first 5 seconds of data collection. Nevertheless, no data point was collected in excess of 10 seconds of sampling. Further, to provide realistic measures of performance no data point was taken out of the pool of the attempted PIRL-MS sampling events on any other grounds to skew the assessment of the duty cycle, except for one data point that contained only 16 mass peaks. In embodiments where the spectral inclusion/exclusion criteria discussed above are included, automated assessment of the unacceptable, poor quality PIRL-MS data points prior to statistical analysis may be done, which may reduce the chance of sampling error that could potentially lead to misclassification of tumour subgroup affiliation which may have grave consequences in a clinical setting.

Statistical Validity of MB Classification

Since prior knowledge of the expected subgroup affiliation existed for all of the MB tumours examined here, unsupervised multivariate statistical methods such as Principal Component Analysis (PCA) were not pursued to discover latent features present in the PIRL-MS spectra[50]. While PCA can also be used to reveal group affiliations, its application for this purpose requires within group variations that are less than between group variations[50]. Considering group affiliation information existed for the data samples, and the extent of within group variation was not available to justify use of PCA, PLS-DA was chosen to determine statistical validity as recommended[50]. However, to address the statistical robustness of the separation seen in FIG. 23A a 5% leave-out-and-remodel test was performed in which 5% of the PIRL-MS data points from both SHH and Group 3 datasets were iteratively removed, and the 5% data points were considered as pseudo-unknown entities. A model was then created based on the 95% remainder of all data points, and a 3 component PLS-DA analysis was performed where the two reference datasets consisted of the SHH and Group 3 PIRL-MS data (95%, as model), with the test dataset being the 5% pseudo-unknowns. The PIRL-MS data points of the pseudo-unknowns were then ranked for how they grouped within the 95% interval area of the expected MB subgroup based on the iterative model predictions.

Referring now to FIG. 24, shown therein is the resultant 21 PLS-DA scores plots for pseudo-unknown datasets that were iteratively left out and scored for expected MB grouping. The dataset was oversampled for an additional 7% to create identical weight of representation for both SHH and Group 3 data points. The plots of FIG. 24 indicate the statistical robustness of MB subclass prediction with PIRL MS through a 5% leave out and remodel test. Plots are shown for 21 runs of 3-component Partial Least Squares Discriminant Analysis (PLS-DA) where 10 PIRL MS data points were iteratively taken out (oversampled dataset of 210 points), and ranked as pseudo-unknowns for correct grouping with the expected MB subgroup data from a model constructed from the remainder 95% of the PIRL MS data points. Each run is labelled with a run number accordingly in FIG. 24. Outliers are clearly indicated in each run. A total of 12 outlier data points were identified indicating a 94% correct prediction rate for MB affiliation prediction. Shaded ovals in each panel represent the 95% confidence interval for each data group. No misclassification of data points was seen, and none of the 21 models exhibited a breakdown with overlaps in 95% confidence interval, which would have otherwise been indicative of the failure of the model.

Identification of MB Subgroup Biomarker Ions

To further highlight the individual m/z values (or biomarker ions) that best characterize MB SHH and Group 3 cancers, in FIG. 23B the PLS-DA loading plot was shown. This representation illustrates how individual m/z values contribute to the statistical discrimination between PRIL-MS profiles of the MB Group 3 and the SHH subgroup shown in FIG. 21. The m/z values that are located at the periphery of the plot contribute most strongly to the discrimination between the two MB subgroups examined in this study, and may be considered as univariate biomarker ions of each MB subgroup. The loading plots, thus, provide a pictorial representation of the rank order with which univariate m/z values contribute to the statistical discrimination visualized by the multivariate PLS-DA scores plot shown in FIG. 23A. Table 1, shown previously, summarizes the m/z values extracted from loading plots that are responsible for the statistical separation of MB subclasses. The majority of the m/z values identified in the PLS-DA loading plot were present in the single cell line representative PIRL-MS spectra shown in FIG. 21 using DAOY and MED8A tumours.

Molecular Classification of MB Cell Lines Based on PIRL-MS Profiling

Capitalizing on the specificity with which PIRL ablation is able to extract lipids and small molecules from tumours, the possibility of further statistically classifying the PIRL-MS dataset based on cell line origin was examined. Thus, the 194 PIRL-MS spectra were grouped into their respective 6 classes of cell types, and subjected the dataset thereof to a 6-component PLS-DA assessment. The datasets that overlap in occupying the same area in the PLS-DA scores plot are considered statistically indistinguishable. FIG. 25 shows a plot of specificity of PIRL-MS analysis allows statistical discrimination of some MB cell lines based on lipid content. Shaded ovals represent the 95% confidence interval.

As seen in FIG. 25, with the exception of only two outliers that contained weaker than average MS signals, some of the PIRL-MS data points of individual MB cell lines show distinct statistical grouping. Most pronounced are the DAOY and UW228 cell lines that exhibit a drastic grouping within the SHH subgroup. The outlier UW228 sample E1 had only 149 mass peaks identified in its PIRL-MS spectrum, and the weak signal associated with D341, sample B3 (TIC=$6.9\times10^4$) resulted in only 105 identified peaks. The ONS76 cell line, on the other hand, was shown to possess a hybrid characteristic between the other two SHH cell lines, as in PLS-DA space it occupies an area in between DAOY and UW228 data sets along the axis of statistical separation.

The results for Group 3 cell lines were slightly different. Here, the D341 and D458 were essentially identical from the statistical point of view, and the MED8A cell line also showed some degree of lipid profile overlap with the other two Group 3 cell lines that were examined. While genomic sequencing data exist for some of the established MB cell lines, lack of a 1 to 1 correspondence between the genomic profile and its small molecule metabolite or lipid subsets precludes a direct comparison of the seen rank order based on PIRL-MS profiling to the known trends suggested by genomic approaches[52]. For example, it is not known whether the genomic similarity index of D341 and D458 replicates the expected lipid profiling results seen here with PIRL-MS, or whether ONS76 possesses a genomic similarity index with either of the DAOY or UW228 cell lines that is smaller than that between DAOY and UW228 lines.

With respect to the confounding effect of sample heterogeneity that is largely lacking in xenograft models which is a caveat of the experimental study discussed herein, in FIGS. 26A-26B a low complexity PLS-DA analysis shows that only utilizes ~30 m/z values identified in Table 1 as specific biomarker ions for SHH and Group 3 MB was sufficient to statistically distinguish between cell lines of these two subgroups.

Referring now to FIGS. 26A-26B, shown therein is a Low complexity Partial Least Squares Discriminant Analysis (PLS-DA) which suggests that the discovered biomarker ions are robust determinants of MB subgroup affiliation. Here performed PLS-DA assessment of the statistical discrimination between Group 3 and SHH subgroups was performed as shown in FIG. 26A as well as between the 6 MB cell lines of D341, D458, MED8A, DAOY, ONS76 and UW228 as shown in FIG. 26B using only ~30 m/z values listed in Table 1 as biomarker ions for SHH and Group 3 MB. As illustrated in FIGS. 26A-26B, in both cases, this reduced complexity assessment resulted in approximately the same pattern of statistical separation seen using the full m/z range. This assessment used a mass tolerance of 25 mDa after post process correction of mass shift using internal mass lock, as described in the methods section above.

It is advantageous that this analysis only uses MB specific m/z values to provide statistical discrimination and not the entire m/z range of PIRL-MS profiles since the entire m/z range may harbor signatures of sample heterogeneity. The separation seen in FIGS. 26A and 26B suggests that the biomarker ions reported in Table 1 can serve as robust determinants of MB subgroup affiliation. In the absence of significant ion suppression[53], it is expected that the influence of sample heterogeneity on the abundance of MB specific biomarker ions is small. In case a PIRL-MS data point is obtained through an ablation event from a region that contains a non-MB heterogeneity, it is expected that the reduced complexity assessment proposed herein may be highly sensitive to such a change, providing a red flag for data point exclusion on the basis of drastic mismatch between the expected and the observed reduced complexity PIRL-MS profiles. Such exclusion may be difficult to ascertain using the entire m/z range due to low sensitivity to change in molecular composition. This observation may also open up the use in tumour grading of simpler detection platforms with reduced multiplexing capabilities compared to full size mass spectrometers.

It has been shown herein that through 5-10 second of sampling with PIRL-MS with soft ionization it is possible to distinguish xenografts of Group 3 MB from the SHH subgroup.

In another aspect, in at least one example embodiment, in accordance with the teachings herein, there is provided a method of identification of material by mass spectrometry, wherein the method comprises: identifying and exposing a surface of a material to be analyzed; generating a gaseous variant of the material using any of the methods described in accordance with the teachings herein; transporting the gaseous material towards a heat source; generating ionized molecules by using the heat source to facilitate heat-induced evaporative soft ionization of molecules in the gaseous material using any of the methods described in accordance with the teachings herein; analyzing the ionized molecules with a mass spectrometer to obtain mass spectra; comparing the mass spectra against a database of known mass spectrometer profiles; and identifying the material through matches with the database.

In some embodiments, the identifying comprises matching the material based on a type of cancer or a type of disease. Alternatively, in some embodiments, the identifying comprises matching the material based on cancer subtypes or closely related subclasses of a same cancer type.

In some embodiments, the identifying act involves using multivariate statistical comparison between a mass spectrometry profile of the material to known profiles of the material present in a library and in which the multivariate statistical comparison uses only a portion of the entire mass spectrum. For example, only a selected subset of mass peaks in the mass spectrum are used. Preferably, the selected subset of mass peaks can be those mass peaks that correspond to at least one of known biomarkers of a disease, a cancer type and a cancer subtype.

In embodiments in which only a selected subset of mass peaks in the mass spectrum are used, the multivariate statistical comparison may comprise using MS data normalized to total intensity of the selected subset of mass peaks.

While the applicant's teachings described herein are in conjunction with various embodiments for illustrative purposes, it is not intended that the applicant's teachings be limited to such embodiments. On the contrary, the applicant's teachings described and illustrated herein encompass various alternatives, modifications, and equivalents, without generally departing from the embodiments described herein.

REFERENCES

1. Balog, J. et al. Intraoperative tissue identification using rapid evaporative ionization mass spectrometry. *Sci Transl Med* 5, 194ra193, doi:5/194/194ra93 [pii] 10.1126/scitranslmed.3005623 (2013).
2. Balog, J. et al. Identification of biological tissues by rapid evaporative ionization mass spectrometry. *Anal Chem* 82, 7343-7350, doi:10.1021/ac101283x (2010).

3. Balog, J. et al. Instantaneous Identification of the Species of Origin for Meat Products by Rapid Evaporative Ionization Mass Spectrometry. *J Agric Food Chem*, doi: 10.1021/acs.jafc.6b01041 (2016).
4. Sachfer, K. C. et al. In situ, real-time identification of biological tissues by ultraviolet and infrared laser desorption ionization mass spectrometry. *Anal Chem* 83, 1632-1640, doi:10.1021/ac102613m (2011).
5. He, J. et al. Air flow assisted ionization for remote sampling of ambient mass spectrometry and its application. *Rapid Commun Mass Spectrom* 25, 843-850, doi: 10.1002/rcm.4920 (2011).
6. Guest, W. H. Recent Developments of Laser Microprobe Mass Analyzers, Lamma-500 and Lamma-1000. *Int J Mass Spectrom* 60, 189-199 (1984).
7. Zou, J. et al. Ambient Mass Spectrometry Imaging with Picosecond Infrared Laser Ablation Electrospray Ionization (PIR-LAESI). *Analytical Chemistry* 87, 12071-12079 (2015).
8. Nemes, P. & Vertes, A. Atmospheric-pressure molecular imaging of biological tissues and biofilms by LAESI mass spectrometry. *J Vis Exp*, doi:2097 [pii] 10.3791/2097 (2010).
9. Jecklin, M. C., Gamez, G., Touboul, D. & Zenobi, R. Atmospheric pressure glow discharge desorption mass spectrometry for rapid screening of pesticides in food. *Rapid Commun Mass Spectrom* 22, 2791-2798, doi: 10.1002/rcm.3677 (2008).
10. Na, N., Zhao, M., Zhang, S., Yang, C. & Zhang, X. Development of a dielectric barrier discharge ion source for ambient mass spectrometry. *J Am Soc Mass Spectrom* 18, 1859-1862, doi:10.1016/j.jasms.2007.07.027 (2007).
11. Jorabchi, K., Westphall, M. S. & Smith, L. M. Charge assisted laser desorption/ionization mass spectrometry of droplets. *J Am Soc Mass Spectrom* 19, 833-840, doi: 10.1016/j.jasms.2008.02.012 (2008).
12. Galhena, A. S., Harris, G. A., Nyadong, L., Murray, K. K. & Fernandez, F. M. Small molecule ambient mass spectrometry imaging by infrared laser ablation metastable-induced chemical ionization. *Anal Chem* 82, 2178-2181, doi:10.1021/ac902905v (2010).
13. Kwiatkowski, M., M. Wurlitzer, A. Krutilin, P. Kiani, R. Nimer, M. Omidi, A. Mannaa, T. Bussmann, K. Bartkowiak, S. Kruber, S. Uschold, P. Steffen, J. Lubberstedt, N. Kupker, H. Petersen, R. Knecht, N. O. Hansen, A. Zarrine-Afsar, W. D. Robertson, R. J. Miller and H. Schluter (2016). "Homogenization of tissues via picosecond-infrared laser (PIRL) ablation: Giving a closer view on the in-vivo composition of protein species as compared to mechanical homogenization." *J Proteomics* 134: 193-202.
14. U.S. Pat. No. 8,029,501B2 titled LASER SELECTIVE CUTTING BY IMPULSIVE HEAT DEPOSITION IN THE IR WAVELENGTH RANGE FOR DIRECT-DRIVE ABLATION issued on Oct. 4, 2011 to Miller, R J Dwayne.
15. Balog, J., T. Szaniszlo, K. C. Schaefer, J. Denes, A. Lopata, L. Godorhazy, D. Szalay, L. Balogh, L. Sasi-Szabo, M. Toth and Z. Takats (2010). "Identification of biological tissues by rapid evaporative ionization mass spectrometry." *Anal Chem* 82(17): 7343-7350.
16. Sachfer, K. C., T. Szaniszlo, S. Gunther, J. Balog, J. Denes, M. Keseru, B. Derso, M. Toth, B. Spengler and Z. Takats (2011). "In situ, real-time identification of biological tissues by ultraviolet and infrared laser desorption ionization mass spectrometry." *Anal Chem* 83(5): 1632-1640.
17. Schafer, K. C., J. Balog, T. Szaniszlo, D. Szalay, G. Mezey, J. Denes, L. Bognar, M. Oertel and Z. Takats (2011). "Real time analysis of brain tissue by direct combination of ultrasonic surgical aspiration and sonic spray mass spectrometry." *Analytical Chemistry* 83(20): 7729-7735.
18. Balog, J., S. Kumar, J. Alexander, O. Golf, J. Huang, T. Wiggins, N. Abbassi-Ghadi, A. Enyedi, S. Kacska, J. Kinross, G. B. Hanna, J. K. Nicholson and Z. Takats (2015). "In vivo endoscopic tissue identification by rapid evaporative ionization mass spectrometry (REIMS)." *Anqew Chem Int Ed Enql* 54(38): 11059-11062.
19. Cowan, M. L., B. D. Bruner, N. Huse, J. R. Dwyer, B. Chugh, E. T. Nibbering, T. Elsaesser and R. J. Miller (2005). "Ultrafast memory loss and energy redistribution in the hydrogen bond network of liquid H2O." *Nature* 434(7030): 199-202.
20. Schafer, K. C., J. Denes, K. Albrecht, T. Szaniszlo, J. Balog, R. Skoumal, M. Katona, M. Toth, L. Balogh and Z. Takats (2009). "In vivo, in situ tissue analysis using rapid evaporative ionization mass spectrometry." *Anqew Chem Int Ed Enql* 48(44): 8240-8242.
21. Balog, J., L. Sasi-Szabo, J. Kinross, M. R. Lewis, L. J. Muirhead, K. Veselkov, R. Mirnezami, B. Derso, L. Damjanovich, A. Darzi, J. K. Nicholson and Z. Takats (2013). "Intraoperative tissue identification using rapid evaporative ionization mass spectrometry." *Sci Transl Med* 5(194): 194ra193.
22. Amini-Nik, S., D. Kraemer, M. L. Cowan, K. Gunaratne, P. Nadesan, B. A. Alman and R. J. Miller (2010). "Ultrafast mid-IR laser scalpel: protein signals of the fundamental limits to minimally invasive surgery." *PLoS One* 5(9).
23. Northcott, P. A., A. Korshunov, H. Witt, T. Hielscher, C. G. Eberhart, S. Mack, E. Bouffet, S. C. Clifford, C. E. Hawkins, P. French, J. T. Rutka, S. Pfister and M. D. Taylor (2011). "Medulloblastoma comprises four distinct molecular variants." *J Clin Oncol* 29(11): 1408-1414.
24. Ramaswamy, V., M. Remke, E. Bouffet, S. Bailey, S. C. Clifford, F. Doz,
M. Kool, C. Dufour, G. Vassal, T. Milde, 0. Witt, K. von Hoff, T. Pietsch, P. A. Northcott, A. Gajjar, G. W. Robinson, L. Padovani, N. Andre, M. Massimino, B. Pizer, R. Packer, S. Rutkowski, S. M. Pfister, M. D. Taylor and S. L. Pomeroy (2016). "Risk stratification of childhood medulloblastoma in the molecular era: the current consensus." *Acta Neuropathol* 131(6): 821-831.
25. Sabha, N., C. B. Knobbe, M. Maganti, S. Al Omar, M. Bernstein, R. Cairns, B. Cako, A. von Deimling, D. Capper, T. W. Mak, T. R. Kiehl, P. Carvalho, E. Garrett, A. Perry, G. Zadeh, A. Guha and C. Sidney (2014). "Analysis of IDH mutation, 1p/19q deletion, and PTEN loss delineates prognosis in clinical low-grade diffuse gliomas." *Neuro Oncol* 16(7): 914-923.
26. Gottardo, N. G., J. R. Hansford, J. P. McGlade, F. Alvaro, D. M. Ashley, S. Bailey, D. L. Baker, F. Bourdeaut, Y. J. Cho, M. Clay, S. C. Clifford, R. J. Cohn, C. H. Cole, P. B. Dallas, P. Downie, F. Doz, D. W. Ellison, R. Endersby, P. G. Fisher, T. Hassall, J. A. Heath, H. L. Hii, D. T. Jones, R. Junckerstorff, S. Kellie, M. Kool, R. S. Kotecha, P. Lichter, S. J. Laughton, S. Lee, G. McCowage, P. A. Northcott, J. M. Olson, R. J. Packer, S. M. Pfister, T. Pietsch, B. Pizer, S. L. Pomeroy, M. Remke, G. W. Robinson, S. Rutkowski, T. Schoep, A. A. Shelat, C. F. Stewart, M. Sullivan, M. D. Taylor, B. Wainwright, T. Walwyn, W. A. Weiss, D. Williamson and A. Gajjar (2014). "Medulloblastoma Down Under 2013: a report from the third annual meeting of the International Medulloblastoma Working Group." *Acta Neuropathol* 127(2): 189-201.

27. Ifa, D. R. and L. S. Eberlin (2016). "Ambient Ionization Mass Spectrometry for Cancer Diagnosis and Surgical Margin Evaluation." *Clin Chem* 62(1): 111b 123.
28. Zhang, J. L., W. D. Yu, J. Suliburk and L. S. Eberlin (2016). "Will Ambient Ionization Mass Spectrometry Become an Integral Technology in the Operating Room of the Future?" *Clinical Chemistry* 62(9): 1172-1174.
29. Takats, Z., N. Strittmatter and J. S. McKenzie (2017). "Ambient Mass Spectrometry in Cancer Research." *Adv Cancer Res* 134: 231-256.
30. Fenselau, C., D. N. Heller, J. K. Olthoff, R. J. Cotter, Y. Kishimoto and O. M. Uy (1989). "Desorption of ions from rat membranes: selectivity of different ionization techniques." *Biomed Environ Mass Spectrom* 18(12): 1037-1045.
31. Dill, A. L., D. R. Ifa, N. E. Manicke, Z. Ouyang and R. G. Cooks (2009). "Mass spectrometric imaging of lipids using desorption electrospray ionization." *J Chromatogr B Analyt Technol Biomed Life Sci* 877(26): 2883-2889.
32. Dill, A. L., L. S. Eberlin, C. Zheng, A. B. Costa, D. R. Ifa, L. Cheng, T. A. Masterson, M. O. Koch, O. Vitek and R. G. Cooks (2010). "Multivariate statistical differentiation of renal cell carcinomas based on lipidomic analysis by ambient ionization imaging mass spectrometry." *Anal Bioanal Chem* 398(7-8): 2969-2978.
33. Eberlin, L. S., A. L. Dill, A. B. Costa, D. R. Ifa, L. Cheng, T. Masterson, M. Koch, T. L. Ratliff and R. G. Cooks (2010). "Cholesterol sulfate imaging in human prostate cancer tissue by desorption electrospray ionization mass spectrometry." *Analytical Chemistry* 82(9): 3430-3434.
34. Dill, A. L., L. S. Eberlin, A. B. Costa, C. Zheng, D. R. Ifa, L. Cheng, T. A. Masterson, M. O. Koch, O. Vitek and R. G. Cooks (2011). "Multivariate statistical identification of human bladder carcinomas using ambient ionization imaging mass spectrometry." *Chemistry* 17(10): 2897-2902.
35. Eberlin, L. S., I. Norton, A. L. Dill, A. J. Golby, K. L. Ligon, S. Santagata, R. G. Cooks and N. Y. Agar (2012). "Classifying human brain tumors by lipid imaging with mass spectrometry." *Cancer Res* 72(3): 645-654.
36. Gerbig, S., O. Golf, J. Balog, J. Denes, Z. Baranyai, A. Zarand, E. Raso, J. Timar and Z. Takats (2012). "Analysis of colorectal adenocarcinoma tissue by desorption electrospray ionization mass spectrometric imaging." *Anal Bioanal Chem* 403(8): 2315-2325.
37. Eberlin, L. S., I. Norton, D. Orringer, I. F. Dunn, X. Liu, J. L. Ide, A. K. Jarmusch, K. L. Ligon, F. A. Jolesz, A. J. Golby, S. Santagata, N. Y. Agar and R. G. Cooks (2013). "Ambient mass spectrometry for the intraoperative molecular diagnosis of human brain tumors." *Proc Natl Acad Sci USA* 110(5): 1611-1616.
38. Jarmusch, A. K., V. Pirro, Z. Baird, E. M. Hattab, A. A. Cohen-Gadol and R. G. Cooks (2016). "Lipid and metabolite profiles of human brain tumors by desorption electrospray ionization-MS." *Proc Natl Acad Sci USA* 113(6): 1486-1491.
39. Zhang, J., W. Yu, J. Suliburk and L. S. Eberlin (2016). "Will Ambient Ionization Mass Spectrometry Become an Integral Technology in the Operating Room of the Future?" *Clin Chem* 62(9): 1172-1174.
40. Wiseman, J. M., D. R. Ifa, Q. Song and R. G. Cooks (2006). "Tissue imaging at atmospheric pressure using desorption electrospray ionization (DESI) mass spectrometry." *Angew Chem Int Ed Engl* 45(43): 7188-7192.
41. Woolman, M., A. Tata, E. Bluemke, D. Dara, H. J. Ginsberg and A. Zarrine-Afsar (2016). "An Assessment of the Utility of Tissue Smears in Rapid Cancer Profiling with Desorption Electrospray Ionization Mass Spectrometry (DESI-MS)." *J Am Soc Mass Spectrom.*
42. Tata, A., M. Woolman, M. Ventura, N. Bernards, M. Ganguly, A. Gribble, B. Shrestha, E. Bluemke, H. J. Ginsberg, A. Vitkin, J. Zheng and A. Zarrine-Afsar (2016). "Rapid Detection of Necrosis in Breast Cancer with Desorption Electrospray Ionization Mass Spectrometry." *Sci Rep* 6: 35374.
43. Franjic, K. and D. Miller (2010). "Vibrationally excited ultrafast thermodynamic phase transitions at the water/air interface." *Phys Chem Chem Phys* 12(20): 5225-5239.
44. Franjic, K., M. L. Cowan, D. Kraemer and R. J. Miller (2009). "Laser selective cutting of biological tissues by impulsive heat deposition through ultrafast vibrational excitations." *Opt Express* 17(25): 22937-22959.
45. Woolman, M., A. Gribble, E. Bluemke, J. Zou, M. Ventura, N. Bernards, M. Wu, H. J. Ginsberg, S. Das, A. Vitkin and A. Zarrine-Afsar (2017). "Optimized Mass Spectrometry Analysis Workflow with Polarimetric Guidance for ex vivo and in situ Sampling of Biological Tissues." *Sci Rep* 7(1): 468.
46. Reinoso, R. F., B. A. Telfer and M. Rowland (1997). "Tissue water content in rats measured by desiccation." *J Pharmacol Toxicol Methods* 38(2): 87-92.
47. Xia, J., N. Psychogios, N. Young and D. S. Wishart (2009). "MetaboAnalyst: a web server for metabolomic data analysis and interpretation." *Nucleic Acids Res* 37(Web Server issue): W652-660.
48. Xia, J. and D. S. Wishart (2011). "Metabolomic data processing, analysis, and interpretation using MetaboAnalyst." *Curr Protoc Bioinformatics* Chapter 14: Unit 14 10.
49. Xia, J., I. V. Sinelnikov, B. Han and D. S. Wishart (2015). "MetaboAnalyst 3.0—making metabolomics more meaningful." *Nucleic Acids Res* 43(W1): W251-257.
50. Worley, B. and R. Powers (2013). "Multivariate Analysis in Metabolomics." *Curr Metabolomics* 1(1): 92-107.
51. Fatou, B., P. Saudemont, E. Leblanc, D. Vinatier, V. Mesdag, M. Wisztorski, C. Focsa, M. Salzet, M. Ziskind and I. Fournier (2016). "In vivo Real-Time Mass Spectrometry for Guided Surgery Application." *Sci Rep* 6: 25919.
52. Griffin, J. L. and J. P. Shockcor (2004). "Metabolic profiles of cancer cells." *Nat Rev Cancer* 4(7): 551-561.
53. Furey, A., M. Moriarty, V. Bane, B. Kinsella and M. Lehane (2013). "Ion suppression; a critical review on causes, evaluation, prevention and applications." *Talanta* 115: 104-122.

The invention claimed is:

1. A method for ionizing molecules present in a gaseous material, a vapourized material, a plume material, a desorbed material or an aerosolized material for the purpose of analysis by mass spectrometry, wherein the method comprises:

generating the gaseous material, the vapourized material, the plume material, the desorbed material or the aerosolized material;

heating the gaseous material, the vapourized material, the plume material, the desorbed material or the aerosolized material to generate ions from the molecules present in the gaseous material, the vapourized material, the plume material, the desorbed material or the aerosolized material, where an amount of heat is applied to achieve desolvation and heat-induced evaporative soft ionization of said molecules, the heating being applied in the temperature range of 45° C. to 250° C.; and transporting the ions to a mass spectrometer for analysis.

2. The method of claim 1, wherein the method is utilized to differentiate between tumour subtypes including brain tumour subtypes.

3. The method according to claim 1, wherein a heat-induced soft ionization source is located to apply heat in the temperature range at any point between a site of aerosol, plume, gas or vapour generation and an entrance of the mass spectrometer.

4. The method according to claim 1, wherein the gaseous material, the vapourized material, the plume material, or the aerosolized material is produced using at least one of laser ablation, laser desorption, joules heating, cauterization, electrocautery, radio frequency ablation, ultrasonic aspiration, chemical extraction and aerosol generation using mechanical, acoustic means, laser desorption using a laser having a pulse range of about 1-1000 picoseconds, and pico-second infrared laser ablation or desorption.

5. The method according to claim 1, wherein the gaseous material arises directly from volatile material or the gaseous material is produced in the presence of additional solvent or matrix materials.

6. The method of according to claim 1, wherein the heating is applied in at least one of a range of 50° C. to 150° C., below a level that causes fragmentation or disintegration of one or more molecules of interest, and below the amount of heating used to generate thermal, plasma or corona (glow) ionization.

7. A device comprising:

an input for receiving a gaseous material, a vapourized material, a plume material, a desorbed material or an aerosolized material;

a transport tube coupled to the input and being configured to allow for conduction of heat to facilitate heat-induced evaporative soft ionization of molecules in the gaseous material, the vapourized material, the plume material, the desorbed material or the aerosolized material, where an amount of heat is applied to achieve desolvation and heat-induced evaporative soft ionization of said molecules, the heating being applied in the temperature range of 45° C. to 250° C.; and an output coupled to the transport tube for providing the ionized molecules to a downstream mass spectrometer for analysis.

8. The device of claim 7, wherein the device is used to differentiate between tumour subtypes including brain tumour subtypes.

9. The device according to claim 7, wherein the transport tube is heated using a heat source and a controller coupled to the heat source for controlling the amount of heat provided by the heat source and optionally the device comprises the heat source and the controller.

10. The device according to claim 7, wherein the gaseous material, the vapourized material, the plume material, the desorbed material or the aerosolized material is transported to the mass spectrometer via a flexible tubing attached to an analyte collection tube of an interface of the mass spectrometer.

11. The device according to claim 10, wherein the analyte collection tube is metallic and heating is applied to the analyte collection tube of the mass spectrometer through at least one of elevating a temperature of the mass spectrometer interface, and an external heat source including one at least one of a tape heater, Peltier element, and an infrared radiation source.

12. The device according to claim 11, wherein the temperature of the mass spectrometer interface is maintained at an optimal, manufacturer-suggested working temperature to facilitate the heat-induced evaporative soft ionization of molecules.

13. The device according to claim 7, wherein the heating is applied in at least one of a temperature range that does not cause fragmentation, disintegration or breakdown of one or more molecules of interest and a temperature range of 50° C. to 150° C.

14. A method of identification of material by mass spectrometry, wherein the method comprises:

identifying and exposing a surface of a material to be analyzed;

generating a gaseous variant of the material by using one of a laser having a pulse range of about 1-1000 picoseconds, pico-second infrared laser ablation, nanosecond infrared laser ablation or desorption;

transporting the gaseous material towards a heat source using the pressure gradient provided by the inner workings of a mass spectrometer device in absence of an auxiliary pump or added gas flow;

generating ionized molecules by using the heat source to facilitate heat-induced evaporative soft ionization of molecules in the gaseous material, wherein an amount of heat is applied to achieve desolvation and heat-induced evaporative soft ionization of said molecules;

analyzing said ionized molecules with a mass spectrometer to obtain mass spectra;

comparing said mass spectra against a database of known mass spectrometer profiles; and identifying the material through matches with the database.

15. The method according to claim 14, wherein the identifying comprises matching the material based on at least one of type of cancer, type of disease, cancer subtypes, and closely related subclasses of a same cancer type.

16. The method according to claim 14, wherein the identifying comprises using multivariate statistical comparison between a mass spectrometry profile of the material to known profiles of said material present in a library, wherein said multivariate statistical comparison uses only a portion of the entire mass spectrum.

17. The method according to claim 16, wherein only a selected subset of mass peaks in the mass spectrum are used in the multivariate statistical comparison and the selected subset of mass peaks correspond to at least one of known biomarkers of a disease, a cancer type and a cancer subtype.

18. The method according to claim 16, wherein the multivariate statistical comparison comprises using MS data normalized to total intensity of the selected subset of mass peaks.

19. The method according to claim 14, wherein the heating is applied in the temperature range of 45° C. to 250° C.

* * * * *